US006018322A

United States Patent [19]

Taniguchi et al.

[11] Patent Number: 6,018,322

[45] Date of Patent: Jan. 25, 2000

[54] EARTH STRUCTURE FOR ANTENNAS, AND ANTENNA APPARATUS WITH EARTH FOR VEHICLES

[75] Inventors: Tatsuaki Taniguchi; Kazuo Shigeta, both of Hiroshima-ken; Kenji Kubota, Kure, all of Japan

[73] Assignee: Mazda Motor Corporation, Hiroshima, Japan

[21] Appl. No.: 08/816,369

[22] Filed: Mar. 13, 1997

[30] Foreign Application Priority Data

Mar. 13, 1996 [JP] Japan ..... 8-056542

[51] Int. Cl.[7] ..... H01Q 1/32

[52] U.S. Cl. ..... 343/713; 343/712

[58] Field of Search ..... 343/713, 846, 343/848, 829, 830, 790, 795, 712

[56] References Cited

U.S. PATENT DOCUMENTS

| | | | |
|---|---|---|---|
| 4,940,991 | 7/1990 | Sheriff | 343/795 |
| 5,353,039 | 10/1994 | Tsukada et al. . | |
| 5,659,324 | 8/1997 | Taniguchi et al. | 343/713 |
| 5,663,737 | 9/1997 | Kakizawa . | |

FOREIGN PATENT DOCUMENTS

| | | | |
|---|---|---|---|
| 43 07 232 | 10/1993 | Germany | H01Q 1/32 |
| 61-82502 | 4/1986 | Japan | H01Q 1/32 |
| 20272804 | 11/1990 | Japan | H01Q 1/32 |
| 3-1703 | 1/1991 | Japan | H01Q 1/32 |
| 3-74845 | 11/1991 | Japan . | |
| 5-82113 | 4/1993 | Japan . | |
| 5-152817 | 6/1993 | Japan . | |
| 1 417 715 | 11/1972 | United Kingdom | H01Q 1/22 |

OTHER PUBLICATIONS

Michiaki Ito, et al., "Disc Shaped Mono–Pole Antenna With Wide Range and Directivity–Less Reception Performance", Nagaoka University of Technology, pp. 55–59. (with partial translation of p. 55).

*Primary Examiner*—Don Wong
*Assistant Examiner*—Hoang Nguyen

[57] ABSTRACT

Disclosed is an earth structure which can be easily attached without degrading the antenna performance. The earth structure for grounding a feeder line for transmitting a signal received from an antenna to a receiver or the like has a long earth member having a predetermined length and one end connected to a ground wire of the feeder line. A portion from one end to the other end of the long earth member is not grounded, and the other end is open.

15 Claims, 65 Drawing Sheets

AVERAGE VALUES WITHIN
EVALUATION FREQUENCY RANGE (dB)

| | Pw − AV |
|---|---|
| x60y5 = X | − 14.9 |
| x50y5 = IX | − 13.3 |
| x40y5 = VIII | − 13.2 |
| x30y5 = VII | − 13.0 |
| x25y5 = VI | − 13.3 |
| x15y5 = V | − 14.2 |
| x10y5 = IV | − 15.9 |
| x5y5 = III | − 18.1 |
| x2y5 = II | − 19.3 |
| x0.5y5 = I | − 20.5 |

AVERAGE VALUES WITHIN
EVALUATION FREQUENCY RANGE (dB)

| | Pw − AV |
|---|---|
| x60y10 = X | − 13.6 |
| x50y10 = IX | − 12.0 |
| x40y10 = VIII | − 11.5 |
| x30y10 = VII | − 11.4 |
| x25y10 = VI | − 11.2 |
| x15y10 = V | − 11.8 |
| x10y10 = IV | − 13.0 |
| x5y10 = III | − 14.5 |
| x2y10 = II | − 15.7 |
| x0.5y10 = I | − 17.2 |

AVERAGE VALUES WITHIN EVALUATION FREQUENCY RANGE (dB)

| | Pw − AV |
|---|---|
| x60y15 = X | − 13.3 |
| x50y15 = IX | − 11.6 |
| x40y15 = VIII | − 10.4 |
| x30y15 = VII | − 10.4 |
| x25y15 = VI | − 10.2 |
| x15y15 = V | − 10.5 |
| x10y15 = IV | − 11.2 |
| x5y15 = III | − 12.2 |
| x2y15 = II | − 13.0 |
| x0.5y15 = I | − 14.2 |

AVERAGE VALUES WITHIN
EVALUATION FREQUENCY RANGE (dB)

| | Pw − AV |
|---|---|
| x60y20 = X | − 13.5 |
| x50y20 = IX | − 12.0 |
| x40y20 = VIII | − 10.1 |
| x35y20 = VII | − 9.7 |
| x25y20 = VI | − 9.5 |
| x15y20 = V | − 9.7 |
| x10y20 = IV | − 10.1 |
| x5y20 = III | − 10.6 |
| x2y20 = II | − 11.2 |
| x0.5y20 = I | − 12.0 |

AVERAGE VALUES WITHIN
EVALUATION FREQUENCY RANGE (dB)

| | Pw − AV |
|---|---|
| x50y25 = X | − 12.7 |
| x40y25 = IX | − 10.9 |
| x35y25 = VIII | − 9.8 |
| x30y25 = VII | − 9.3 |
| x25y25 = VI | − 9.1 |
| x15y25 = V | − 9.2 |
| x10y25 = IV | − 9.4 |
| x5y25 = III | − 9.7 |
| x2y25 = II | − 10.0 |
| x0.5y25 = I | − 10.7 |

AVERAGE VALUES WITHIN
EVALUATION FREQUENCY RANGE (dB)

| | Pw − AV |
|---|---|
| x50y30 = X | − 12.9 |
| x40y30 = IX | − 12.0 |
| x35y30 = VIII | − 10.8 |
| x30y30 = VII | − 9.2 |
| x25y30 = VI | − 9.1 |
| x20y30 = V | − 9.1 |
| x15y30 = IV | − 9.2 |
| x10y30 = III | − 9.1 |
| x5y30 = II | − 9.3 |
| x0.5y30 = I | − 10.2 |

AVERAGE VALUES WITHIN
EVALUATION FREQUENCY RANGE (dB)

| | Pw − AV |
|---|---|
| x40y35 = IX | − 12.5 |
| x35y35 = VIII | − 11.9 |
| x30y35 = VII | − 9.5 |
| x25y35 = VI | − 9.6 |
| x20y35 = V | − 9.3 |
| x15y35 = IV | − 9..3 |
| x10y35 = III | − 9.1 |
| x5y35 = II | − 9.2 |
| x0.5y35 = I | − 10.1 |

FIG. 22

AVERAGE VALUES WITHIN
EVALUATION FREQUENCY RANGE (dB)

| | Pw − AV |
|---|---|
| x40y40 = X | − 12.5 |
| x35y40 = IX | − 12.6 |
| x30y40 = VIII | − 10.7 |
| x25y40 = VII | − 10.7 |
| x20y40 = VI | − 10.0 |
| x15y40 = V | − 9.6 |
| x10y40 = IV | − 9.2 |
| x5y40 = III | − 9.3 |
| x2y40 = II | − 9.8 |
| x0.5y40 = I | − 10.5 |

AVERAGE VALUES WITHIN
EVALUATION FREQUENCY RANGE (dB)

| | Pw − AV |
|---|---|
| y3x40 = VIII | − 17.7 |
| y3x35 = VII | − 17.4 |
| y3x30 = VI | − 16.9 |
| y3x25 = V | − 17.7 |
| y3x20 = IV | − 16.2 |
| y3x15 = III | − 14.7 |
| y3x10 = II | − 17.8 |
| y3x5 = I | − 18.8 |

AVERAGE VALUES WITHIN
EVALUATION FREQUENCY RANGE (dB)

| | Pw − AV |
|---|---|
| y5x40 = VIII | − 17.2 |
| y5x35 = VII | − 17.6 |
| y5x30 = VI | − 17.1 |
| y5x25 = V | − 17.2 |
| y5x20 = IV | − 16.3 |
| y5x15 = III | − 15.0 |
| y5x10 = II | − 16.4 |
| y5x5 = I | − 18.0 |

FIG. 49

AVERAGE VALUES WITHIN
EVALUATION FREQUENCY RANGE (dB)

| | Pw − AV |
|---|---|
| y10x40 = Ⅷ | − 16.9 |
| y10x35 = Ⅶ | − 17.1 |
| y10x30 = Ⅵ | − 17.4 |
| y10x25 = Ⅴ | − 16.7 |
| y10x20 = Ⅳ | − 16.0 |
| y10x15 = Ⅲ | − 15.5 |
| y10x10 = Ⅱ | − 15.8 |
| y10x5 = Ⅰ | − 15.5 |

AVERAGE VALUES WITHIN EVALUATION FREQUENCY RANGE (dB)

| | Pw − AV |
|---|---|
| C-SHAPE FRAME ANTENNA (22cm × 9cm) | − 13.7 |
| RECTANGULARA FRAME ANTENNA (GROUND WIRE : 30cm) | − 21.4 |
| CIRCULARA FRAME ANTENNA (GROUND WIRE : 15cm) | − 24.7 |
| | |

AVERAGE VALUES WITHIN EVALUATION FREQUENCY RANGE (dB)

| | Pw − AV |
|---|---|
| C-SHAPE FRAME ANTENNA (22cm × 9cm) | − 15.1 |
| RECTANGULARA FRAME ANTENNA (GROUND WIRE : 30cm) | − 12.6 |
| CIRCULARA FRAME ANTENNA (GROUND WIRE : 15cm) | − 19.8 |
| | |

AVERAGE VALUES WITHIN EVALUATION FREQUENCY RANGE (dB)

| | Pw − AV |
|---|---|
| C-SHAPE FRAME ANTENNA (22cm × 9cm) | − 16.2 |
| RECTANGULARA FRAME ANTENNA (GROUND WIRE : 30cm) | − 16.0 |
| CIRCULARA FRAME ANTENNA (GROUND WIRE : 15cm) | − 17.3 |
| | |

WITH GROUND PLATE

WITHOUT GROUND

AVERAGE VALUES WITHIN
EVALUATION FREQUENCY RANGE (dB)

| | Pw – AV |
|---|---|
| T-SHAPE FRAME ANTENNA (GROUND WIRE : 90cm) | – 15.1 |
| GROUND PLATE | – 13.3 |
| | |

AVERAGE VALUES WITHIN
EVALUATION FREQUENCY RANGE (dB)

| | Pw – AV |
|---|---|
| T-SHAPE FRAME ANTENNA (GROUND WIRE : 53.5cm) | – 13.3 |
| GROUND PLATE | – 12.3 |
| | |

AVERAGE VALUES WITHIN
EVALUATION FREQUENCY RANGE (dB)

| | Pw – AV |
|---|---|
| T-SHAPE FRAME ANTENNA (GROUND WIRE : 30cm) | – 14.2 |
| GROUND PLATE | – 12.3 |
| | |

AVERAGE VALUES WITHIN
EVALUATION FREQUENCY RANGE (dB)

| | Pw – AV |
|---|---|
| T-SHAPE FRAME ANTENNA (GROUND WIRE : 20cm) | – 18.1 |
| GROUND PLATE | – 17.4 |
| | |

AVERAGE VALUES WITHIN
EVALUATION FREQUENCY RANGE (dB)

| | Pw – AV |
|---|---|
| RECTANGULAR FRAME ANTENNA (GROUND WIRE : 30cm) | – 12.5 |
| GROUND PLATE | – 12.1 |
| | |

FIG. 88

AVERAGE VALUES WITHIN
EVALUATION FREQUENCY RANGE (dB)

| | Pw – AV |
|---|---|
| RECTANGULAR FRAME ANTENNA (GROUND WIRE : 10cm) | – 15.1 |
| GROUND PLATE | – 15.2 |
| | |

WITHOUT GROUND

10cm

AVERAGE VALUES WITHIN EVALUATION FREQUENCY RANGE (dB)

| | Pw – AV |
|---|---|
| GROUND WIRE : 90cm | – 16.2 |
| DIRECTLY GROUNDED | – 15.9 |

EARTH STRUCTURE FOR ANTENNAS, AND ANTENNA APPARATUS WITH EARTH FOR VEHICLES

BACKGROUND OF THE INVENTION

1. Field of the Invention

The present invention relates to an antenna apparatus with earth for vehicles provided on a glass window pane of a vehicle or the like, and to the structure of ground or earth for an antenna.

2. Related Art

Vehicular window panes limit drivers' sight. To ensure visibility, various legal regulations are made on vehicular antennas provided on the window panes. Accordingly, the glass antennas must be designed within predetermined limitations regulations on size, width and length.

The above limitations on the shape of the glass antennas by the regulations have serious influence on performance of glass antennas which are already disadvantageous in comparison with rod antennas in point of sensitivity.

Known conventional glass antennas, such as a vehicular antenna device disclosed in Japanese Patent Publication No. 3-74845 and a loop-shaped glass antenna disclosed in Japanese Patent Application Laid-Open No. 3-1703, are not made with consciousness of the regulations, but are well-designed in antenna shape. Further, an antenna according to an article "Disc Shaped Mono-Pole Antenna with Wide Range and Directivity-less Reception Performance" (by Michiaki Ito and Hajime Seki) is known.

The vehicular antenna device in Japanese Patent Publication No. 3-74845 is made based on the relation between the antenna and a metal pillar. That is, the length of the pillar is set to $\lambda/2$ ($\lambda$: wavelength of received wave) or shorter, while the length of the antenna is $\lambda/4$ or shorter. Since this prior art is made on the relation between the antenna and the pillar, and the antenna is basically a mono-pole type antenna, it includes no reference regarding a widthwise direction. Therefore, in consideration of present vehicle size, this antenna device is applicable to the FM band at most.

The glass antenna in Japanese Patent Application Laid-Open No. 3-1703 has a 200 to 1500 mm loop shape, a conductive wire is provided to connect the antenna at a feeding point in approximately parallel to a longitudinal central line of the vehicle. This prior art is made on the point of the total length of the loop antenna, however, the relation between a longitudinal length and a transversal length of the antenna is not considered. Accordingly, to clear the regulations and attain high reception performance, trials and errors with various lengths in the lengthwise and widthwise directions must be repeated within a range of 200 to 1500 mm.

The disk mono-pole type antenna as shown in the above article has a wide range performance with a round disk shape. However, this shape obstructs a driver's sight if the antenna is applied as a vehicular glass antenna. If the size of this antenna is reduced to ensure the driver's sight, a desired performance may not be attained.

Japanese Patent Laid-Open No. 50-24928 has proposed an antenna arranged behind a sideview mirror, although no proposal for the size of the antenna has been made.

Conventional antenna apparatuses for vehicles are also disclosed in Japanese Patent Laid-Open Nos. 61-82502 and 2-272804 and Japanese Utility Model Laid-Open No. 5-82113.

In Japanese Patent Laid-Open Nos. 61-82502 and 2-272804 and Japanese Utility Model Laid-Open No. 5-82113, screwing, adhesion, or a ground pattern is employed to ground the jacket line (shield line) of the feeder line of the antenna apparatus. For this reason, it is difficult to optionally attach an antenna earth structure to the vehicle.

Japanese Patent Laid-Open No. 5-152817 has proposed a ground wire provided along an antenna harness to prevent a decrease in reception sensitivity. In this prior art, a line soldered to the shield line of the feeder line is used as a ground wire, thereby facilitating attachment of the ground wire to the body. However, the earth structure of Japanese Patent Laid-Open No. 5-152817 has a ground wire set along the vehicle harness. That is, this structure assumes a harness provided near the antenna mounting portion and therefore cannot be applied to a vehicle without any harness near the antenna mounting portion. Even for a vehicle with a harness, it is difficult for the user to attach a ground wire to the harness.

SUMMARY OF THE INVENTION

The present invention has been made in consideration of the problems of the prior arts, and has as its object to provide an earth structure which can be further easily grounded without degrading antenna performance.

It is another object of the present invention to provide an earth structure and an antenna apparatus for vehicles, which can be further easily grounded without degrading the antenna performance and visibility.

In order to achieve the above objects, according to the present invention, there is provided an earth structure connected to a feeder line for transmitting a signal received from an antenna. More specifically, according to the present invention, there is provided an earth structure which is formed independently of an electrically conductive member functioning as earth, having:

an earth line member having a first end portion connected to one end of an antenna feeder line and a second end portion which is open, wherein a portion extending from the first end portion to the second end portion of the earth line member is insulated from the electrically conductive member, arranged along the conductive member, and attached to a vehicle side independently of a harness provided on the vehicle.

Since the second end portion is open, the earth line member forms a transmission line, and the potential of the first end portion almost becomes zero, so that the earth line portion substantially functions as earth. Therefore, the performance of an antenna attached with this earth structure is not degraded. Since the second end portion is open, the earth structure need not be fixed. In addition, the earth structure can be easily attached because it is provided on the vehicle independently of the harness.

The above object can also be achieved by an earth structure having the following arrangement. According to the present invention, there is also provided an earth structure formed independently of an electrically conductive member functioning as earth, having:

an earth line member having a first end portion connected to one end of an antenna feeder line and a second end portion which is open and serves as a transmission line, wherein a portion extending from the first end portion to the second end portion of the earth line member is insulated from the electrically conductive member and arranged along the conductive member, and a length of the earth line member is set in correspondence with a wavelength of a radio wave to be received.

Since the length of the earth line member is set in correspondence with the wavelength of the radio wave to be received, the earth structure can achieve predetermined earth performance.

The above object can also be achieved by an earth structure having the following arrangement. According to the present invention, there is also provided an earth structure formed independently of an electrically conductive member functioning as earth, having:

an earth line member having a first end portion connected to one end of an antenna feeder line and a second end portion which is open and serves as a transmission line, wherein a portion extending from the first end portion to the second end portion of the earth line member is insulated from the electrically conductive member and arranged along the conductive member, and attached to a vehicle side independently of a harness provided on the vehicle, and a length of the earth line member is set in correspondence with a wavelength of a radio wave to be received.

According to a preferred aspect of the present invention, the feeder line has a coaxial shield line. In this case, the first end portion of the earth line member is connected to a portion of the shield line.

According to the preferred aspect of the present invention, to make the earth structure suitable for the vehicle, the metal portion of the body of the vehicle is used as the electrically conductive member.

According to the preferred aspect of the present invention, to make the earth structure suitable for the vehicle, the earth line member is arranged to extend on the window glass of the vehicle. With the path reduction effect of the glass, the earth line member can be shortened.

According to the preferred aspect of the present invention, to use the earth structure for the vehicle, the earth line member is covered with an insulating material.

According to the preferred aspect of the present invention, the earth line member is insulated from the feeder line and bundled. Therefore, the earth line member can easily serve as a transmission line.

According to the preferred aspect of the present invention, the earth line member is flexible so as to be easily attached.

According to the preferred aspect of the present invention, the first end portion of the earth line member is arranged near the electrically conductive member so that the conductive member easily functions as earth.

According to the preferred aspect of the present invention, the length of the earth line member as the transmission line is set such that an impedance with respect to the first end portion substantially becomes zero.

According to the preferred aspect of the present invention, the length from the first end portion to the second end portion of the earth line member is set to be substantially ¼ the wavelength $\lambda$ of the radio wave to be received.

According to the preferred aspect of the present invention, the earth line member is arranged along the electrically conductive member through a predetermined insulating layer (e.g., an air layer or the paint layer of the vehicle body) having a path reduction ratio $\delta$, and the length of the earth line member is set to be $\delta \cdot \lambda/4$.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 22 is a table showing average reception sensitivities obtained within an evaluation frequency range when y is 40 cm;

FIG. 49 is a table showing average UHF reception characteristics (average reception sensitivities in an evaluation frequency range) in the antenna system in FIG. 1 when y is 10 cm;

FIG. 88 is a table showing averaged reception characteristics of the rectangular antenna according to the first embodiment (reception band: 470–770 MHz; ground length=10 cm);

DETAILED DESCRIPTION OF THE PREFERRED EMBODIMENTS

Preferred embodiments of the present invention will now be described in detail in accordance with the accompanying drawings as examples where an antenna according to the present invention is provided on a glass, especially on a vehicular window glass. In the following embodiments, the glass antenna is applied to a front window glass (first embodiment), a rear window glass (second embodiment) and a side window glass (third embodiment).

An example in which the earth structure of the present invention is applied to the antenna of the above embodiment will be described below with reference to FIGS. 61 to 67, FIGS. 81 and 82, and FIGS. 99 to 111B.

The glass antenna attains objects characteristic of setting positions in the respective embodiments (i.e., in the first embodiment, to ensure front sight; in the second embodiment, to eliminate influence by a defogger etc.). Further, modifications of the embodiments (i.e., a grounded antenna using a ground plate and a grounded antenna using a ground wire) will be described.

First Embodiment

Figure 1:
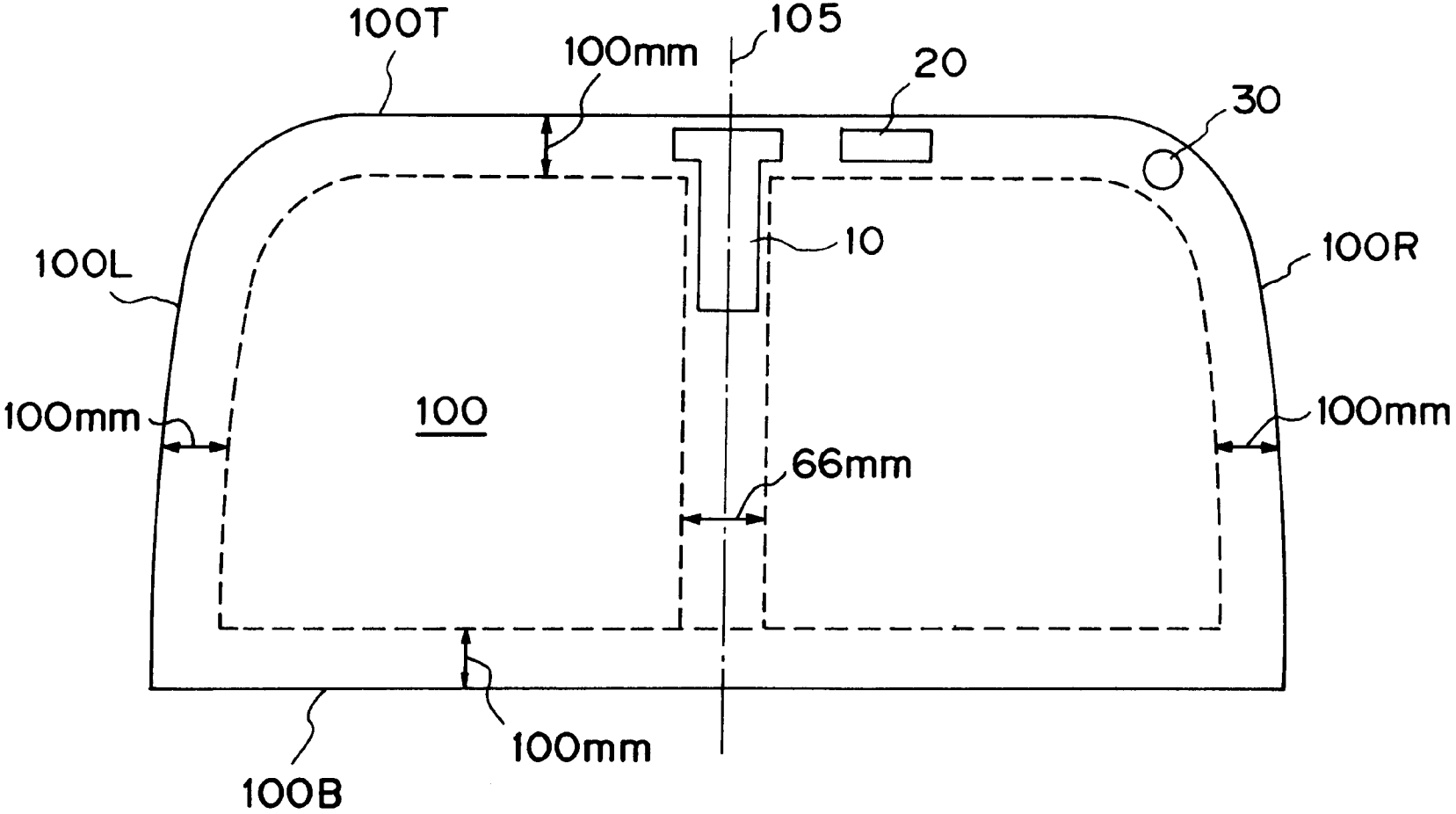
FIG. 1 is a schematic diagram of a vehicular front window glass to which an antenna system according to a first embodiment of the present invention is applied.

FIG. 1 shows a front glass window 100 to which a glass antenna system according to a first embodiment is applied, as a front overview of a vehicle body. In this figure, the right side of the front glass window 100 corresponds to the left side of the vehicle, and the left side of the front glass window 100, the right side of the vehicle.

Figure 4:
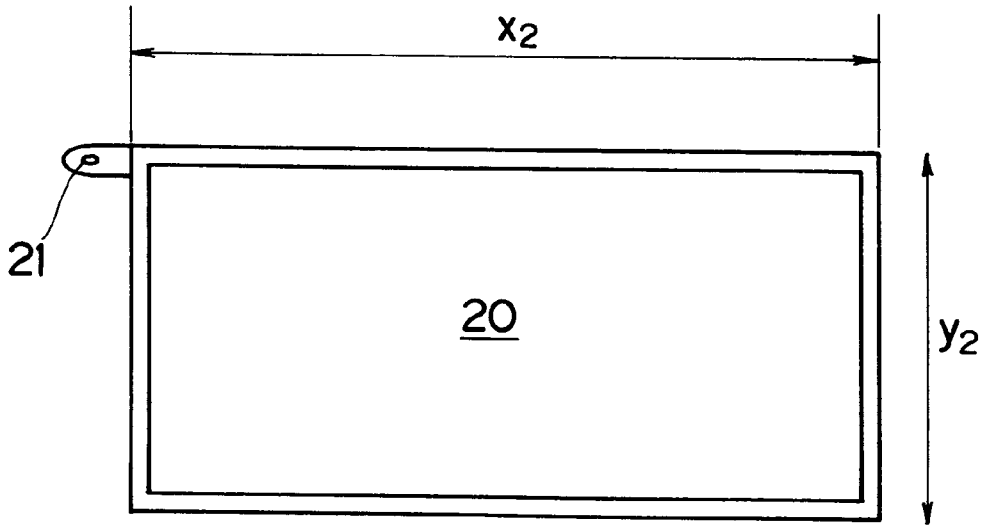
FIG. 4 is a schematic diagram showing a structure of an antenna 20 of the antenna system in FIG. 1.
Figure 5:
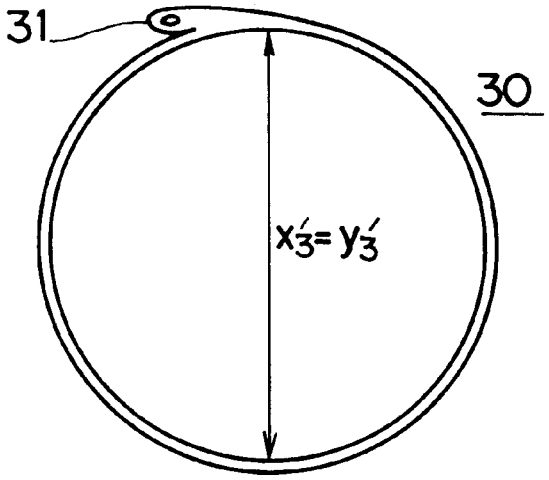
FIG. 5 is a schematic diagram showing a structure of an antenna 30 of the antenna system in FIG. 1.

The window glass 100 is provided with three antennas 10, 20 and 30, on the inner surface. The antenna 10 is mainly for receiving radio waves in the FM and TV broadcast bands. The antenna 10 is a T-shape loop antenna having a width (transversal length, i.e., length in a vehicular widthwise direction) $x_1$ (e.g. 10 cm), and a height (longitudinal length, i.e., length in a window height direction) $y_1$ (e.g. 20 cm) longer than the length $x_1$. The antenna 20 is a rectangular loop antenna long sideways, having a width (transversal length) $x_2$ longer than a height (longitudinal length) $y_2$, as shown in FIG. 4. The antenna 30 placed at the rightmost position on the window glass 100 is a circular loop antenna as shown in FIG. 5. The antennas 10, 20 and 30 constitute a diversity antenna system.

The transversal length x and the longitudinal length y of these antennas are in the following relation:

$$y \leq \frac{\lambda}{4} \cdot \alpha \tag{1}$$

$$60\ \text{cm} - y \geqq x \tag{2}$$

$\lambda$: reception frequency wavelength $\alpha$: glass reduction ratio

The meaning of expression (2) (i.e., the sum of the x and y does not exceed 60 cm) will be described later. An appropriate reception sensitivity can be obtained by setting the size of the antennas in accordance with expressions (1) and (2).

Referring to FIG. 1, opaque objects may be set on the window glass 100 within a peripheral band area delimited by the alternate long and short dashed line and a central band area surrounded by the broken lines, without violating the regulations in Japan. Accordingly, the antenna can be placed or set in these areas with no problem.

Although window glass is basically transparent, the regulations are concerned with areas that are actually transparent. Specifically, on the vehicle body to which the front window glass 100 is attached, a ceramic coating layer and a moling surround the window glass 100. The ceramic coating layer and the mole are opaque, and intercept or block driver's sight. Accordingly, the regulations are concerned only with peripheral areas where opaque obstacles are not provided. Positions where these opaque members end around the peripheral area on the window glass 100 will be called as "reference base" lines, for convenience. Thus, the window glass 100 has four peripheral areas which are transparent: the area which is lower than the reference base line 100T, the area which is upper than the reference base line 100B, the area which is at left side than the reference base line 100R, and the area which is right side than the reference base line 100L. These transparent peripheral areas on the glass window 100 do not obstruct the driver's sight. Accordingly, in FIG. 1, as these areas having a 10 cm width from the reference base lines 100T, 100B, 100R and 100L toward the center of the window glass 100 are not regulated against attachments, there is no legal control on width of the glass antennas within this band-shaped area.

Next, the shapes of the antennas 10, 20 and 30 will be more concretely described below. First, the shape of the antenna 10 will be described.

The T-shape antenna 10 is longer in length than in width. Upon placing this antenna on the front glass window 100, not to obstruct the driver's sight (driver's seat is at the left side position in the U.S.A. and European countries while it is at the right side position in Japan), the antenna 10 is placed within a central band area, having a width symmetrically 66 mm from a center line 105 of the front window glass 100.

The antennas 20 and 30 are shorter than 10 cm in length, thus can be placed at an upper (or lower) position on the window glass 100 with no problem, and the width of the antennas 20 and 30 can be determined in accordance with a target frequency band and reception sensitivity regardless of the regulations. Note that if the length of the antennas 20 and 30 along the center line 105 exceeds 10 cm from the above reference base line 100T or 100B, the antennas 20 and 30 are placed within the central band area having the 66 mm width on the center line 105. That is, in this case, a part of the antennas 20 and 30 that exceeds 10 cm in length from the reference base line 100T or 100B is preferably set within 66 mm in width.

The antenna 20 (FIG. 4) is designed such that the height $y_2$ is within 100 mm so as not to obstruct the driver's sight, within a range satisfying the above expressions (1) and (2), e.g., $x_2$=15 cm and $y_2$=65 mm.

Similarly, the antenna 30 (FIG. 5) is designed such that a diameter $x_3$=$y_3$ is within 100 mm (e.g., 80 mm) so as to be placed within the 100 mm band area.

The antenna 10 (FIG. 3) is designed such that a length $L_y$ in the height $y_1$ is within 100 mm and a length $L_x$ in the width $x_1$ is within 66 mm (e.g., 66 mm).

Thus the antennas 10, 20 and 30 can be placed on the front window glass 100 without obstructing the driver's sight. Note that the antenna 10 comprises of a combination of regular rectangular shapes, and the antenna 20, also a regular rectangular shape. The antenna 30 has a perfect round shape.

The antenna 10 is placed on approximately the center of the window glass 100. At this position, usually (e.g., in Japan) an automobile inspection sticker is stuck onto the window glass 100. The size of the automobile inspection sticker is normally 70 mm×70 mm. Assuming that the inner size of the upper rectangular part of the antenna loop is $x_1' \times L_y'$, the automobile inspection sticker can be placed within the loop of the antenna 10 by setting the size of the upper rectangular part so as to satisfy:

$$x_1' > 70 \text{ mm} \quad (3)$$

$$L_y' > 70 \text{ mm} \quad (4)$$

Drivers are obliged to change the automobile inspection sticker periodically. If expressions (3) and (4) are satisfied, a conductive wire of the antenna 10 is not at a position overlapped with the position of the automobile inspection sticker. This prevents inadvertent removal of the conductive wire when the automobile inspection sticker is changed by the user.

In Japan, a periodic service sticker is also stuck within the right half area of the window glass 100. The periodic service sticker has a round shape. As shown in FIG. 5, assuming that the inner size of the antenna loop is $x_3'=y_3'$, and the size of the sticker is S, the relation between the inner size and the seal size is as follows:

$$x_3'=y_3'>S$$

Then inadvertent removal of a conductive wire of the antenna 30 upon changing the periodic service sticker can be prevented.

Figure 2:
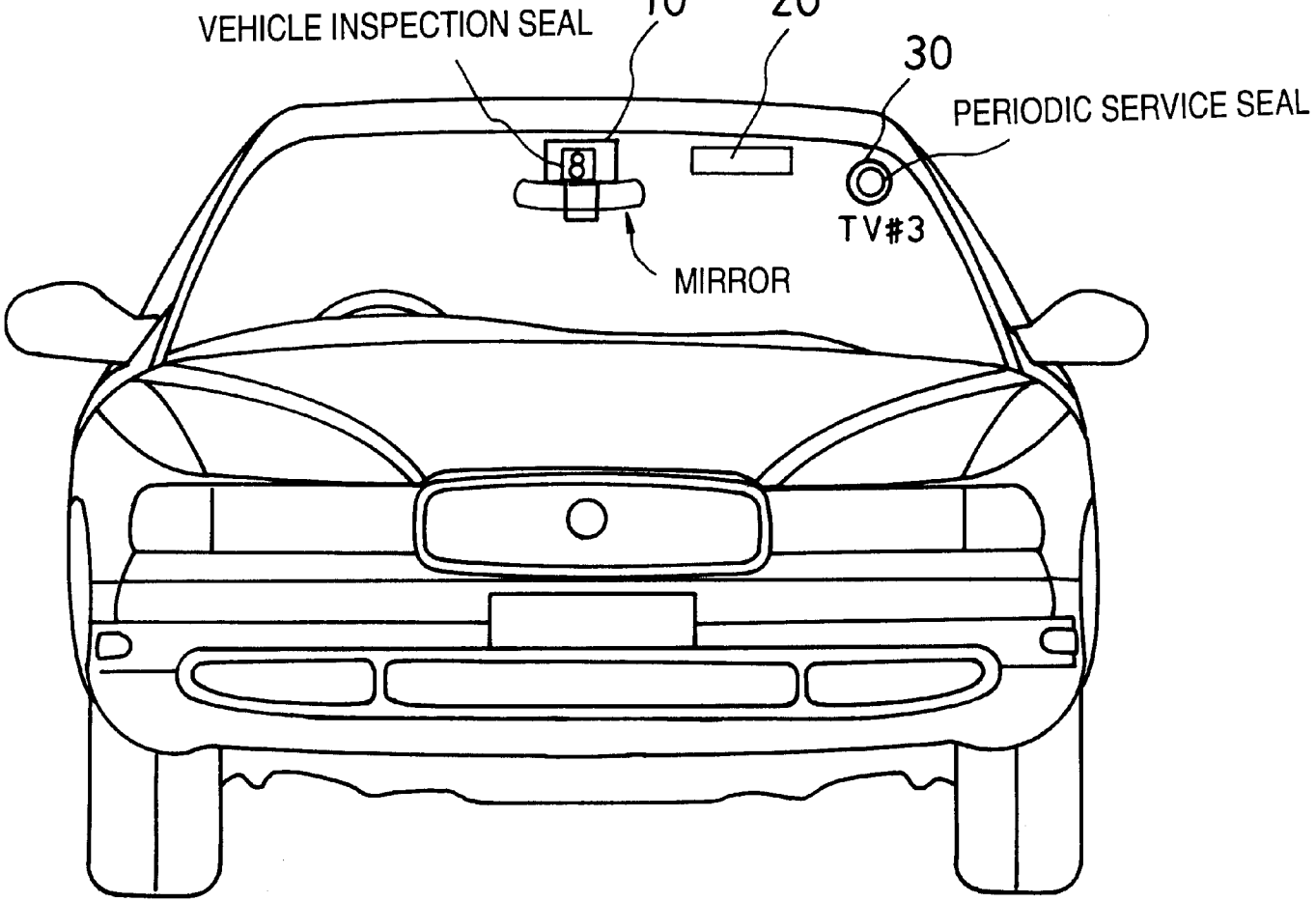
FIG. 2 is a front overview of a vehicle to which an antenna 10 of the antenna system in FIG. 1 is attached.

FIG. 2 shows antenna patterns set on the front window glass, on which the automobile inspection sticker and the periodic service sticker are stuck.

Attachment of Antenna

The glass antennas of the first embodiment are to be provided on the front window glass, therefore, it is desirable that the antennas can be easily attached there. For this purpose, the antennas 10, 20 and 30 should have adhesive material on the backs, and they should be removed from protective sheets and stuck onto the window glass.

Figure 3:
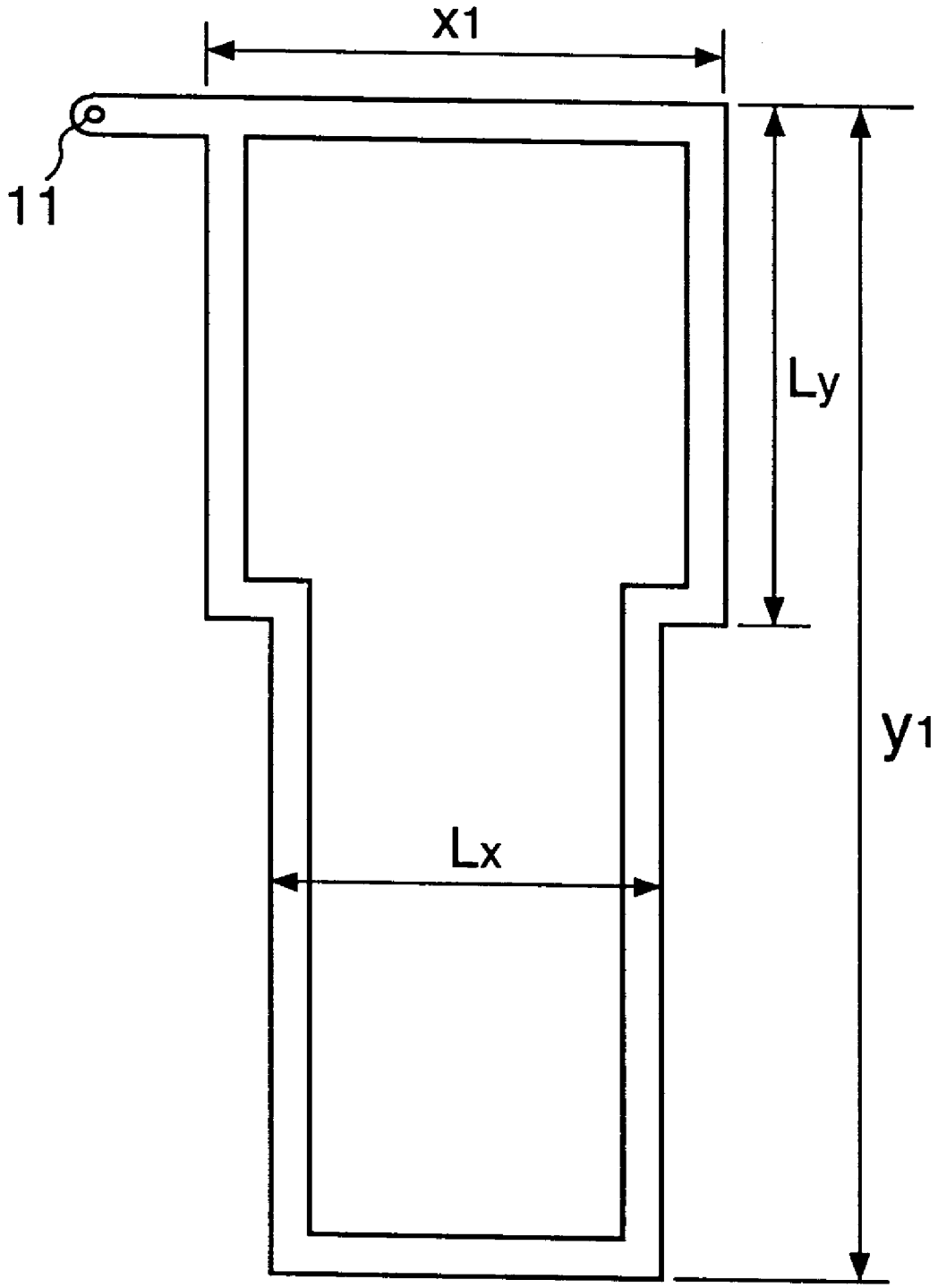
FIG. 3 is a schematic diagram showing a structure of the antenna 10 of the antenna system in FIG. 1.

The attachment of the three antennas in FIGS. 3 to 5 can be made by various methods. If the antenna shapes and the attachment positions are fixed, a thin-plate type conductive wire is attached to the window glass at a window glass factory by a well-known method. In this case, the conductive wire for feeding electric current can be arranged at the best position not to obstruct the driver's sight. Further, a ground wire can be connected to the vehicle body with the minimum ground resistance.

Generally, whether or not the antenna is placed on the front window glass depends on the driver's preference. The first embodiment employs a method which enables a driver to easily attach the conductive wire onto the front window glass shipped from the factory. For this purpose, it is desirable to provide a sheet, on which an adhesive layer is applied, on the conductive wire.

Figure 6:
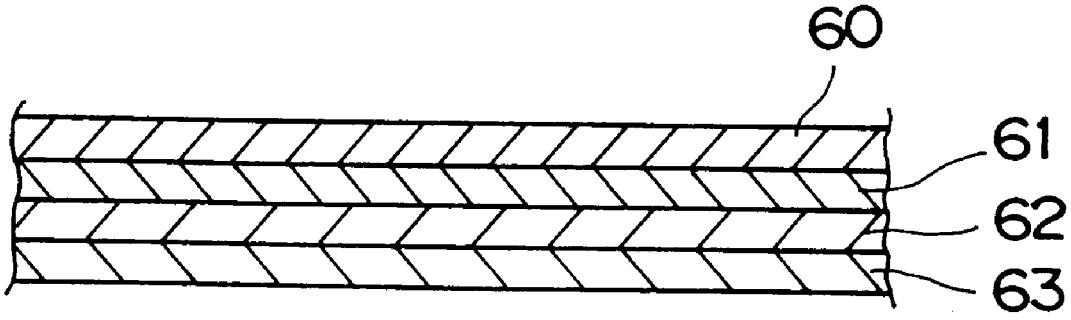
FIG. 6 is a cross-sectional view showing a structure of an antenna product before the antennas in FIG. 1 are attached.

FIG. 6 shows a cross-sectional view of the antenna of this type. That is, as shown in FIG. 6, the antennas 10, 20 and 30 have a protective film 60, an adhesive layer 62 and a paper base layer 63. The adhesive layer 62 is formed on the paper base layer 63. A bonding-agent layer is formed between the adhesive layer 62 and the conductive wire layer 61, and the bonding-agent layer combines the adhesive layer 62 and the conductive wire layer 61. The protective film 60 is formed on the conductive wire layer 61. The protective film 60 is formed only on the surface of the conductive wire, thus prevents oxidation of the conductive wire and protects the conductive wire from damages. When the user pulls the paper base layer 63, the paper base layer 63 is separated from the adhesive layer 62, then the adhesive layer 62 is exposed. The user can attach the antenna having the exposed adhesive layer 62 at a desired position on the window glass. The antenna is preferably attached onto the inner surface of the window glass in consideration of durability.

Relation Between Width x and Height y

FIGS. 7, 9, 11, 13, 15, 17, 19 and 21 are graphs respectively showing reception sensitivities with respect to a reception radio wave in the FM radio and UHF TV broadcast bands when the height y of the antenna 10 is set to a fixed value while the width x is changed. FIGS. 8, 10, 12, 14, 16, 18, 20 and 22 are tables showing average reception sensitivities obtained from the above graphs.

Figures 7, 8:
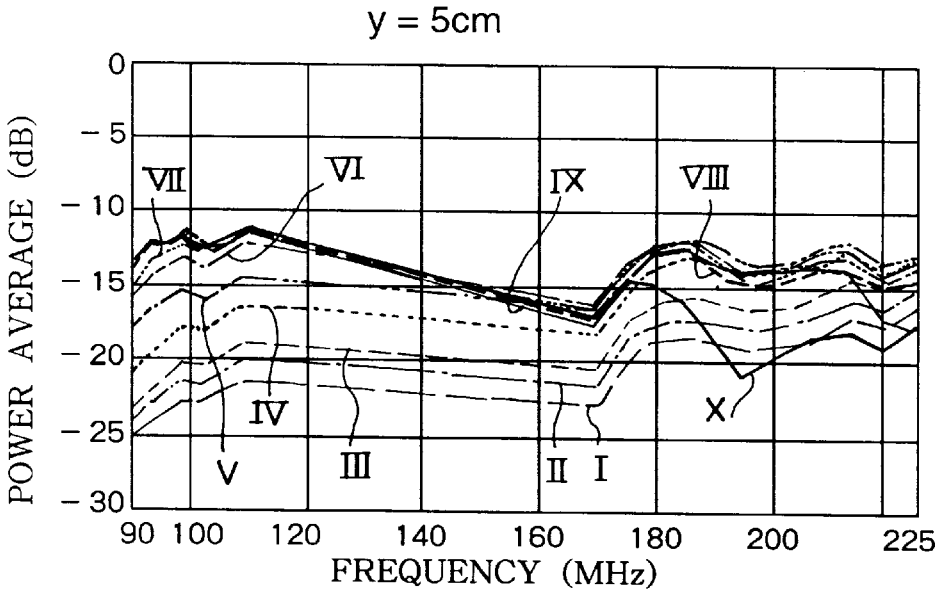
FIG. 7 is a graph showing reception sensitivities with respect to various x (width) values when y (height) is 5 cm.
FIG. 8 is a table showing average reception sensitivities obtained within an evaluation frequency range when y is 5 cm.

FIG. 7, for example, shows reception sensitivity by a curve I when the height y is 5 cm and the width x is 0.5 cm; reception sensitivity by a curve II when the width x is 2 cm; reception sensitivity by a curve III when the width x is 5 cm; reception sensitivity by a curve IV when the width x is 10 cm; reception sensitivity by a curve V when the width x is 15 cm; reception sensitivity by a curve VI when the width x is 25 cm; reception sensitivity by a curve VII when the width x is 30 cm; reception sensitivity by a curve VIII when the width x is 40 cm; reception sensitivity by a curve IX when the width x is 50 cm; and reception sensitivity by a curve X when the width x is 60 cm. FIG. 8 shows average reception sensitivities obtained by averaging the test reception sensitivities of the antenna 10 in FIG. 7 within an evaluation frequency range.

Figures 9, 10:
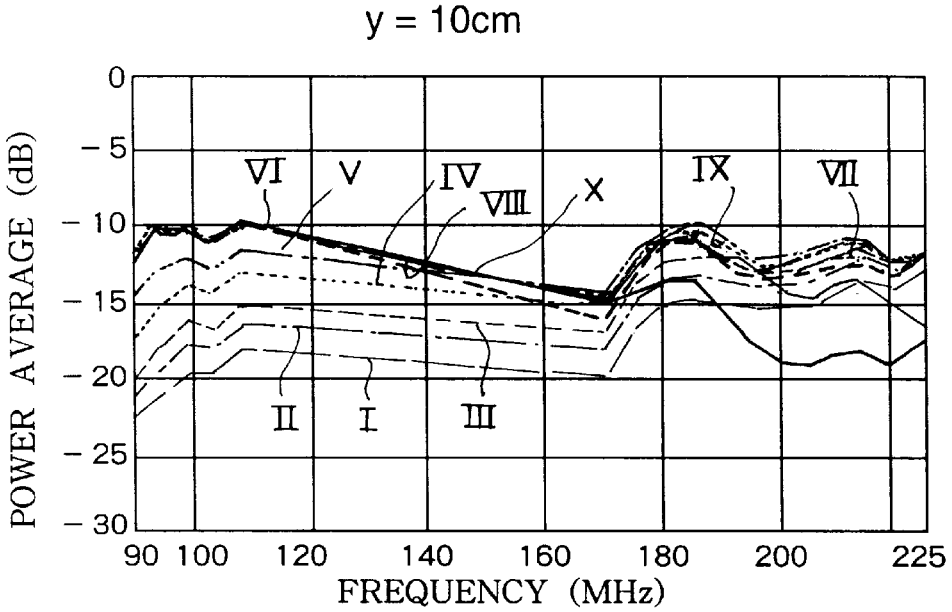
FIG. 9 is a graph showing reception sensitivities with respect to various x values when y is 10 cm.
FIG. 10 is a table showing average reception sensitivities obtained within an evaluation frequency range when y is 10 cm.
Figures 11, 12:
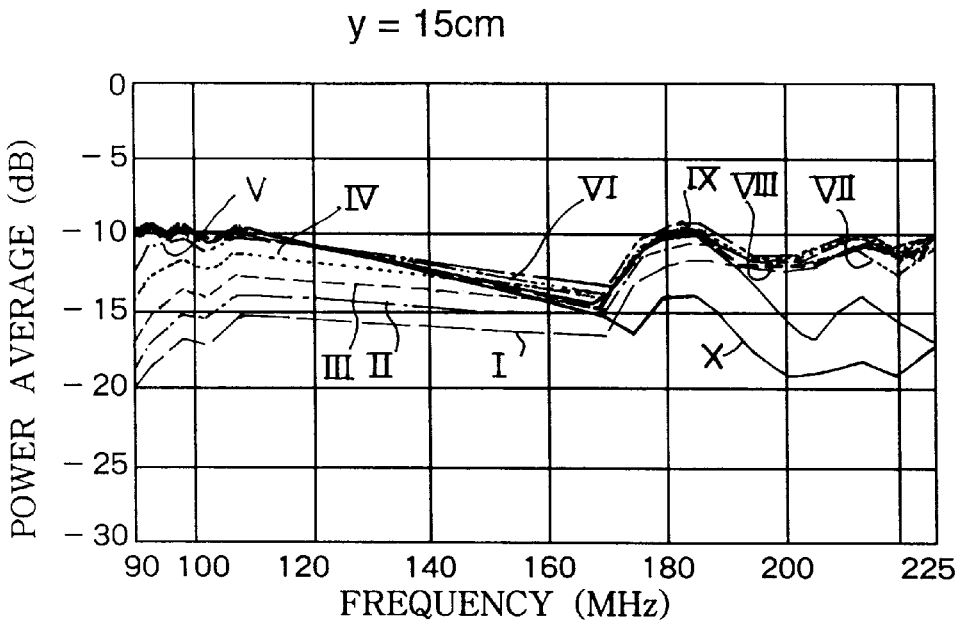
FIG. 11 is a graph showing reception sensitivities with respect to various x values when y is 15 cm.
FIG. 12 is a table showing average reception sensitivities obtained within an evaluation frequency range when y is 15 cm.
Figures 13, 14:
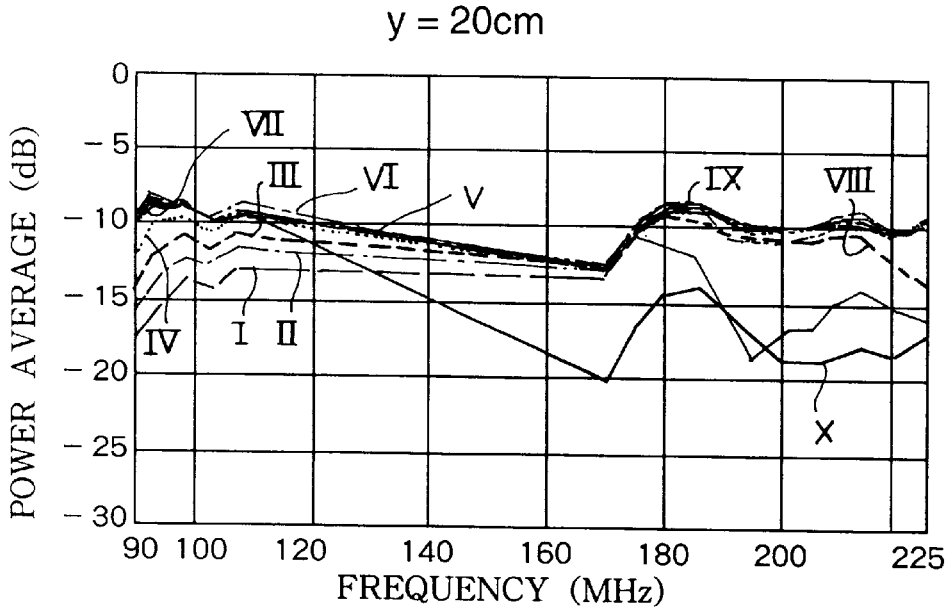
FIG. 13 is a graph showing reception sensitivities with respect to various x values when y is 20 cm.
FIG. 14 is a table showing average reception sensitivities obtained within an evaluation frequency range when y is 20 cm.
Figure 15:
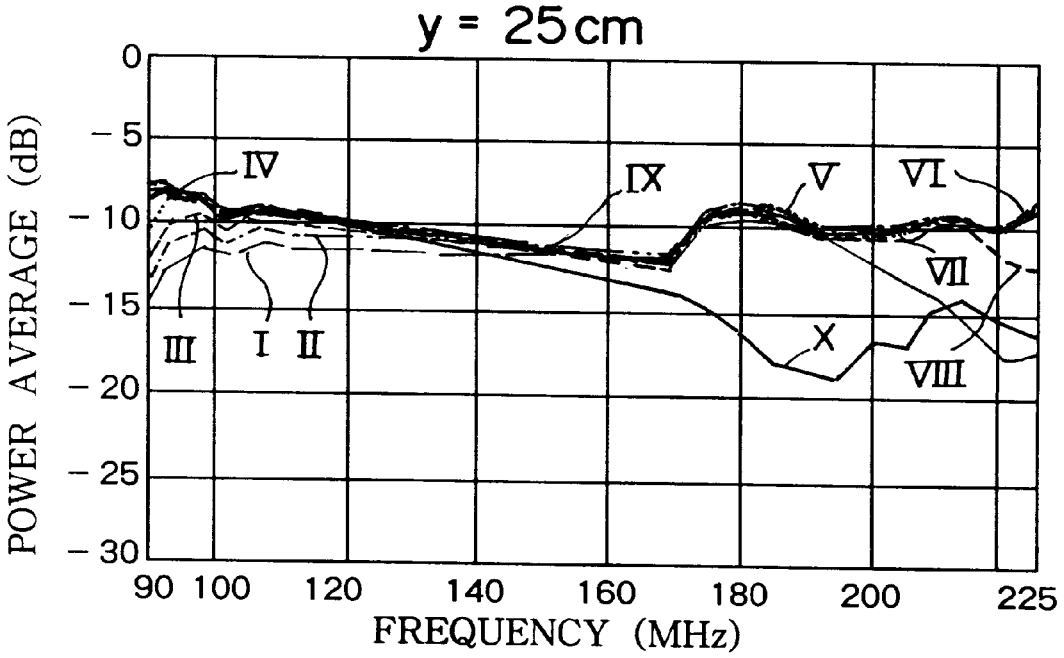
FIG. 15 is a graph showing reception sensitivities with respect to various x values when y is 25 cm.
Figures 16, 17:
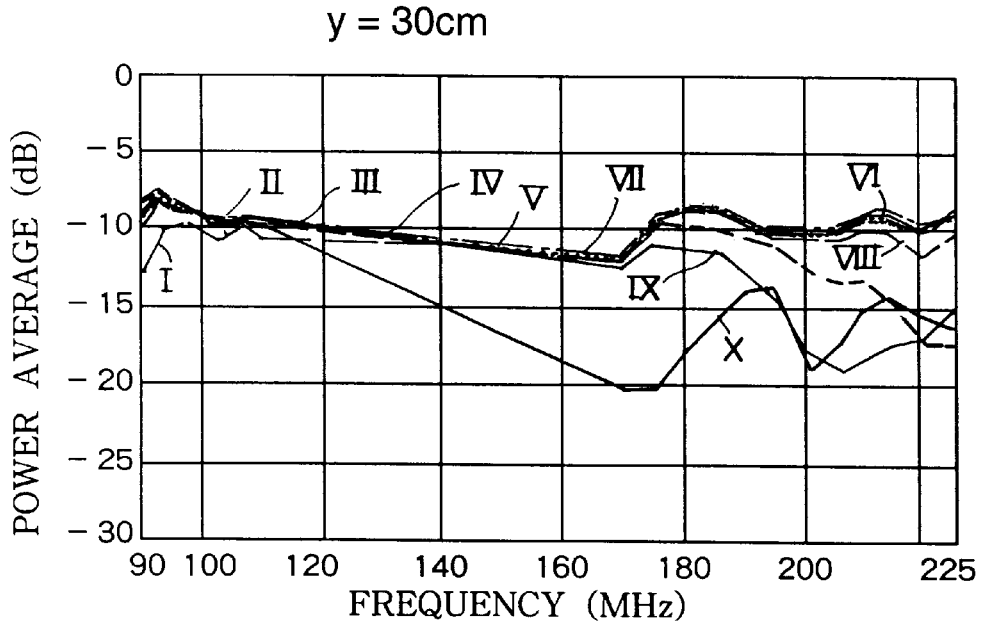
FIG. 16 is a table showing average reception sensitivities obtained within an evaluation frequency range when y is 25 cm.
FIG. 17 is a graph showing reception sensitivities with respect to various x values when y is 30 cm.
Figures 18, 19:
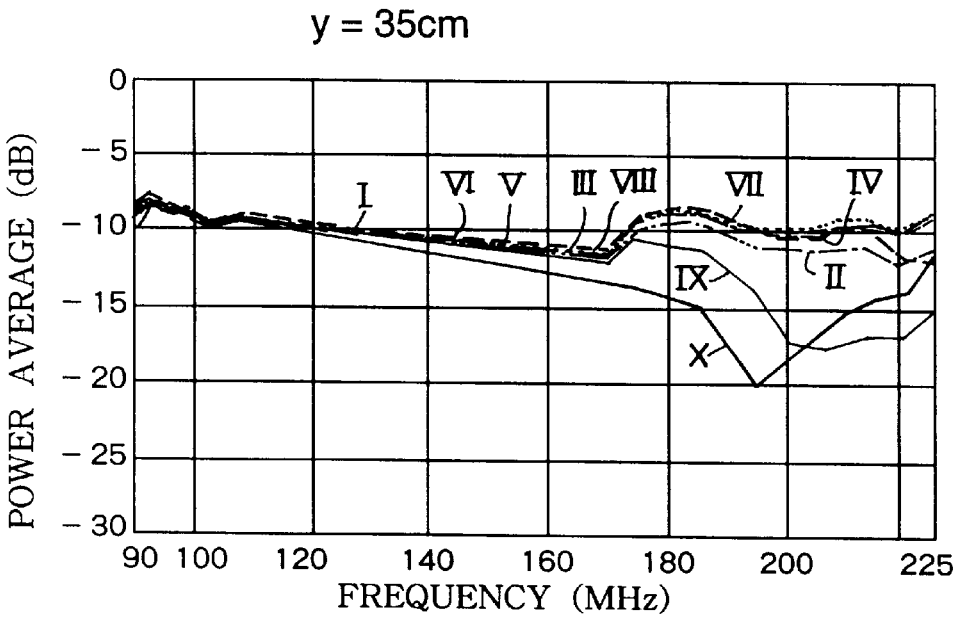
FIG. 18 is a table showing average reception sensitivities obtained within an evaluation frequency range when y is 30 cm.
FIG. 19 is a graph showing reception sensitivities with respect to various x values when y is 35 cm.
Figures 20, 21:
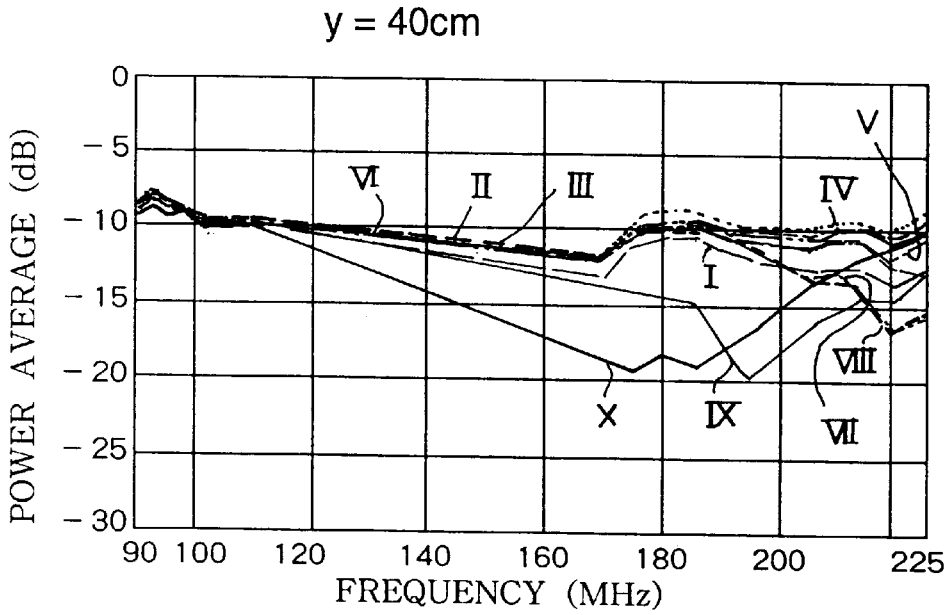
FIG. 20 is a table showing average reception sensitivities obtained within an evaluation frequency range when y is 35 cm.
FIG. 21 is a graph showing reception sensitivities with respect to various x values when y is 40 cm.

The table of average reception sensitivities of FIG. 10 corresponds to the graph of FIG. 9 (y=10 cm); the table of average reception sensitivities of FIG. 12, the graph of FIG. 11 (y=15 cm); the table of average reception sensitivities of FIG. 14, the graph of FIG. 13 (y=20 cm); the table of average reception sensitivities of FIG. 16, the graph of FIG. 15 (y=25 cm); the table of average reception sensitivities of FIG. 18, the graph of FIG. 17 (y=30 cm); the table of average reception sensitivities of FIG. 20, the graph of FIG. 19 (y=35 cm); and the table of average reception sensitivities of FIG. 22, the graph of FIG. 21 (y=40 cm).

These figures indicate that the antenna 10 (and 20 and 30) can obtain practical sensitivities when the height y is within about 40 cm:

$$y \leq \frac{\lambda}{4} \cdot \alpha \quad (\lambda\text{: reception radio wavelength})$$

Further, FIGS. 7 to 22 show a tendency that when x≈y holds, an obtained reception sensitivity is low, on the other hand, when x>y or x<y holds, a relatively high reception sensitivity can be obtained. That is, when the longitudinal length (height) y stands within a range $(0 \ldots \lambda/4)\cdot\alpha$, and it is relatively shorter than the transversal length (width) x (y<x), an excellent reception sensitivity can be obtained in a high frequency area. Further, the high reception sensitivity characteristic can be obtained with respect to the width x in a wide range. On the other hand, when the height y stands within a range $(0 \ldots \lambda/4)\cdot\alpha$, and it is relatively longer than the width x (y>x), an excellent reception sensitivity can be obtained in a low frequency area. Also, the high reception sensitivity characteristic can be obtained with respect to the width x in a wide range.

Further, an ideal reception sensitivity can be obtained mainly in the TV UHF band if the height y and the width x are set within the following ranges:

$$8 \text{ cm} \leqq y \leqq 40 \text{ cm}$$

$$x \leqq 30 \text{ cm}$$

The band where the excellent reception sensitivity can be ensured changes as the width x changes. It is apparent that if the sum of the height y and the width x exceeds 60 cm, the reception sensitivity is degraded.

Note that in consideration of the legal regulations as shown in FIG. 1, it is more preferable to set the x and y values within the following ranges:

$$7\text{ cm} \leqq x \leqq 30\text{ cm}$$

$$7\text{ cm} \leqq y \leqq 30\text{ cm}$$

Figure 44:
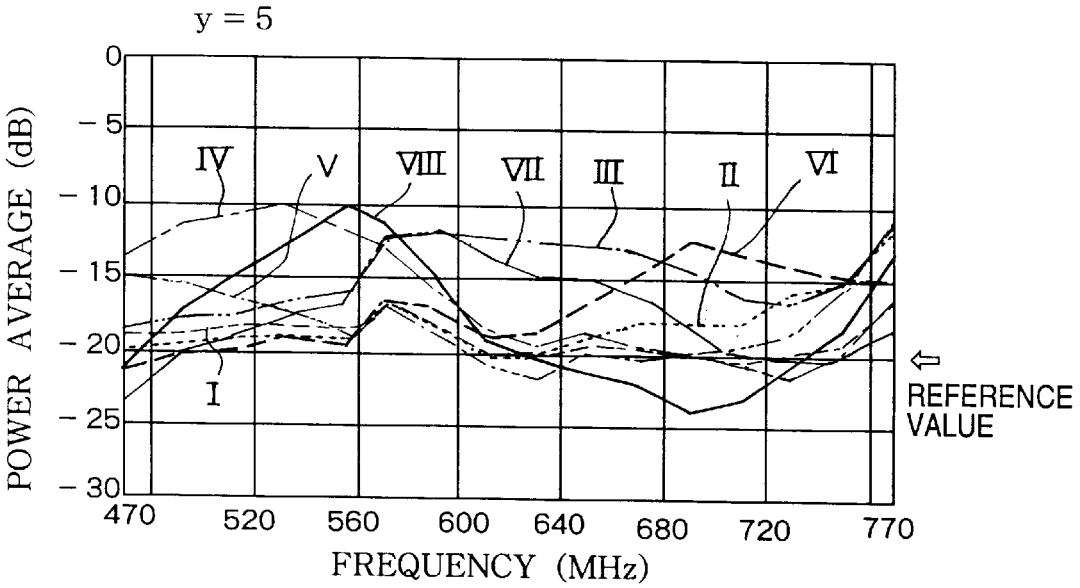
FIG. 44 is a graph showing UHF reception characteristics in the antenna system in FIG. 1 with respect to various x values when y is 3 cm.
Figures 45, 46:
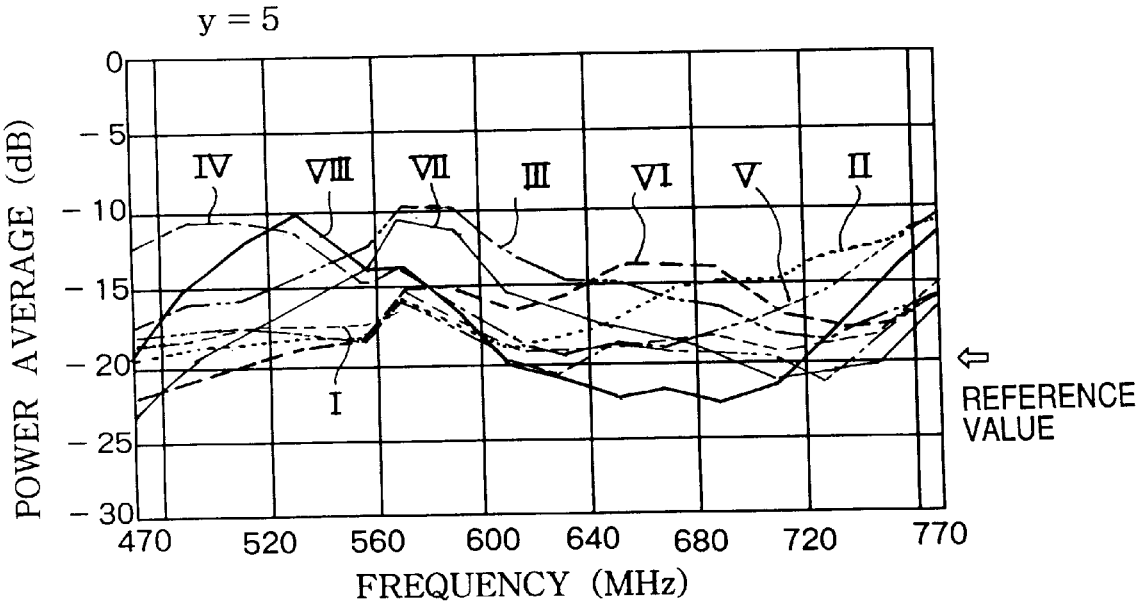
FIG. 45 is a table showing average UHF reception characteristics (average reception sensitivities in an evaluation frequency range) in the antenna system in FIG. 1 when y is 3 cm.
FIG. 46 is a graph showing UHF reception characteristics in the antenna system in FIG. 1 with respect to various x values when y is 5 cm.
Figures 47, 48:
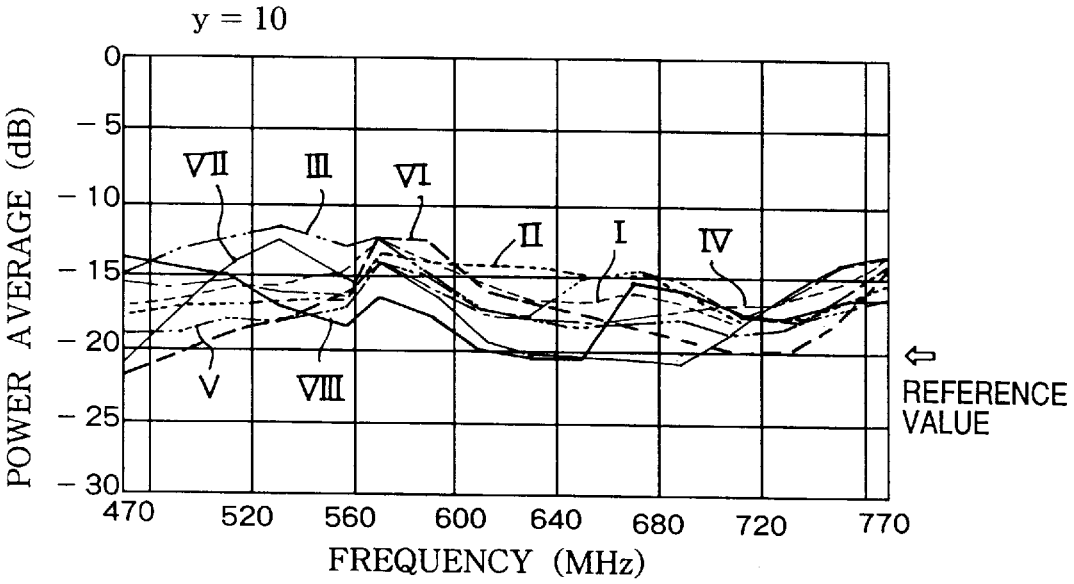
FIG. 47 is a table showing average UHF reception characteristics (average reception sensitivities in an evaluation frequency range) in the antenna system in FIG. 1 when y=5 cm holds.
FIG. 48 is a graph showing UHF reception characteristics in the antenna system in FIG. 1 with respect to various x values when y is 10 cm.

FIGS. 44, 46 and 48 are graphs showing reception sensitivities with respect to a reception radio wave in the UHF band when the height y is set to a fixed value while the width x is changed.

FIGS. 45, 47 and 49 are tables showing average reception sensitivities obtained from the above graphs.

FIGS. 44 to 49 indicate that where the reception radio wave is in the UHF band, if the antenna width is within 40 cm, −20 dB reception can be obtained. FIGS. 44 and 44 show the results of a test where the height y is set to 3 cm while the antenna width x is changed to 5 cm by curve I, to 10 cm by curve II, to 15 cm by curve III, to 20 cm by curve IV, to 25 cm by curve V, to 30 cm by curve VI, to 35 cm by curve VII, and to 40 cm by curve VIII.

FIGS. 46 and 47 show a case where y=5 cm holds, and FIGS. 48 and 49, a case where y=10 cm holds.

In the aforementioned expression (1), if the glass reduction ratio $\alpha$ is 0.6, to receive a UHF band radio wave, the height y is preferably within 10 cm (with respect to a radio wave of 450 MHz or higher). This height is convenient to place the antenna on the front window glass within an area which does not obstruct the driver's sight, i.e., within 10 cm from the end of the front window glass (reference base lines). Accordingly, as an antenna appropriate to the UHF band, the x and y values are preferably set within the following ranges:

$$5\text{ cm} \leqq x \leqq 40\text{ cm}$$

$$y \leqq 10\text{ cm}$$

Further, the lower bound of the y value to ensure a reception sensitivity is:

$$3\text{ cm} \leqq y \leqq 10\text{ cm}$$

Figure 23:
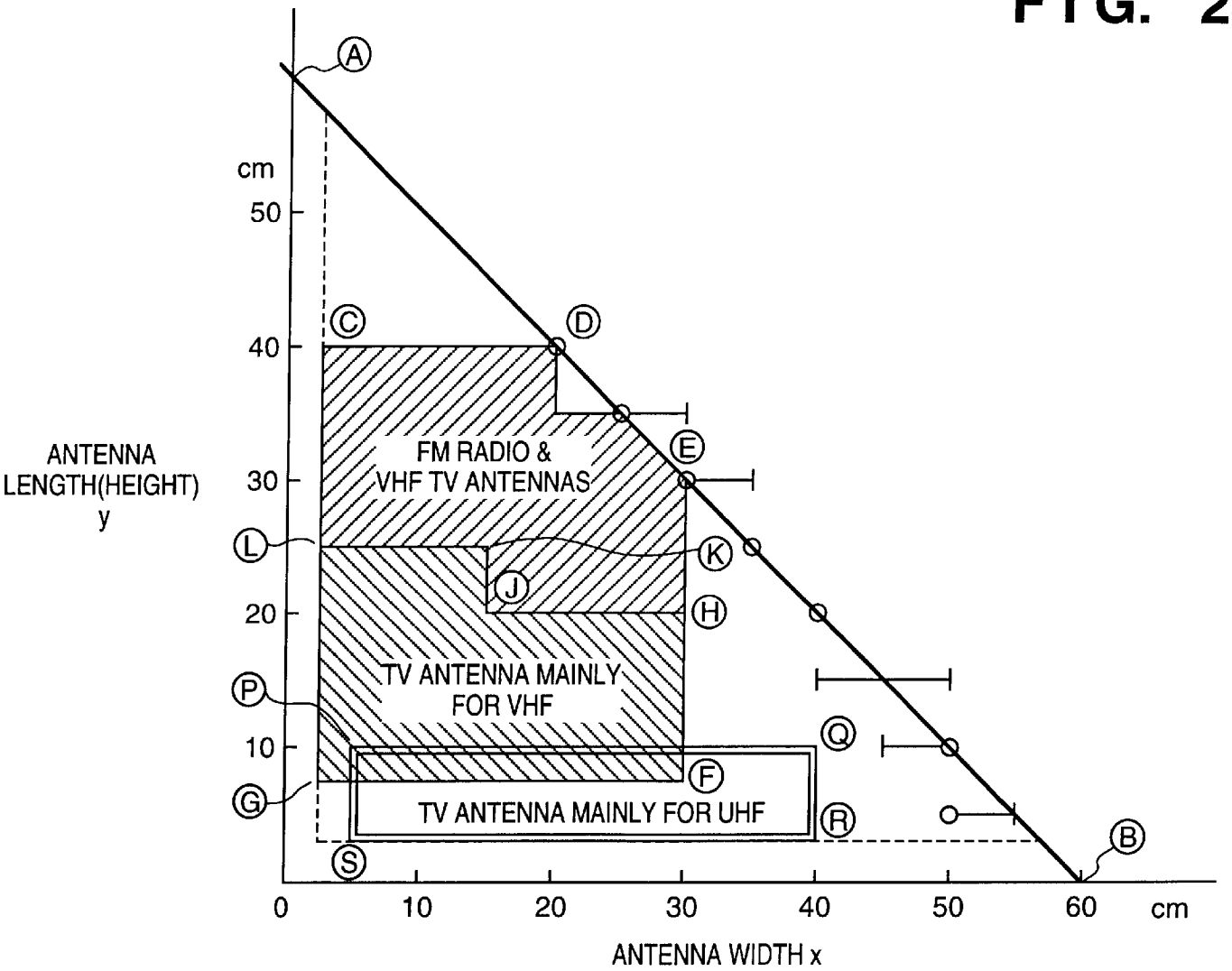
FIG. 23 is a graph showing the relation between the width x and the height y of the antenna system according to the first embodiment.
Figure 24:
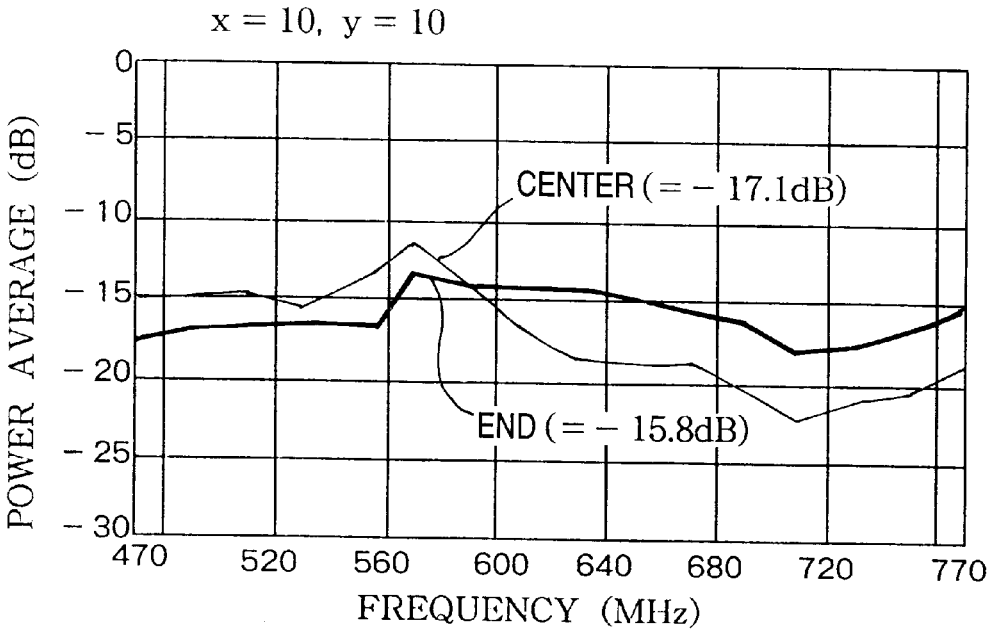
FIG. 24 is a graph showing reception sensitivities with respect to different feeding point positions when x is 10 cm and y is 10 cm.
Figure 25:
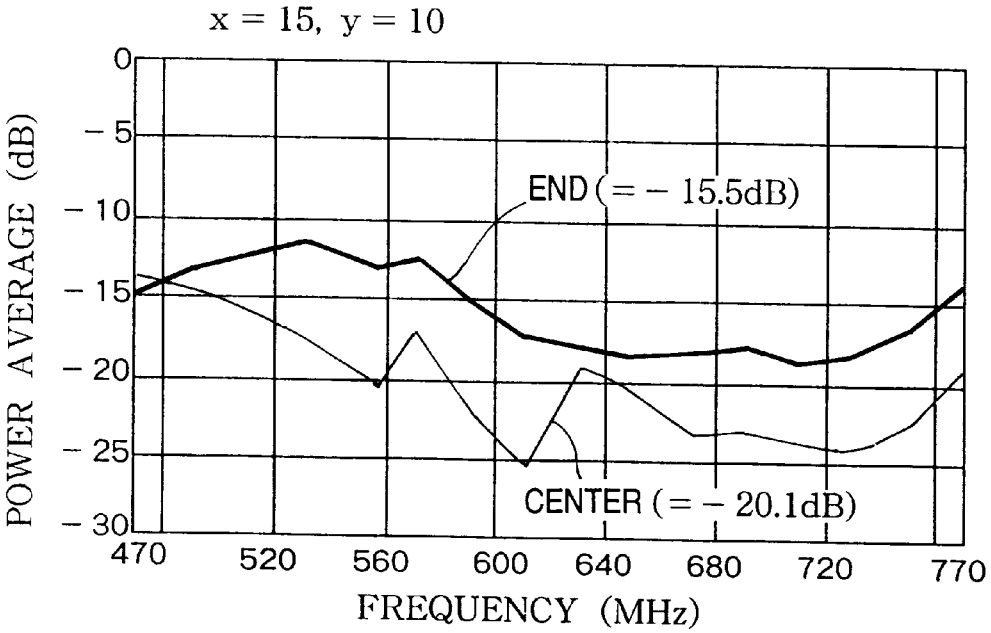
FIG. 25 is a graph showing reception sensitivities with respect to different feeding point positions when x is 15 cm and y is 10 cm.
Figure 26:
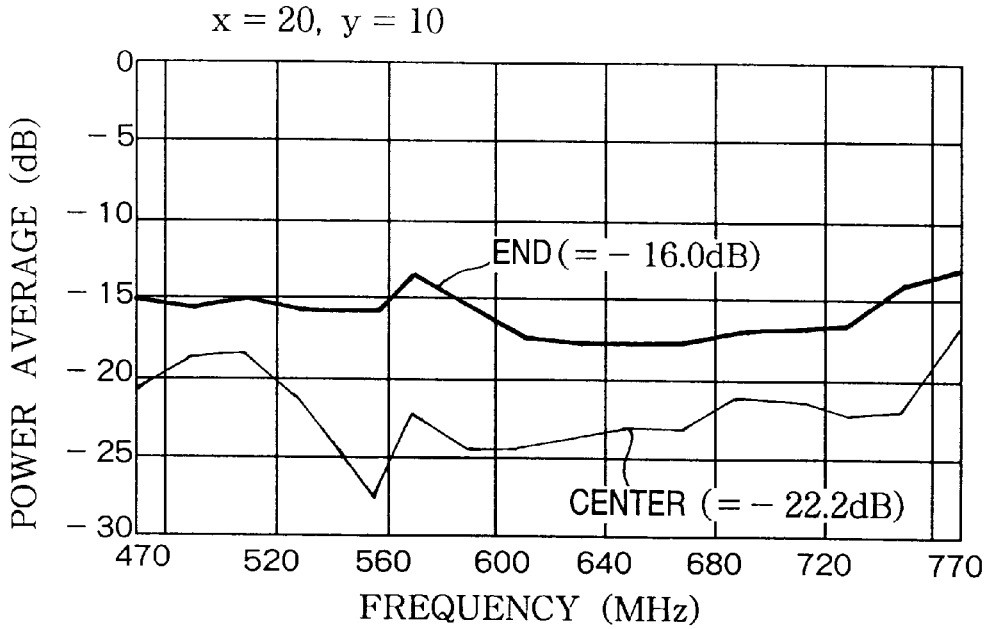
FIG. 26 is a graph showing reception sensitivities with respect to different feeding point positions when x is 20 cm and y is 10 cm.
Figure 27:
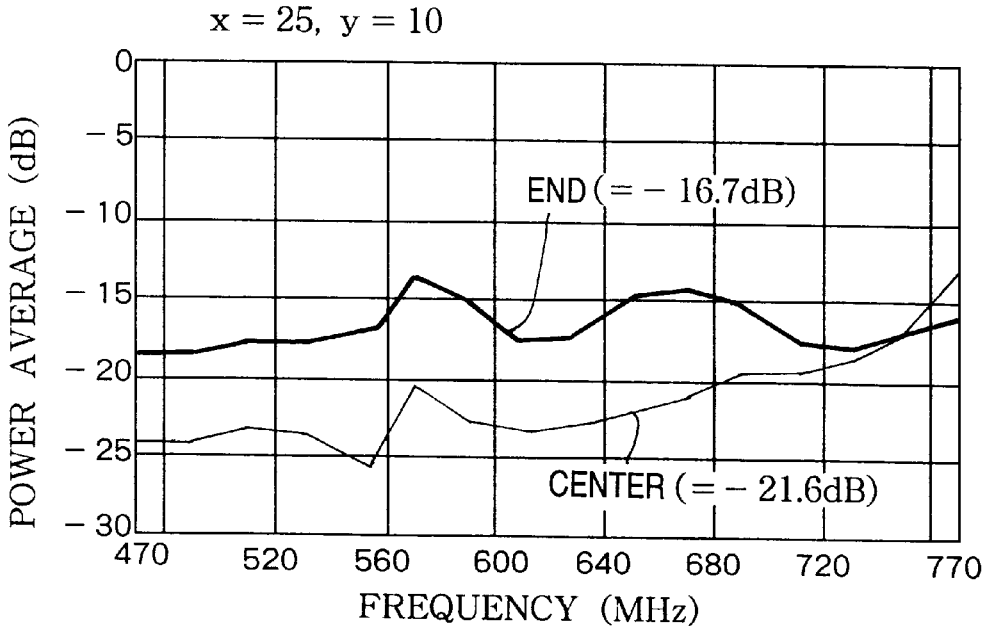
FIG. 27 is a graph showing reception sensitivities with respect to different feeding point positions when x is 25 cm and y is 10 cm.
Figure 28:
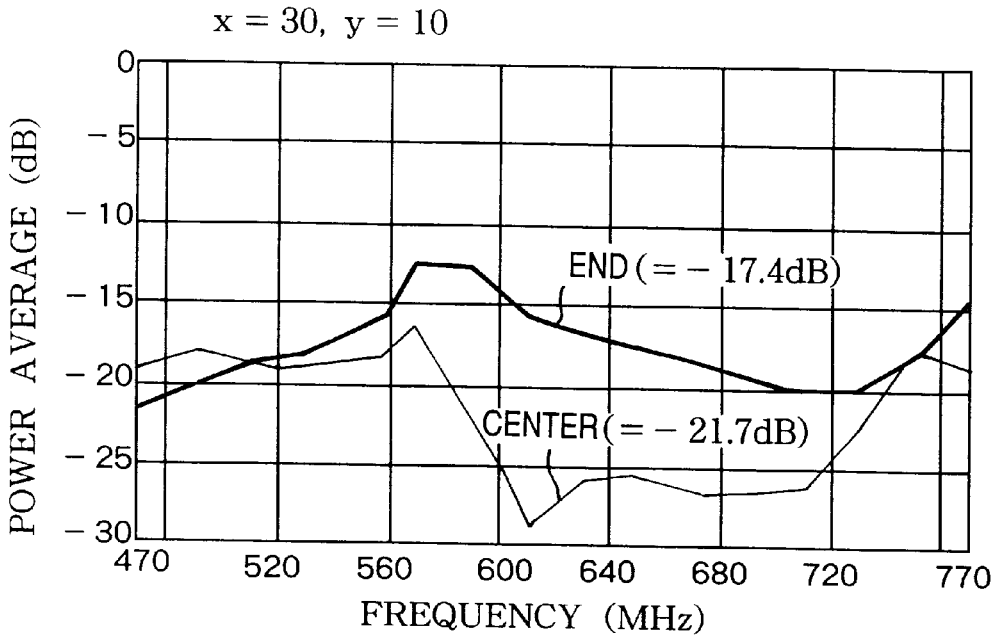
FIG. 28 is a graph showing reception sensitivities with respect to different feeding point positions when x is 30 cm and y is 10 cm.
Figure 29:
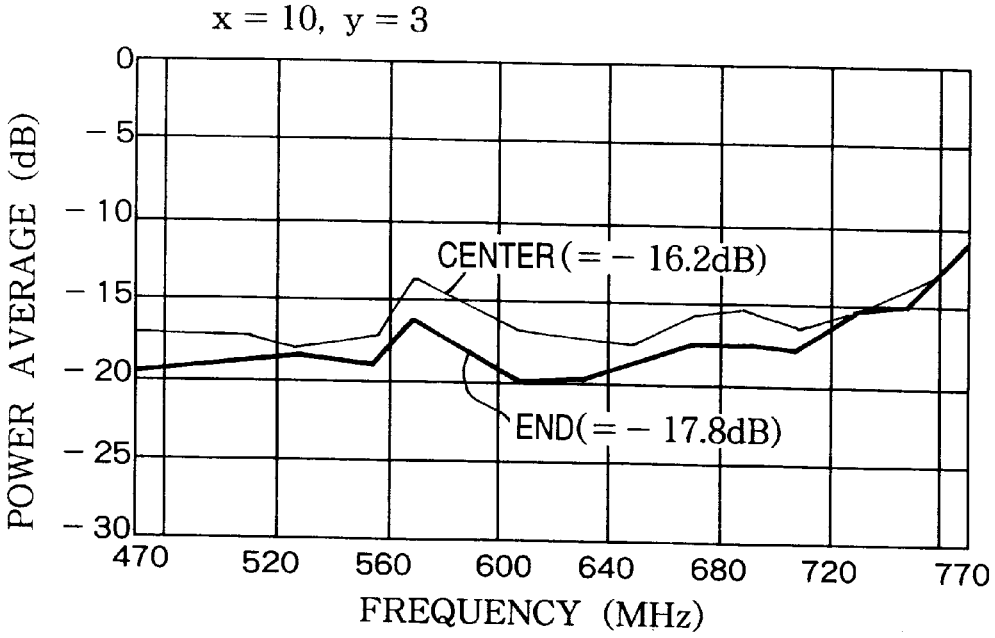
FIG. 29 is a graph showing reception sensitivities with respect to different feeding point positions when x is 10 cm and y is 3 cm.
Figure 30:
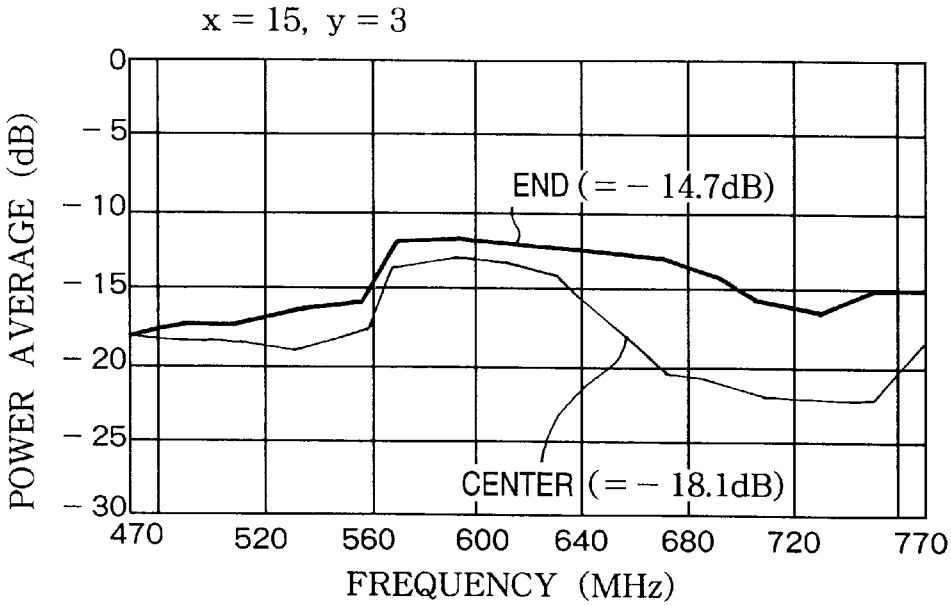
FIG. 30 is a graph showing reception sensitivities with respect to different feeding point positions when x is 15 cm and y is 3 cm.
Figure 31:
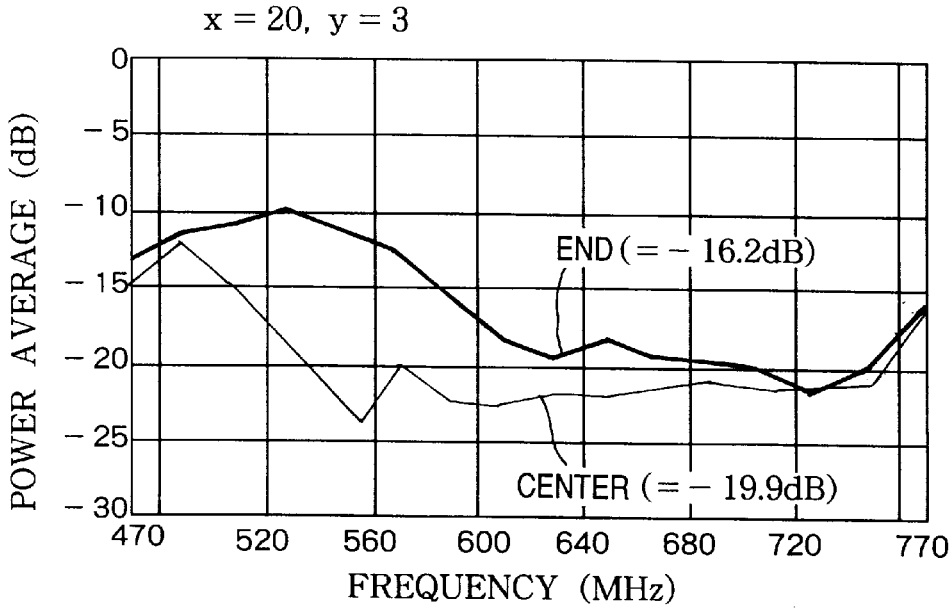
FIG. 31 is a graph showing reception sensitivities with respect to different feeding point positions when x is 20 cm and y is 3 cm.
Figure 32:
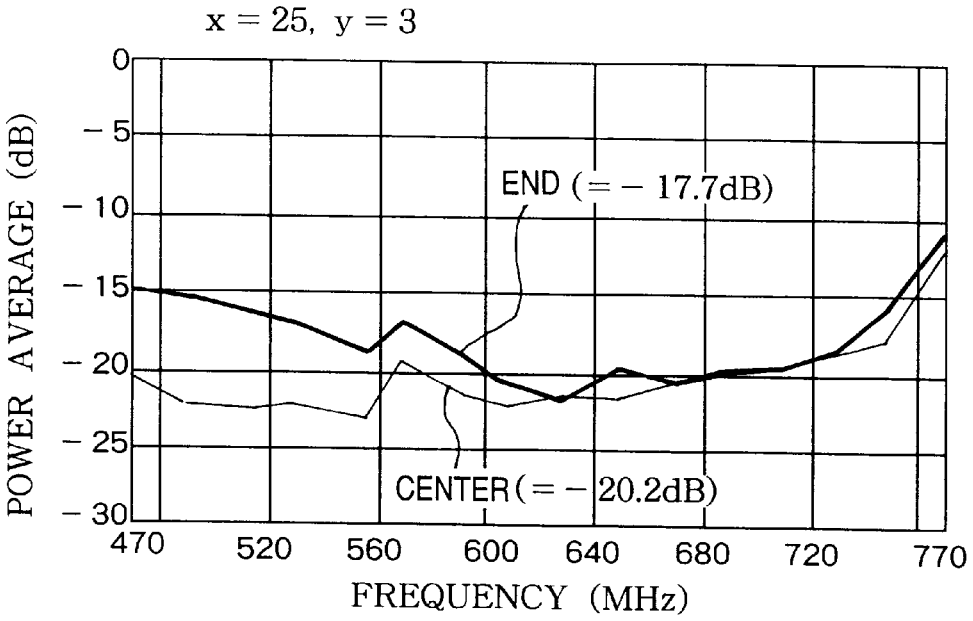
FIG. 32 is a graph showing reception sensitivities with respect to different feeding point positions when x is 25 cm and y is 3 cm.
Figure 33:
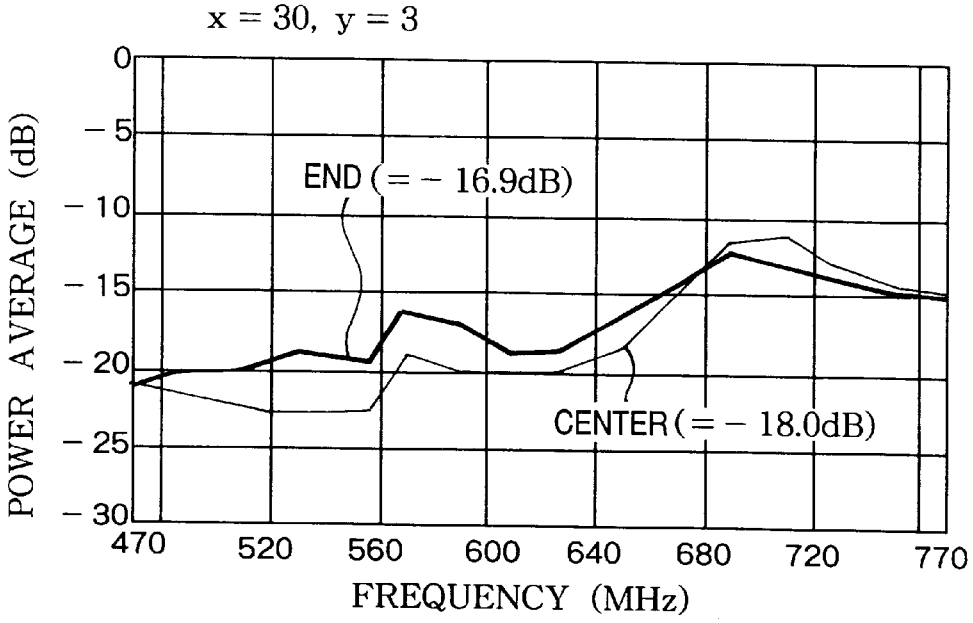
FIG. 33 is a graph showing reception sensitivities with respect to different feeding point positions when x is 30 cm and y is 3 cm.
Figure 34:
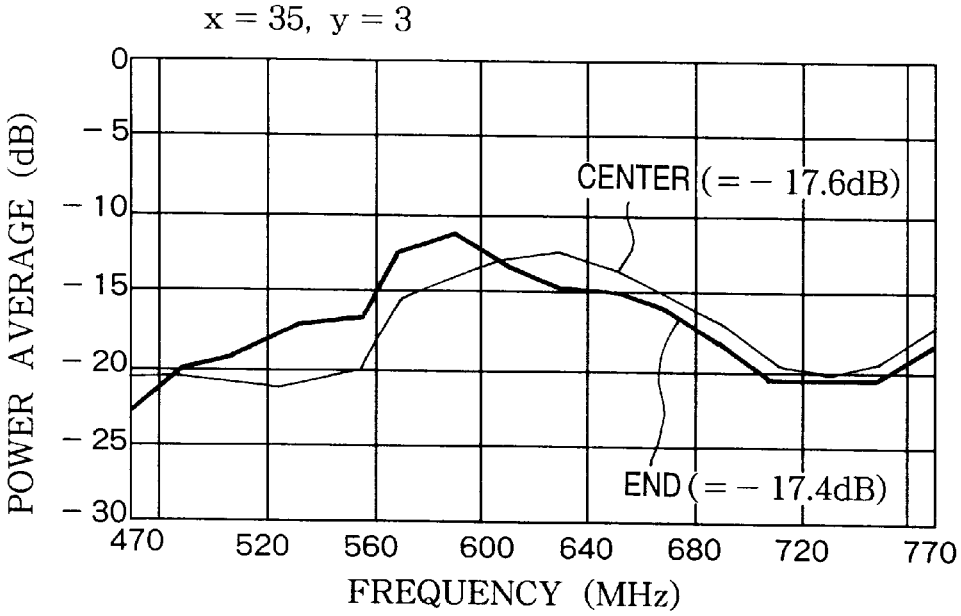
FIG. 34 is a graph showing reception sensitivities with respect to different feeding point positions when x is 35 cm and y is 3 cm.
Figure 35:
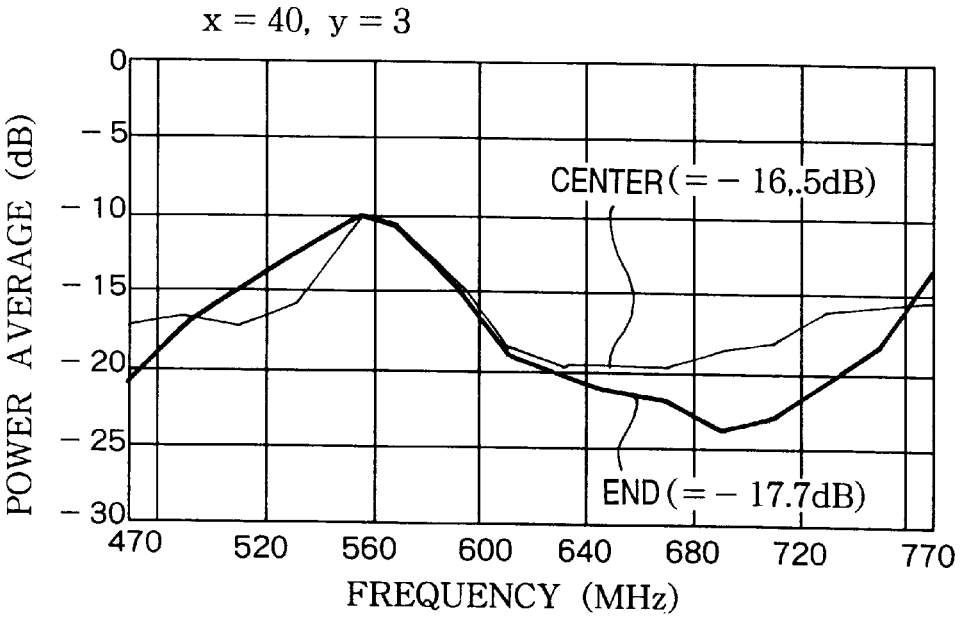
FIG. 35 is a graph showing reception sensitivities with respect to different feeding point positions when x is 40 cm and y is 3 cm.
Figure 36:
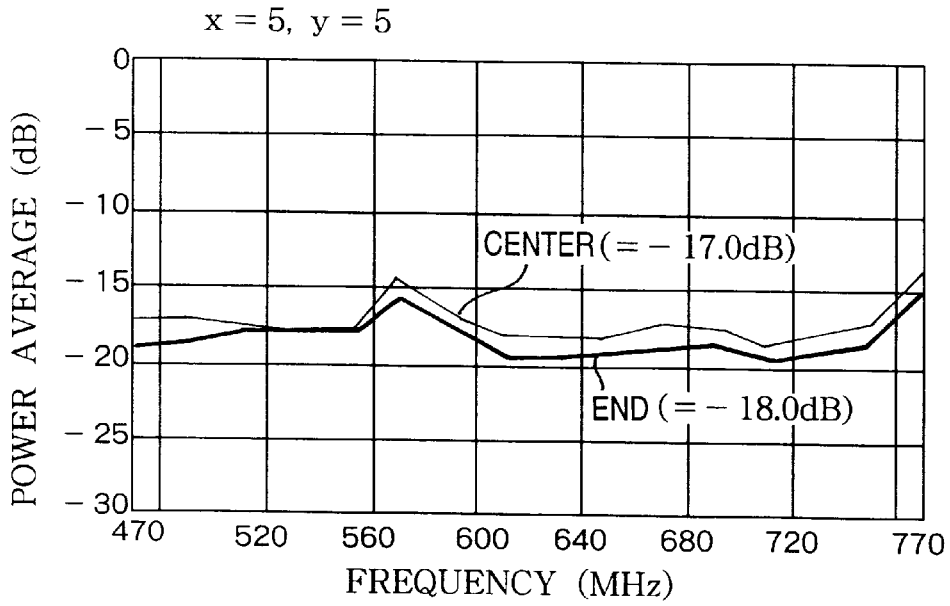
FIG. 36 is a graph showing reception sensitivities with respect to different feeding point positions when x is 5 cm and y is 5 cm.
Figure 37:
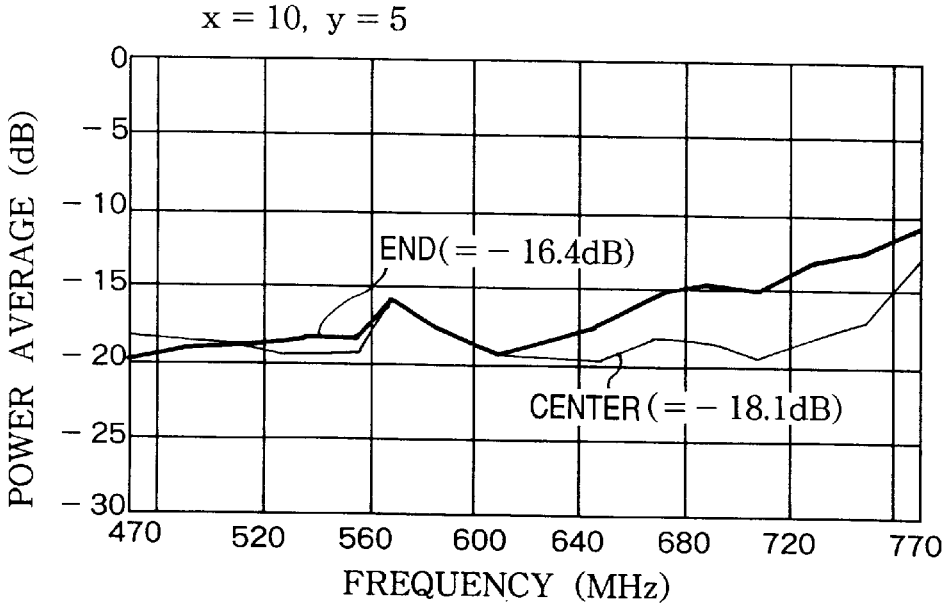
FIG. 37 is a graph showing reception sensitivities with respect to different feeding point positions when x is 10 cm and y is 5 cm.
Figure 38:
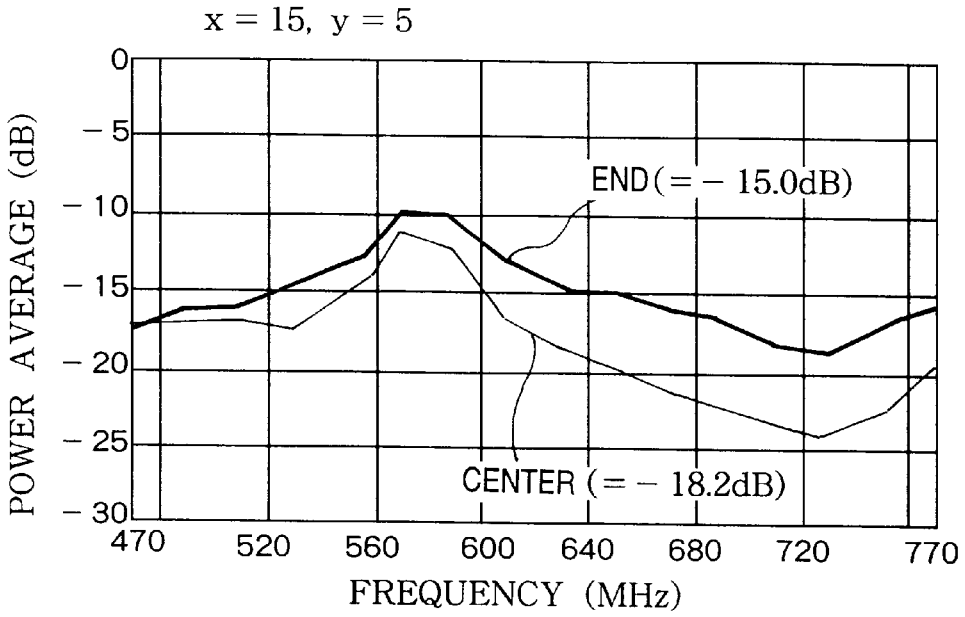
FIG. 38 is a graph showing reception sensitivities with respect to different feeding point positions when x is 15 cm and y is 5 cm.
Figure 39:
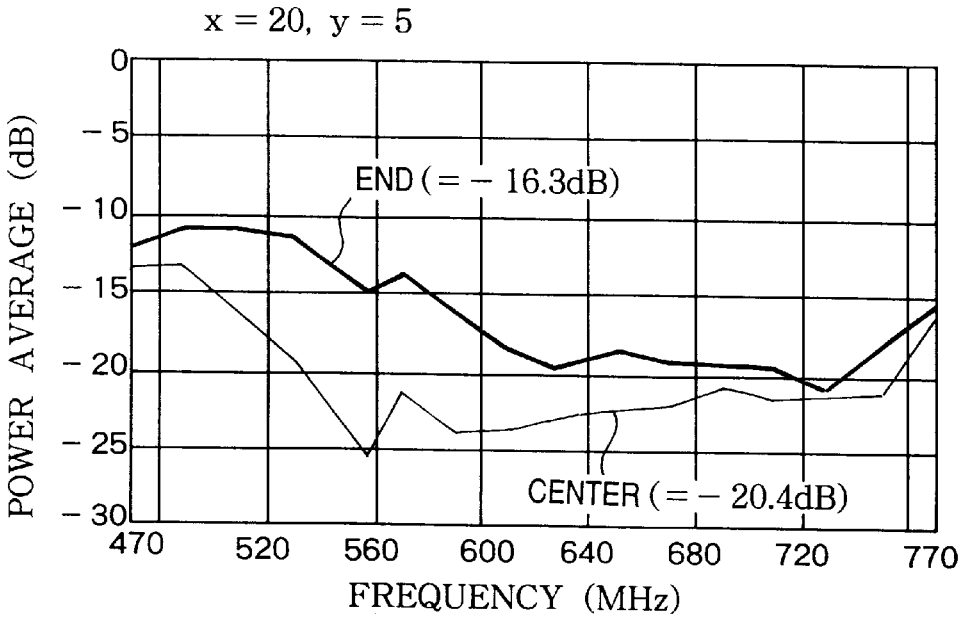
FIG. 39 is a graph showing reception sensitivities with respect to different feeding point positions when x is 20 cm and y is 5 cm.
Figure 40:
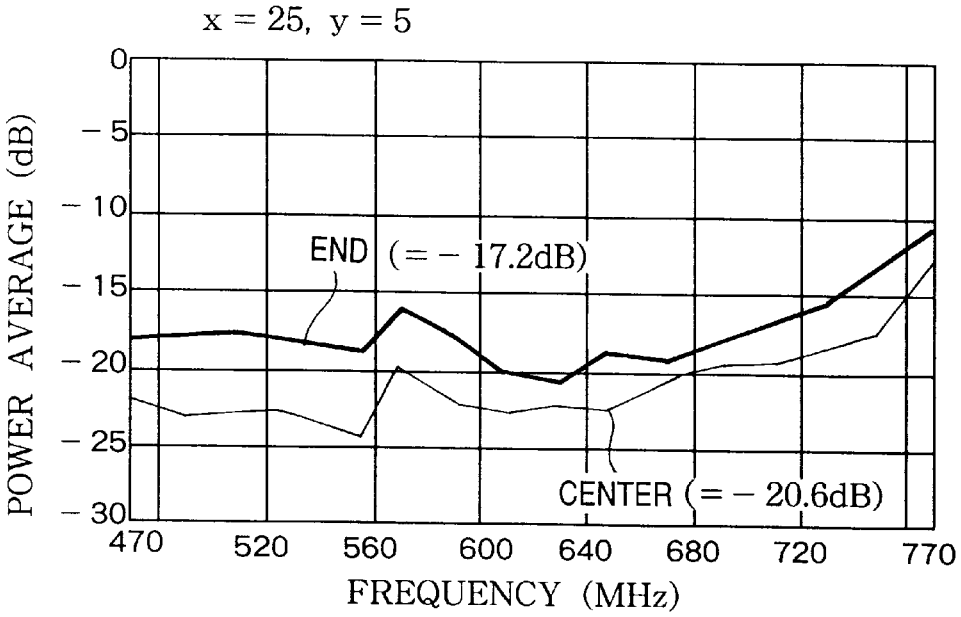
FIG. 40 is a graph showing reception sensitivities with respect to different feeding point positions when x is 25 cm and y is 5 cm.
Figure 41:
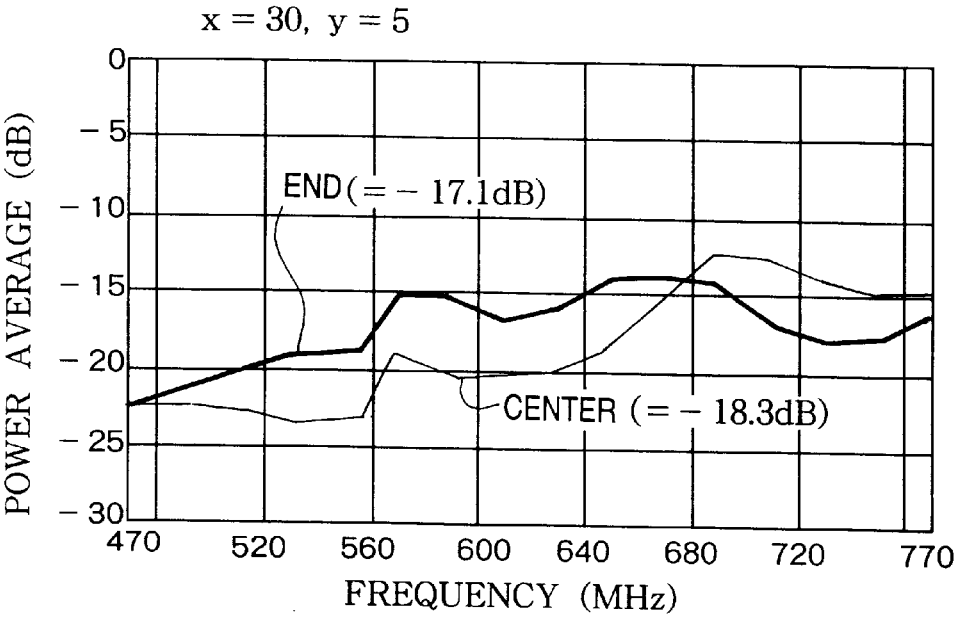
FIG. 41 is a graph showing reception sensitivities with respect to different feeding point positions when x is 30 cm and y is 5 cm.
Figure 42:
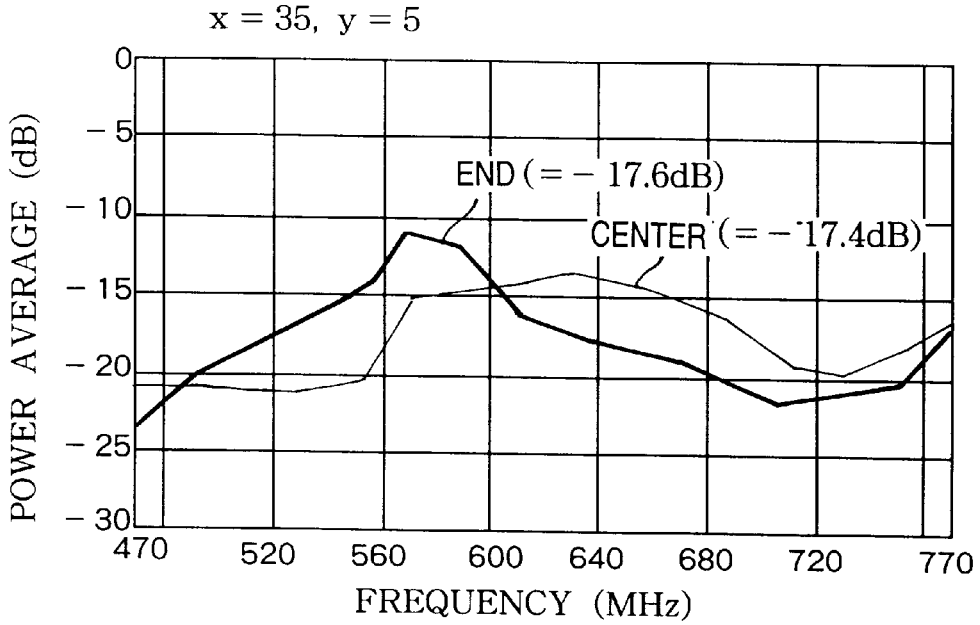
FIG. 42 is a graph showing reception sensitivities with respect to different feeding point positions when x is 35 cm and y is 5 cm.
Figure 43:
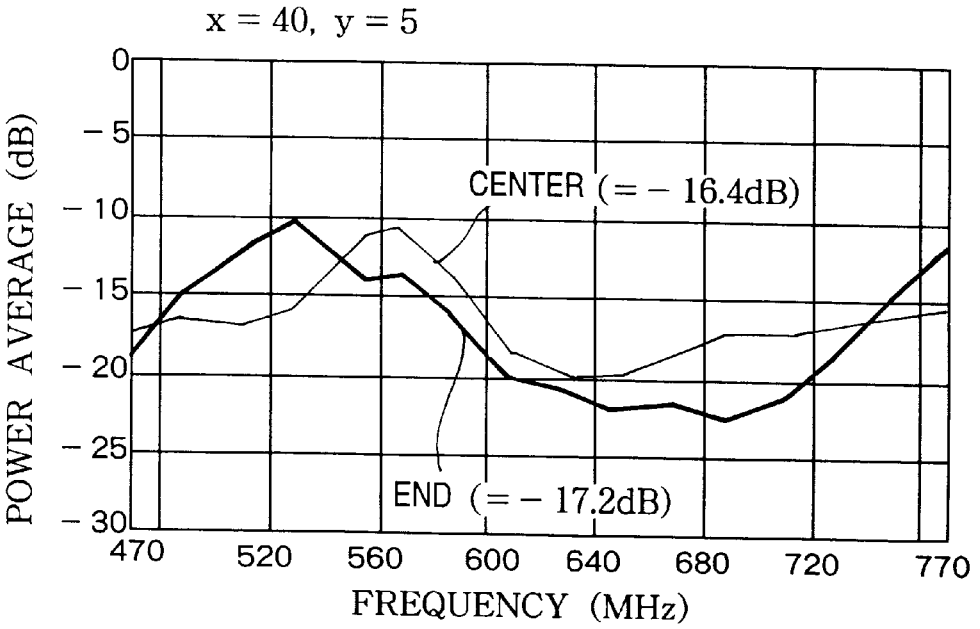
FIG. 43 is a graph showing reception sensitivities with respect to different feeding point positions when x is 40 cm and y is 5 cm.

FIG. 23 is a graph showing the relation between the x and y values, summarized from FIGS. 7 to 22 and FIGS. 44 to 49. In FIG. 23, a line AB denotes a simple equation $$x+y=60\text{ cm}$$

This indicates that the critical value of the sum of the width x and the height y is 60 cm. The area surrounded by line AB, an x axis and a y axis is expressed by:

$$x+y \leqq 60\text{ cm}$$

In a triangular area ABO of FIG. 23, the antenna system comprising of the antennas 10, 20 and 30 shows better performance than that of the conventional mono-pole antenna. In an area CDEHJKL, a practical high reception sensitivity can be obtained in the FM to VHF bands. In an area HFGLKJ, a practical high reception sensitivity can be obtained in the TV VHF band. In an area PQRS, a practical reception sensitivity can be obtained in the TV UHF band. Note that a line CG (x=2 cm) shows the minimum antenna width for obtaining a practical reception sensitivity. A line GF (y=8 cm) shows the minimum antenna height for obtaining a practical reception sensitivity as a TV antenna mainly in a VHF band.

Influence of Feeding Point

FIGS. 24 to 43 are graphs showing reception sensitivities with respect to different feeding point positions, i.e., a central position and an end position. In the graphs of FIGS. 24 to 43, the thick line represents a reception sensitivity when the feeding point is at the end position, and the thin line represents a reception sensitivity when the feeding point is at the central position. Values in the respective graphs indicate average sensitivities within an evaluation frequency range.

Note that feeding point in the present invention means a point of a portion which functions as an antenna that point is the closest to a receiver. In the frame-type antennas according to the first to third embodiments, a joint point connecting the loops and a conductive wire from the loop to a feeder operates as an antenna element, therefore, this joint is defined as feeding point in the embodiments.

The antenna system of the first embodiment attains the target −20 dB. Especially, the antenna where the x, y values are set so as to satisfy x>y, the reception sensitivity in the UHF band is improved.

Setting Measurements of Antenna

Next, a designing method for placing the antenna of the first embodiment on a front window glass of a vehicle will be described. This designing method must satisfy the above-mentioned conditions to ensure the driver's sight and conditions to obtain reception sensitivity and a wide range of reception band.

First, the longitudinal length (height) y is substantially determined from $$\lambda/4\cdot\alpha$$

($\lambda$: reception frequency wavelength, $\alpha$: glass reduction ratio)

In the first embodiment, as the antennas 10, 20 and 30 are respectively set for receiving radio waves in different frequency bands. Assuming the $\alpha$=0.6 holds, the lengths y of the antennas 10, 20 and 30 are set, respectively, to 20 cm for a 225 MHz band; 8 cm for 562.5 MHz band; and 6.5 cm for a 692.3 MHz band (FIGS. 3 to 5).

Next, a transversal length (width) x is determined.

As described above, the width x influences the range of the reception frequency band where a reception sensitivity can be ensured. There is a tendency that as the width increases, the band widens, however, as the band becomes too wide, the reception sensitivity is degraded. The width x must be set within 60 cm as the sum of the height y and the width x (x+y=60 cm).

TV radio waves are in the wide frequency band (VHF 90 MHz to UHF 770 MHz), only one antenna cannot cover the frequency band. For this reason, the widths of the antennas 10, 20 and 30 are respectively set such that the antenna 10 covers mainly the TV VHF band ranging from 90 to 230 MHz; the antenna 20, a band ranging from 500 to 770 MHz; and the antenna 30, mainly the TV UHF band ranging from 470 to 600 MHz. The widths x of the antennas 10, 20 and 30 as shown in FIGS. 3 to 5 are respectively 10 cm, 15 cm and 8 cm. The frequency bands covered by the antennas 20 and 30 overlap with each other. Thus an effective diversity system can be constituted with these antennas.

The antenna 10 placed at the central portion of the front window glass has a T shape as shown in FIG. 3, since the width x in the lower rectangular part must be within 6.6 cm so as to ensure the driver's sight. The antenna 30 has a size to cover a periodic service sticker, i.e., 8 cm×8 cm. The reception band of the antenna 30 is determined by the maximum values of the longitudinal and transversal lengths. As the reception band does not depend on the antenna shape, the antenna 30 has a circular shape. The antenna 30 is placed on a position to cover the periodic service sticker.

The antenna 20 is placed between the antenna 10 and the antenna 30. To ensure the driver's sight, it is desirable to provide the antenna 20 within the peripheral 10 cm band area, avoiding further inside area from the peripheral 10 cm band area. The antenna 10 having a long height y for receiving relatively low frequency (VHF) radio waves is placed at the central portion of the front window glass, and the antennas 20 and 30 having a short heights y for receiving high frequency radio waves are placed except the central portion.

Modification to First Embodiment

Figure 50:
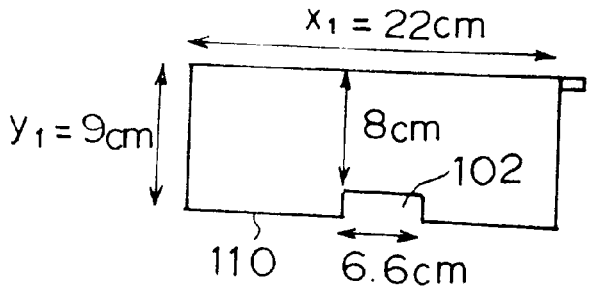
FIG. 50 is a schematic diagram showing the shape of the antenna as a first modification of the first embodiment.

The antenna 10 of the first embodiment, placed on the front window glass, has a T shape as shown in FIG. 3, for the purpose of reception in the VHF band. As a first modification to the first embodiment, an antenna 110 for the purpose of reception in the same frequency band has a U-shape, and is long sideways, as shown in FIG. 50. The measurements of the antenna 110 are as follows:

$x_1$=22 cm $Y_1$=9 cm $L_y$=8 cm

Figure 51:
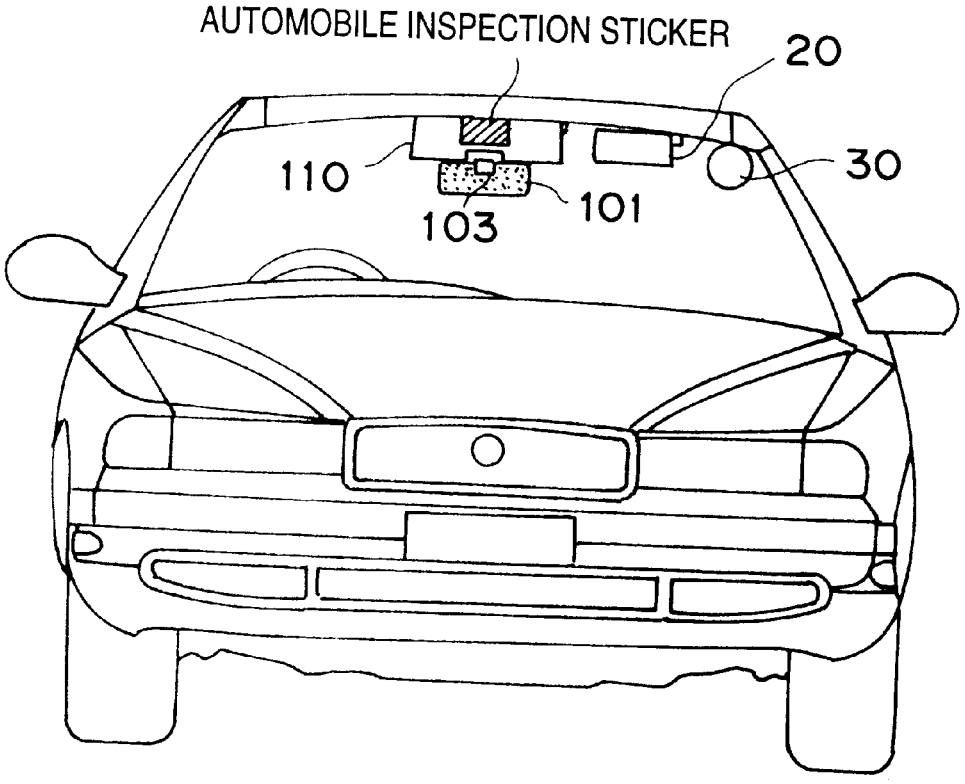
FIG. 51 is a front view of a vehicular front window glass to which the antenna according to the first modification of the first embodiment is applied.

As shown in FIG. 51, the antenna 110 is suitable for vehicles where an internal mirror 101 is attached on a base 103 directly placed on the front window glass. The longitudinal length (height) y, which must be over 7 cm and within 10 cm for the same reason as described in the first embodiment (i.e., to cover an automobile inspection sticker and to ensure visibility), is 9 cm. To prevent interference of an antenna wire with the base 103, a cut-out 102 (FIG. 50) is provided.

The basic designing is made on the requirement to ensure visibility and to cover the automobile inspection sticker. The height y is set within a range from 7 to 10 cm. When the height y is within this range, the frequency band λ corresponding to the height y is expressed as follows;

$$\lambda = \frac{4y}{\alpha} \quad (\alpha\text{: glass reduction ratio})$$

The wavelengths to be received are TV radio waves in the UHF band. The antenna of the first modification is a type of loop antenna having a characteristic that frequency band can be widened by prolonging the width x. Then the first modification sets the width x to fully long, e.g., 22 cm, so as to extend the reception band to the VHF band.

Figures 52, 53:
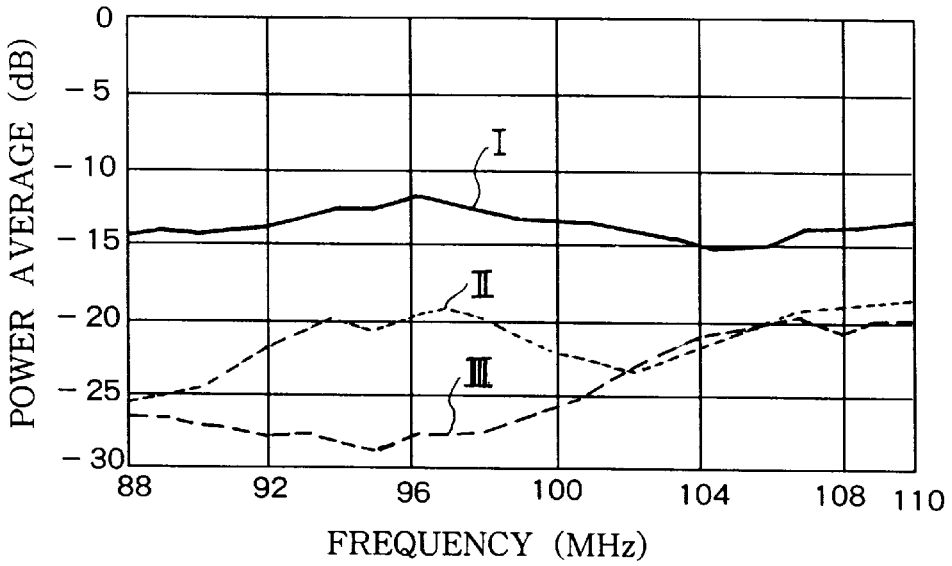
FIG. 52 is a graph showing reception characteristics of the antenna according to the first modification with respect to radio waves in a 88–110 MHz band.
FIG. 53 is a table showing averaged reception characteristics of the antenna according to the first modification with respect to radio waves in the 88–110 MHz band.
Figures 54, 55:
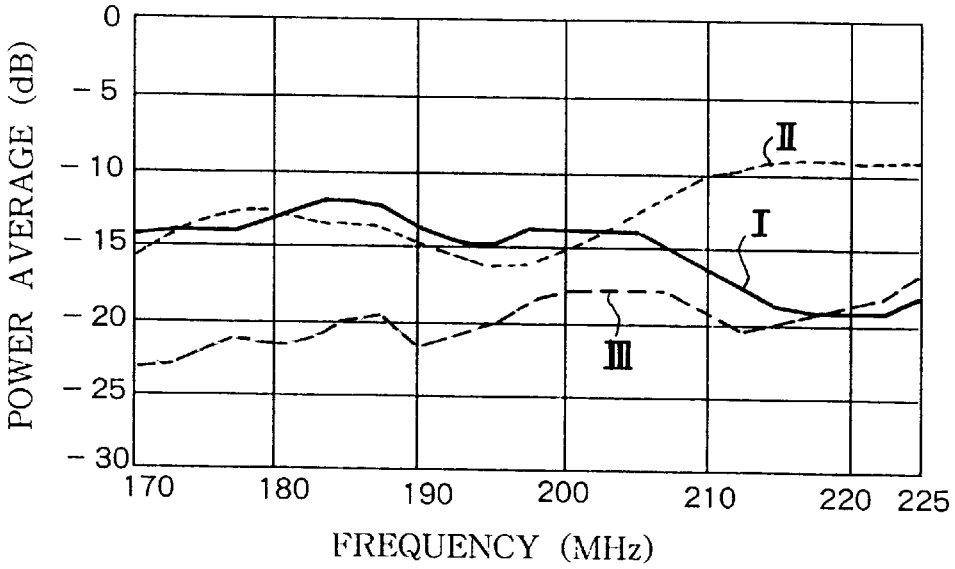
FIG. 54 is a graph showing reception characteristics of the antenna according to the first modification with respect to radio waves in a 170–225 MHz band.
FIG. 55 is a table showing averaged reception characteristics of the antenna according to the first modification with respect to radio waves in the 170–225 MHz frequency band.
Figures 56, 57:
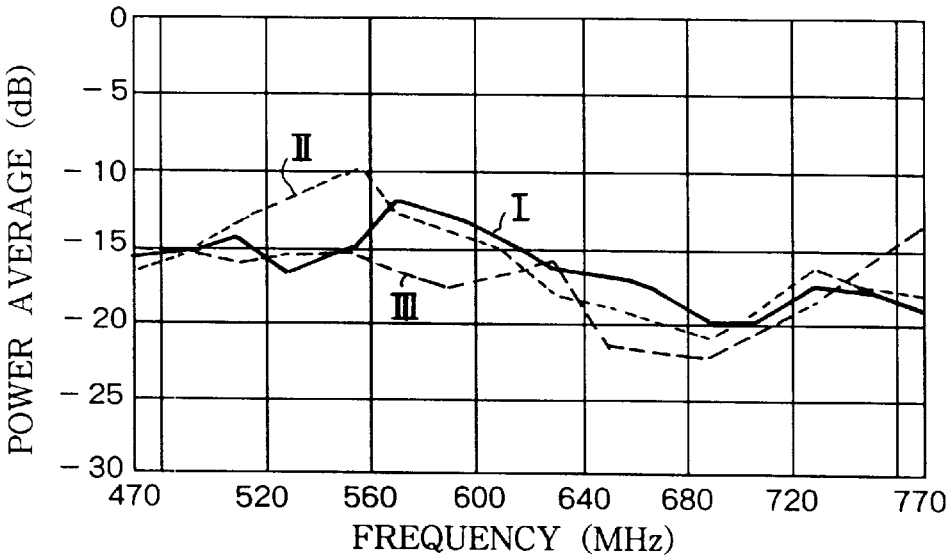
FIG. 56 is a graph showing reception characteristics of the antenna according to the first modification with respect to radio waves in a 470–770 MHz band.
FIG. 57 is a table showing averaged reception characteristics of the antenna according to the first modification with respect to radio waves in the 470–770 MHz band.

FIGS. 52, 54 and 56 are graphs showing reception characteristics (curve I) of the C-shape antenna of the first modification with respect to radio waves (horizontal polarization) respectively in the FM band (88 to 110 MHz), the VHF band (170 to 225 MHz), and the UHF band (470 to 770 MHz). In each graph, for the purpose of comparison with the reception sensitivity (curve I), the characteristics of the antenna 20 (having a rectangular shape which is long sideways) and the antenna 30 (having a circular shape) of the first embodiment are shown as curve II and curve III.

FIGS. 53, 55 and 57 are tables showing average reception characteristics obtained by averaging the above reception sensitivities (curves I to III) within an evaluation frequency range. It is understood from FIGS. 52 to 57 that the U-shape antenna of the first modification has a reception sensitivity −13.7 to −16.2 dB in the respective frequency bands, which is at a practical level.

Note that the test as shown in FIGS. 52 to 57 employs an "open-end type ground wire" to be described later, as the ground of the antennas. The length of the open-end type ground wire of the antenna 20 is 30 cm; and that of the antenna 30, 15 cm.

Second Modification of First Embodiment

A second modification of the first embodiment is an antenna 120 for the FM band. Different from the first embodiment providing the antenna 10 for both TV and FM bands, this modification has an object to receive FM radio waves and VICS (Vehicle Information and Communication System) radio waves by a diversity system.

Figure 58:
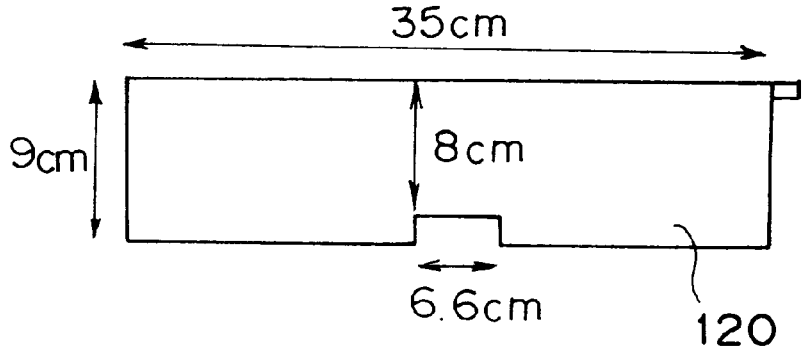
FIG. 58 is a schematic diagram showing the shape of the antenna of a second modification of the first embodiment of the present invention.
Figure 59:
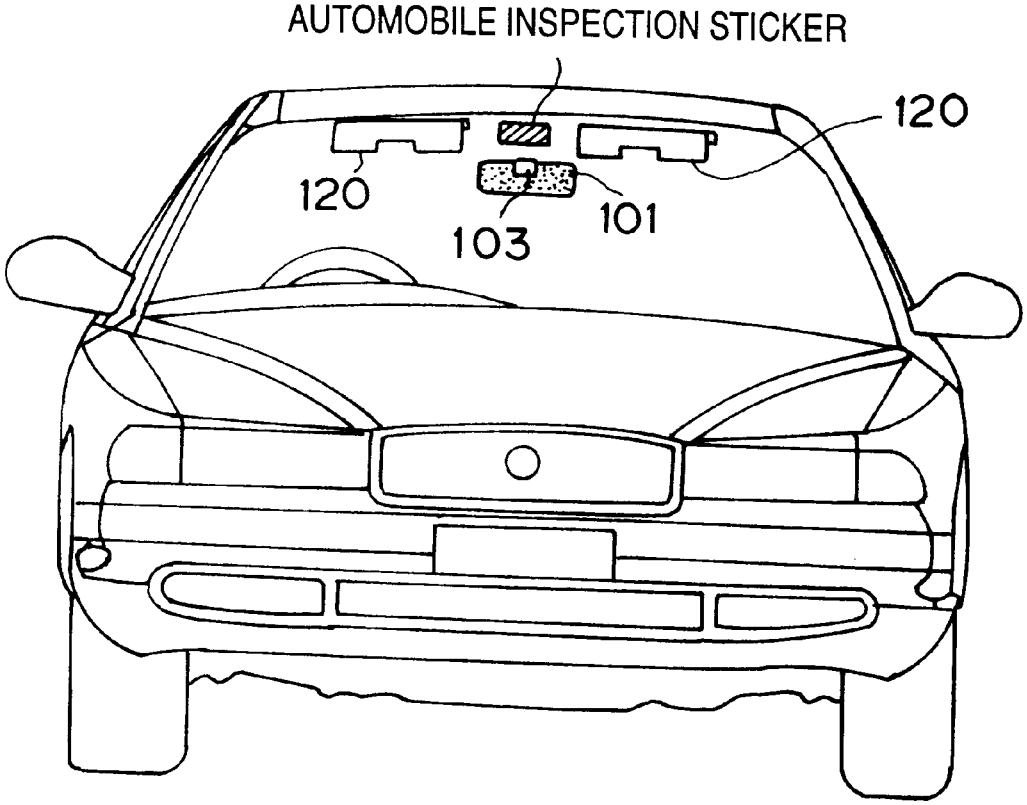
FIG. 59 is a front view of a vehicular front window glass to which the antenna according to the second modification of the first embodiment is applied.

FIG. 58 shows the antenna 120 of the second modification. To improve the reception sensitivity in the FM band, the width x is 35 cm longer than that of the first modification (x=22 cm). As shown in FIG. 59, a diversity system is constituted by providing two antennas 120.

The second modification is made based on a designing concept basically the same as that of the first modification. However, the second modification is mainly intended for FM band reception, the width x is set to the maximum within a range satisfying the above-described expressions (1) and (2) (plus condition x=7 to 10 cm).

As shown in FIG. 59, so far as the antenna 120 does not interfere with the base 103, this modification does not need the cut-out 102.

Figure 60:
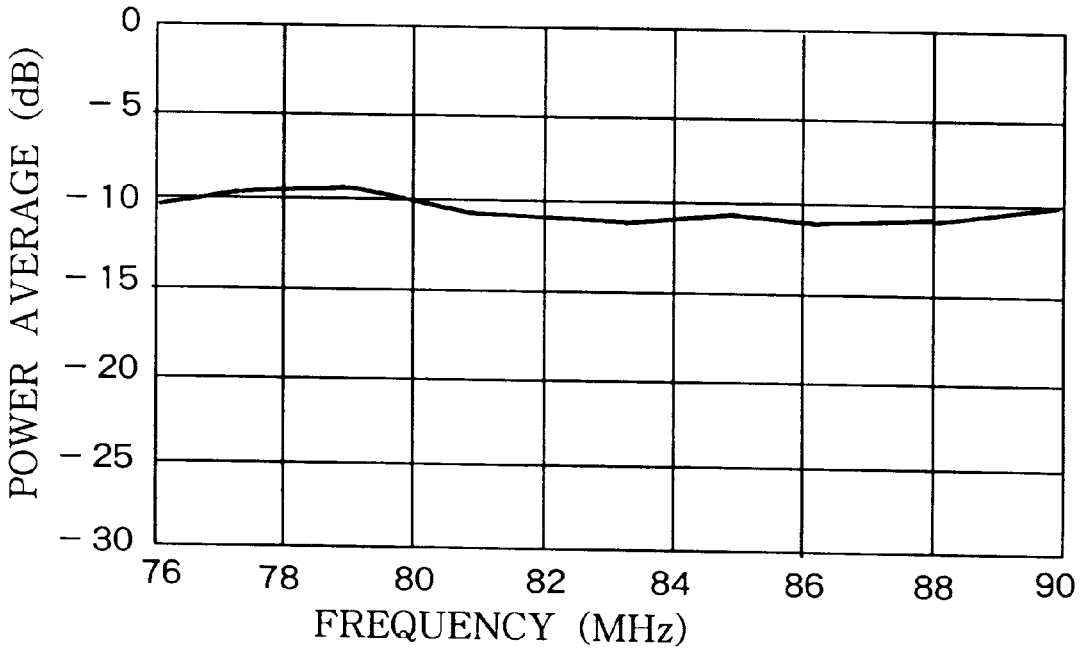
FIG. 60 is a graph showing a reception characteristic of the antenna according to the second modification with respect to an FM radio wave.

FIG. 60 shows a reception sensitivity of the antenna 120 in the FM radio wave band. In this case, the average sensitivity $P_w$-AV is −10.5 dB which indicates that the antenna 120 has a sufficient performance for VICS reception.

Note that preferable ranges of the x and y values are:

$x \geqq 30$ cm $7\text{ cm} \leqq y \leqq 10$ cm.

Open-Ended Type Ground Wire commonly applicable to first to third embodiments

The antennas of the first embodiment employ a ground plate. The ground plate has an advantage that a user can easily attach the antenna onto the front window glass, however, they also have disadvantages that the attachment includes several steps and that they are not always applicable to every type of vehicle.

The open-end type ground wire to be described hereinbelow comprises, not a grounding plate or the like, but only a flexible conductive wire. This ground wire is applicable to every grounded antenna as well as the antenna of the embodiments.

Figure 61:
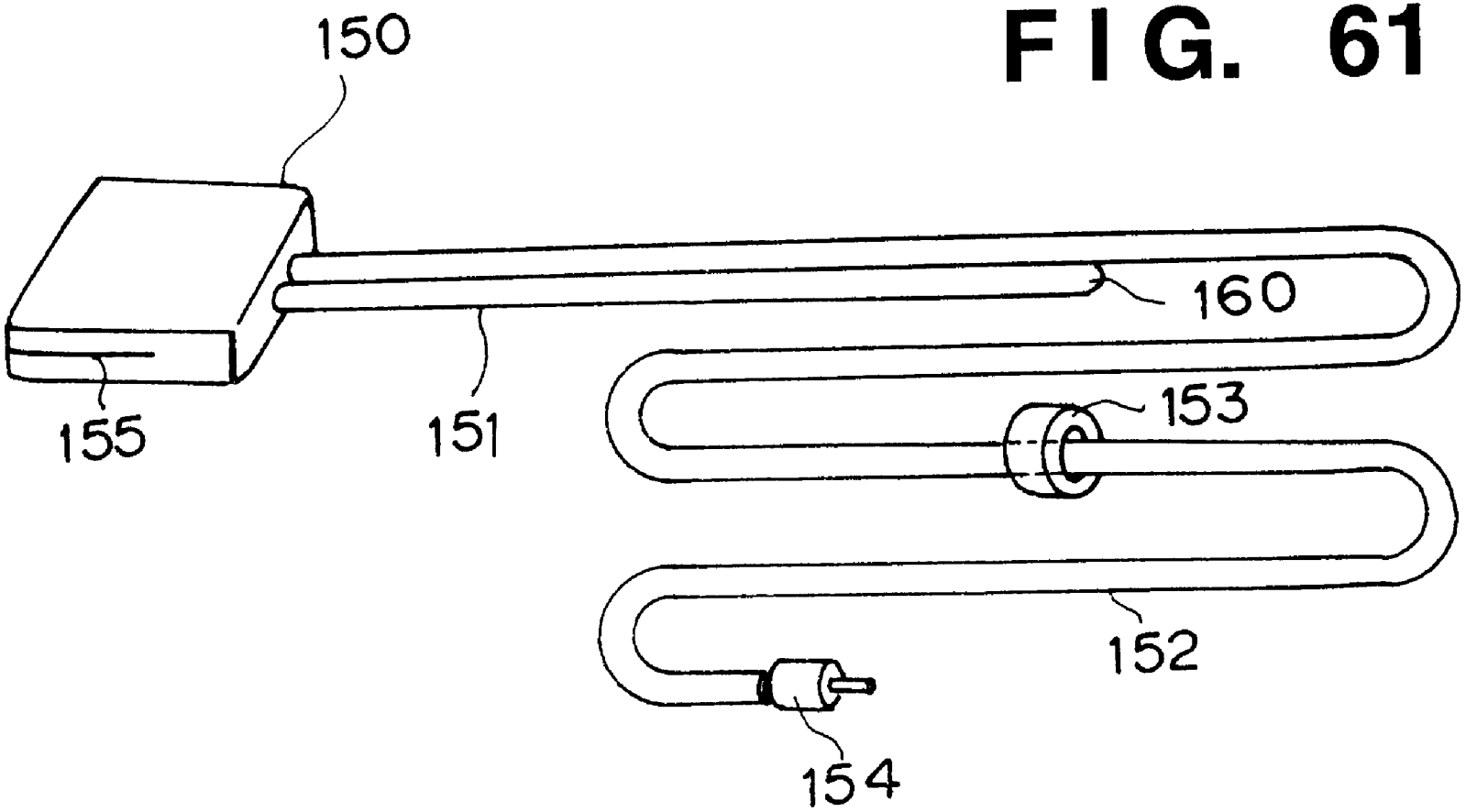
FIG. 61 is a perspective view showing a construction of an open-end type ground wire used for the antennas in the first to third embodiments of the present invention.

FIG. 61 shows the feeder assembly using the open-end type ground wire. In FIG. 61, numeral 150 denotes a joint box having a slit 155 in which the end portions 11, 21 and 31 of the antennas 10, 20 and 30 of the first embodiment are inserted. The joint box 150 is connected with a feeder cable 152 and a ground wire 151. For the purpose of noise elimination or the like, a ferrite core 153 and a connector 154 are attached to the feeder cable 152. The connector 154 is connected to an FM radio, a TV tuner or a VICS terminal (not shown) in accordance with purpose.

Figure 62:
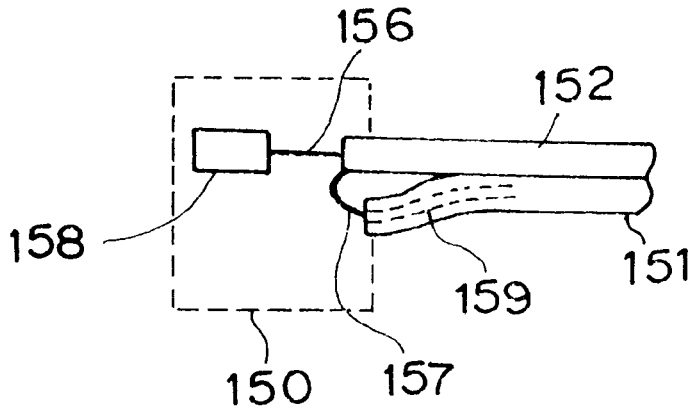
FIG. 62 is a cross-sectional view showing a part of the open-end type ground wire in FIG. 61 in detail.
Figure 63:
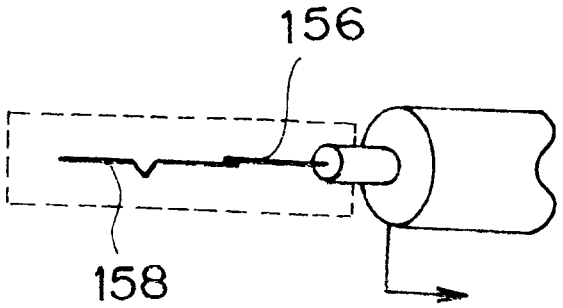
FIG. 63 is a perspective view showing a part of the open-end type ground wire in FIG. 61 in detail.

As shown in FIGS. 62 and 63, the feeder cable 152 comprises a core 156 for signal reception and a net type shield surrounding the core 156. In the joint box 150, a spring 158 having elasticity to hold the antenna end portion is provided, and the core 156 is connected to the spring 158. The net type shield is bundled into a ground lead 157, and the ground lead 157 is connected to a thicker ground core wire 159. The ground core wire 159 is covered with an insulating film, thus constituting the ground cable 151.

Figure 108:
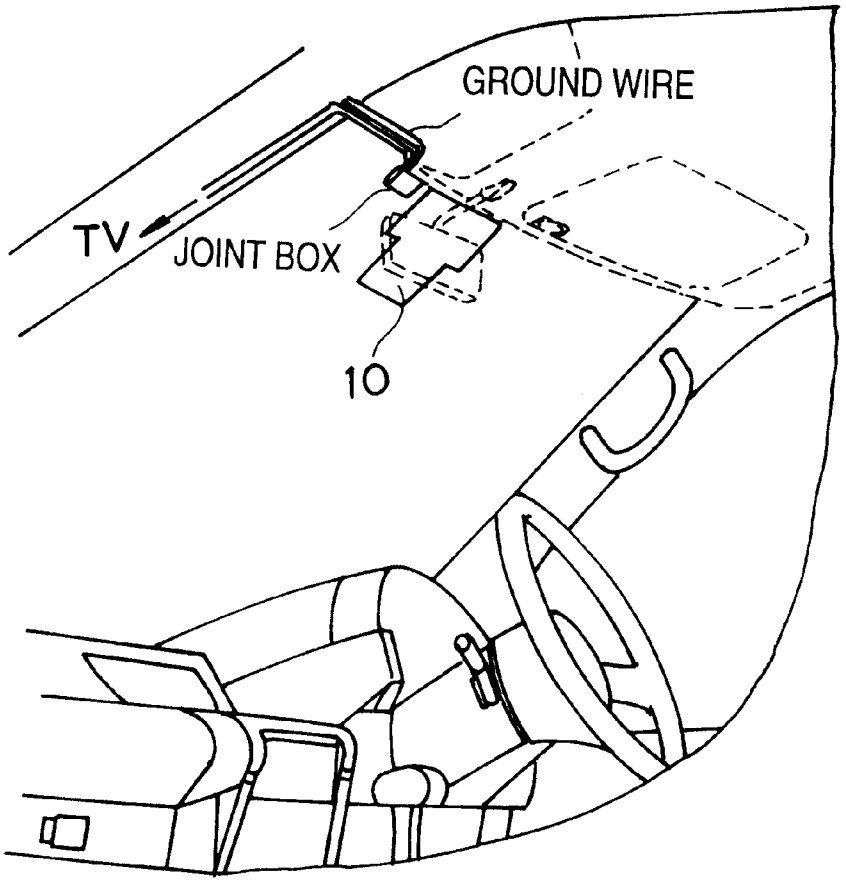
FIG. 108 is a perspective view showing a vehicular front window glass to which the antenna according to the first embodiment is attached with the open-end type ground wire.

FIG. 108 shows thus constructed ground wire assembly to which an antenna 10 is connected is provided on a front glass window pane of vehicle. Referring to FIG. 108, the ground wire assembly (assembly of a ground wire, a feeder cable and a joint box) is pre-assembled in advance. The joint box is arranged on the pane, while the ground wire and the feeder cable are inserted into the inside of a ceiling panel of the vehicle body. When inserting these, the feeder cable is attached to an inner surface of the panel by such any method as adhesion. The arrangement comprising subassembling a ground wire, feeder cable and joint box, and post-attaching the subassembly to the vehicle body can afford to make post-assembling of the subassembly to vehicle body easier. Further, the subassembly will relieve a user who installs the assembly from consideration on an attachment of ground wire, thus improving feasibility of attaching. Further, the ground wire which is shielded as illustrated in FIG. 62, will make the insertion of the ground wire into the panel easier while keeping insulation with the vehicle body.

The assembly of the feeder cable and the ground wire in FIG. 108 is inserted into the ceiling panel. However, in cases where users have a difficulty in insertion of the assembly, the feeder cable and ground wire may be wired or routed along edges of the panel (a body trim member, for example) which are less visible. Such wiring is achieved by the ground wire assembly according to the embodiment which does not necessitate to directly attach a ground wire to a vehicle body.

A ground wire assembly as illustrated in FIG. 108, when installed in a vehicle body, is independent from any other wire harnesses (not shown in FIGS. 61 and 108). Such other wire harnesses may be ones other than a harness of the antenna assembly according to the embodiments.

It is a feature of the open-end type ground wire that its end portion 160 (FIG. 61) is open and is not grounded to the vehicle body, i.e., this ground wire functions as a ground even if the end portion is open. This feature of this ground wire will be described with reference to FIGS. 64 to 67.

Figure 64:
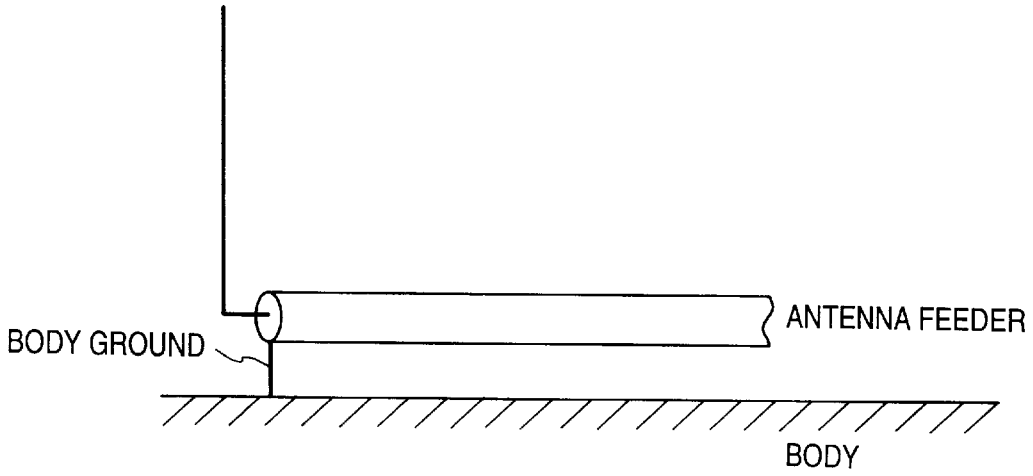
FIG. 64 is an explanatory view showing a body ground of a general grounded antenna.

FIG. 64 shows the structure of a conventional grounded antenna. In FIG. 64, a ground wire of a feeder cable is grounded to the vehicle body.

Figure 65:
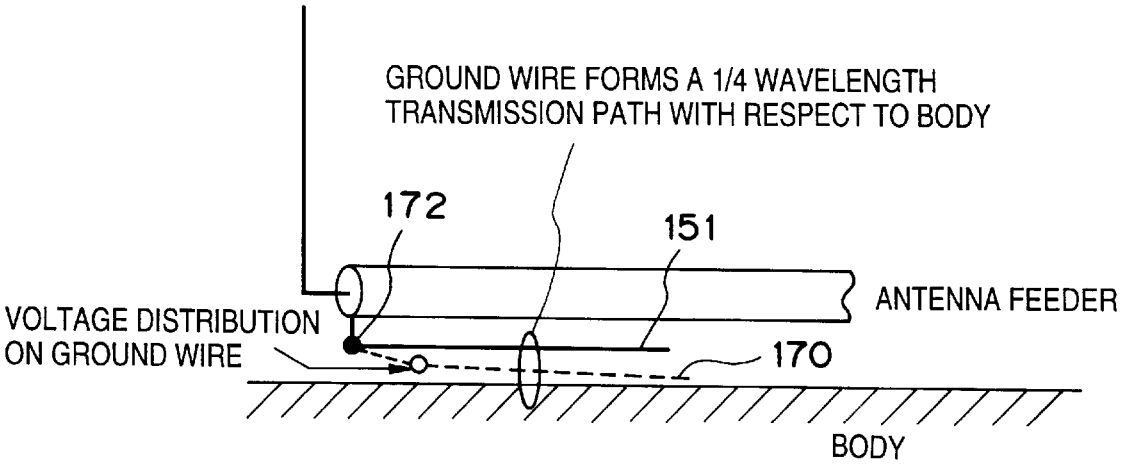
FIGS. 65 to 67 are explanatory views showing a principle of the open-end type ground wire of the embodiments.
Figure 66:
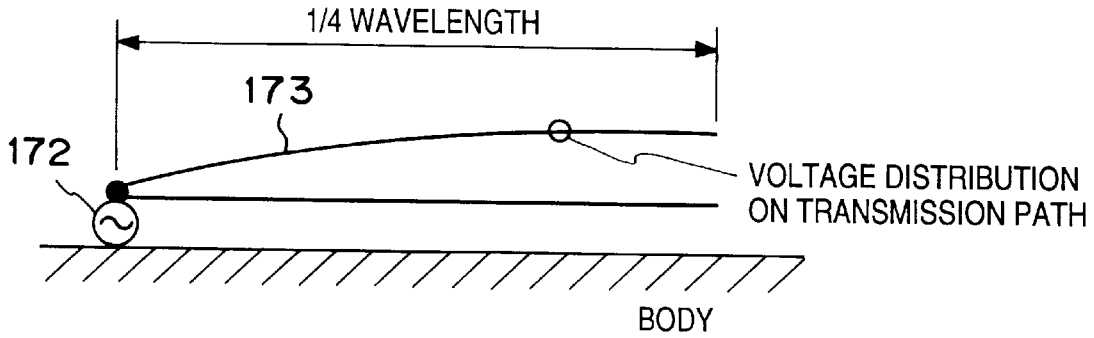
Figure 67:
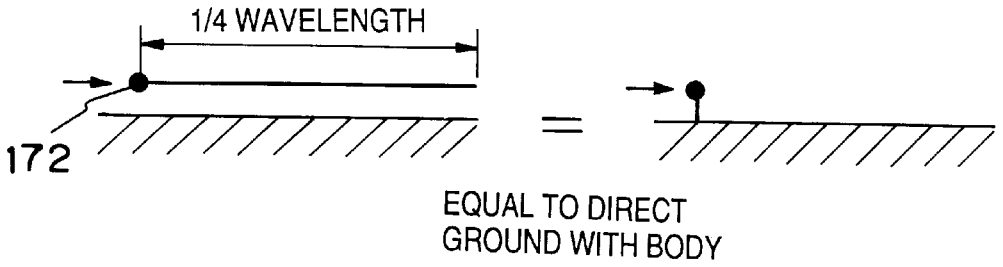
Figure 68:
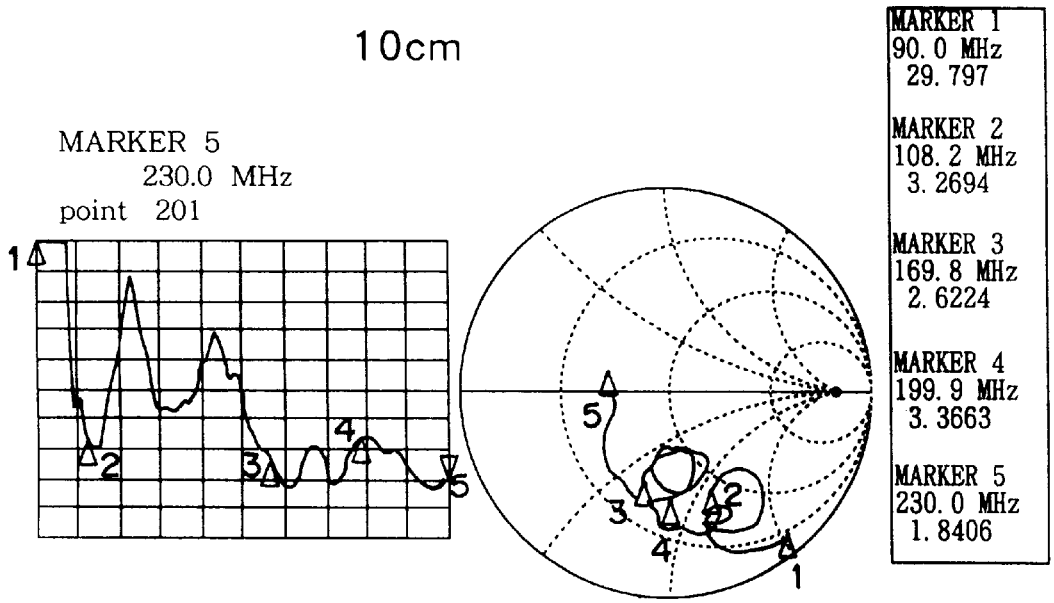
FIG. 68 is a set of graphs showing a VSWR (Voltage Standing Wave Ratio) characteristic of the T-shape framed antenna according to the first embodiment (ground wire length: 10 cm)
Figure 69:
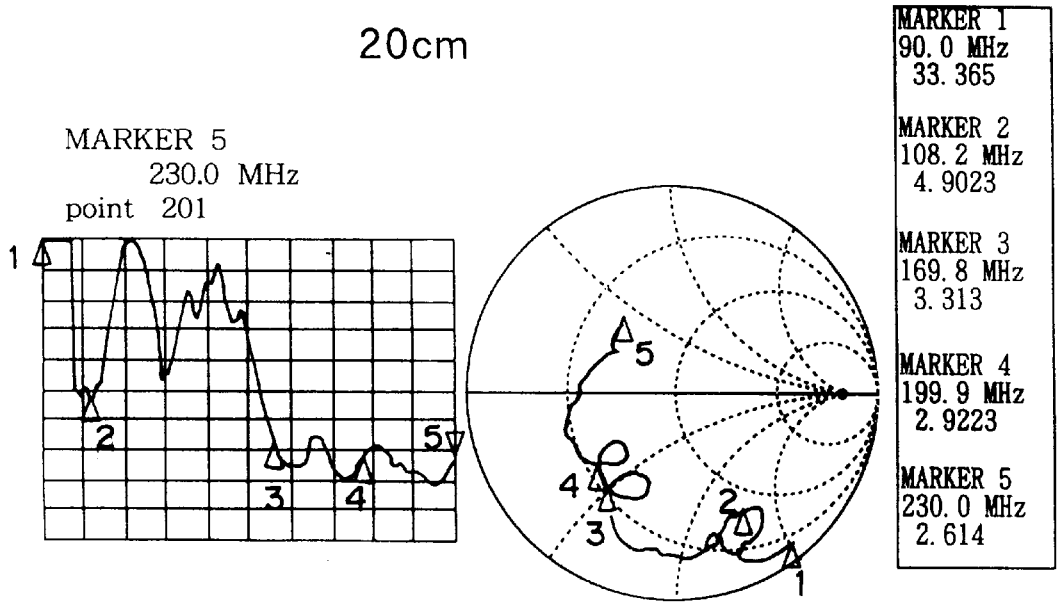
FIG. 69 is a set of graphs showing a VSWR characteristic of the T-shape antenna according to the first embodiment (ground wire length: 20 cm)
Figure 70:
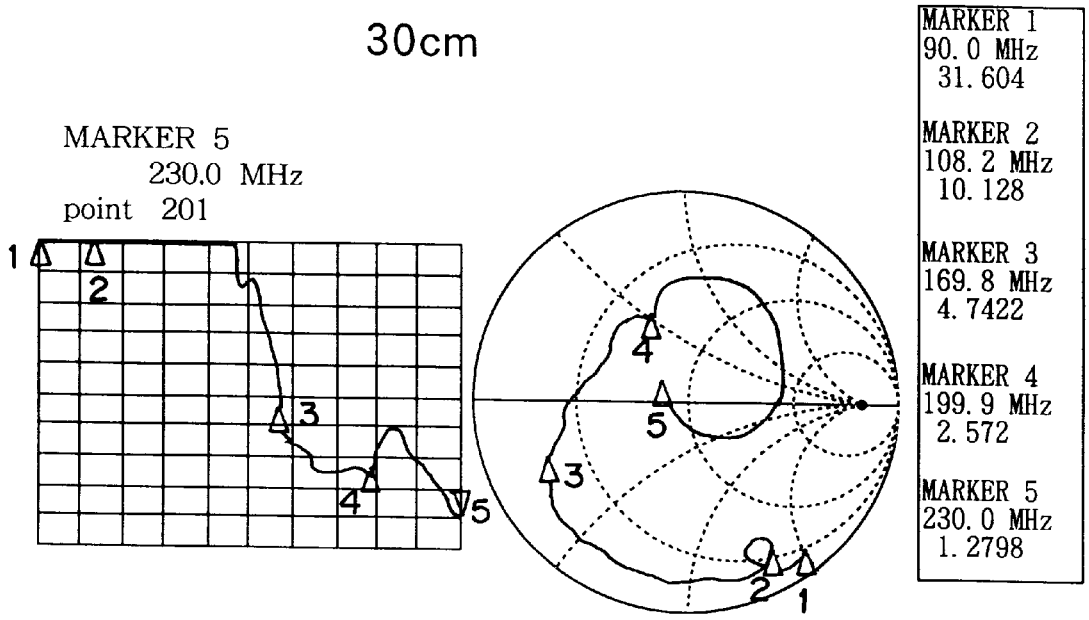
FIG. 70 is a set of graphs showing a VSWR characteristic of the T-shape antenna according to the first embodiment (ground wire length: 30 cm)
Figure 71:
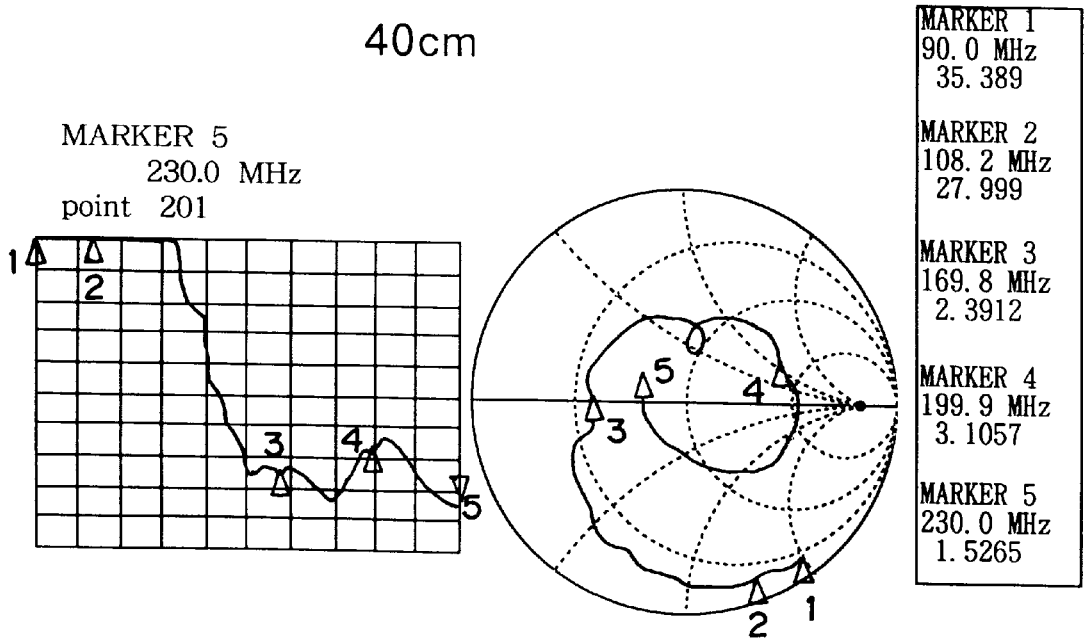
FIG. 71 is a set of graphs showing a VSWR characteristic of the T-shape antenna according to the first embodiment (ground wire length: 40 cm)

On the other hand, FIGS. 65 to 67 show the principle of the open-end type ground wire as the modification of the embodiments. As shown in FIG. 65, if one end of the open-end type ground wire having an arbitrary length is released, the ground wire 151 and the metal of the vehicle body form a transmission path. In this case, the voltage distribution on the ground wire has a curve as a curve 170 in FIG. 65, along the ground wire 151. That is, the potential on the ground wire has a tendency to gradually decrease. As shown in FIG. 66, if the length of the ground wire 151 to ¼ of the reception radio wavelength $\lambda$, the voltage distribution on the transmission path is as a curve 173 in FIG. 66, and an impedance of the transmission path taken from a point 172 in consideration of the characteristic of the transmission path is "0". At this time, the potential at the point 172 is equal to the potential of the vehicle body. That is, as shown in FIG. 67, the open-end type grounding wire 151 having the length $\lambda/4$ of the reception radio wavelength is equivalent to a ground wire directly grounded to the vehicle body at the point 172.

In the example in FIGS. 65 to 67, though there exists an air layer between the ground wire forming the transmission path and the vehicle body, if an insulating member of arbitrary material (path reduction ratio: $\delta$) exists between the ground wire and the vehicle body, a preferable length of the open-end type ground wire is as follows:

$$\frac{\lambda}{4}\cdot\delta \tag{5}$$

Note that it is significant that the open-end type ground wire is not necessarily in parallel with the feeder cable. The purpose of forming a transmission path with the vehicle body may be achieved by simply providing a ground wire along metal parts of the vehicle body, therefor. It is not necessary to make the ground wire contact the metal part. Further, it is preferable that the open-end type ground wire is a flexible conductive member to be curved along the vehicle body in a case where a position for setting the ground wire has a small space.

Further, in consideration of easiness of incorporating the open-end type ground wire into the vehicle body, it is preferable in FIG. 61 that the feeder cable 152 and the ground wire 151 are insulated from each other, and the both wire are covered with an insulating film to be insulated from the vehicle body.

Thus, the open-end type ground wire which is independent from any wire harnesses attains easy grounding in comparison with conventional grounding method or the ground plate (FIG. 11) of the present embodiment which requires any grounding structure such as screw-fixing, bonding and ground pattern. In this regard, the wire harnesses do not include ones relating to the antenna.

Next, the performance of the open-end type ground wire having the above structure very advantageous in assembling will be described below.

Figure 72:
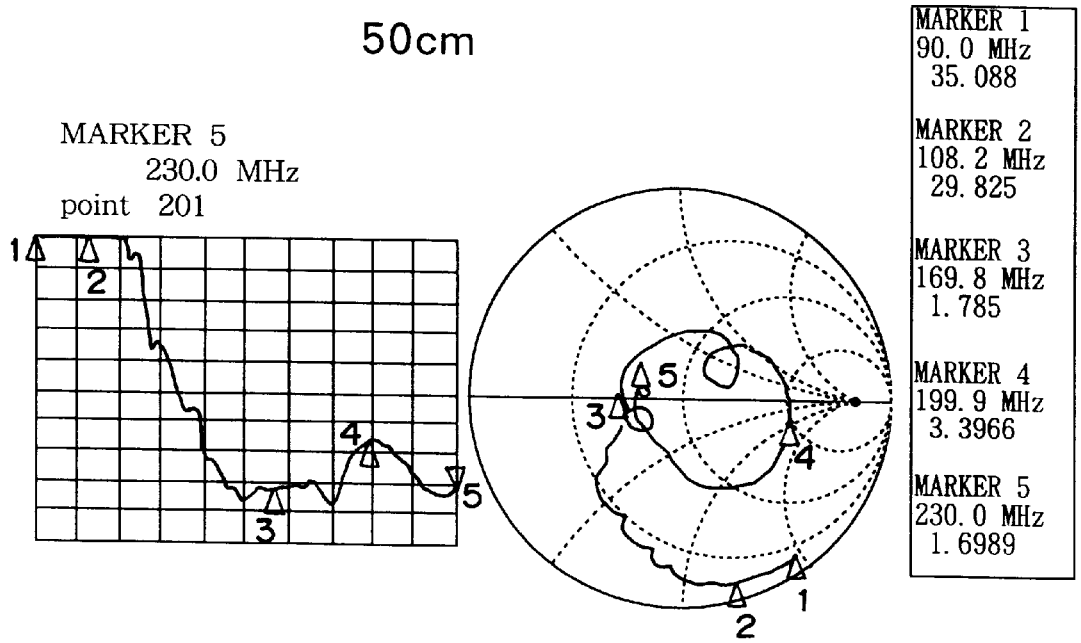
FIG. 72 is a set of graphs showing a VSWR characteristic of the T-shape antenna according to the first embodiment (ground wire length: 50 cm)
Figure 73:
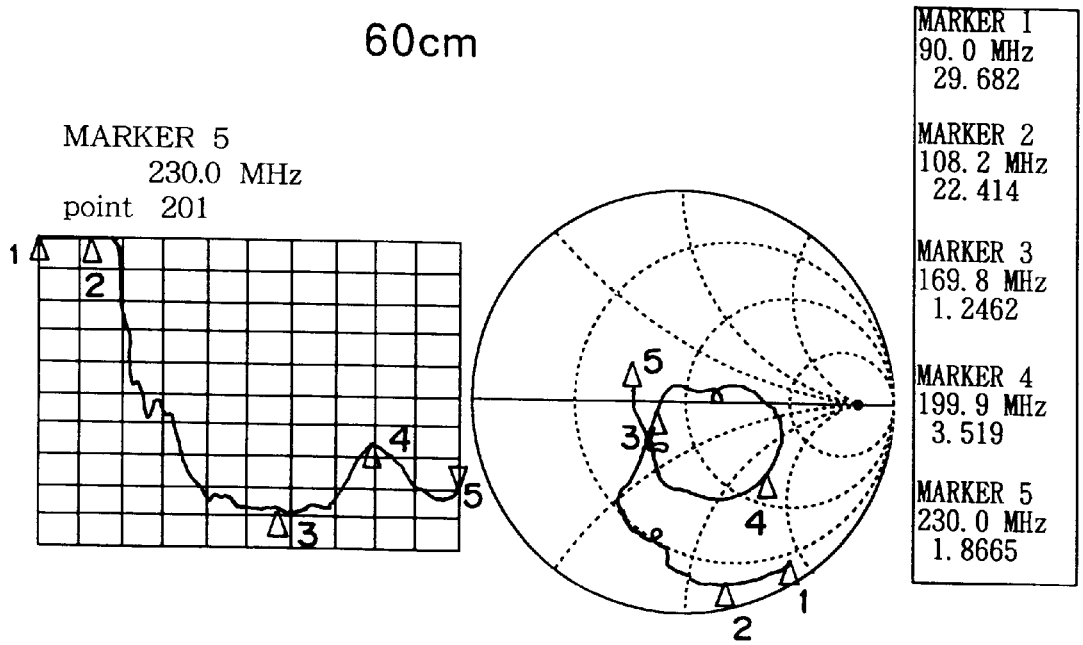
FIG. 73 is a set of graphs showing a VSWR characteristic of the T-shape antenna according to the first embodiment (ground wire length: 60 cm)
Figure 74:
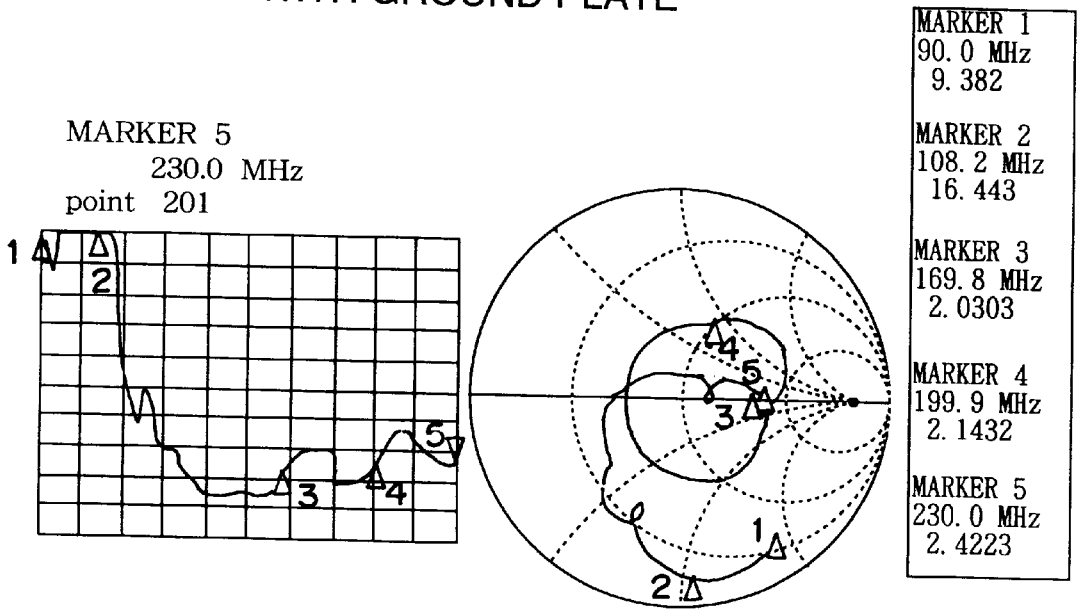
FIG. 74 is a set of graphs showing a VSWR characteristic of the T-shape antenna according to the first embodiment (with the grounding plate)
Figure 75:
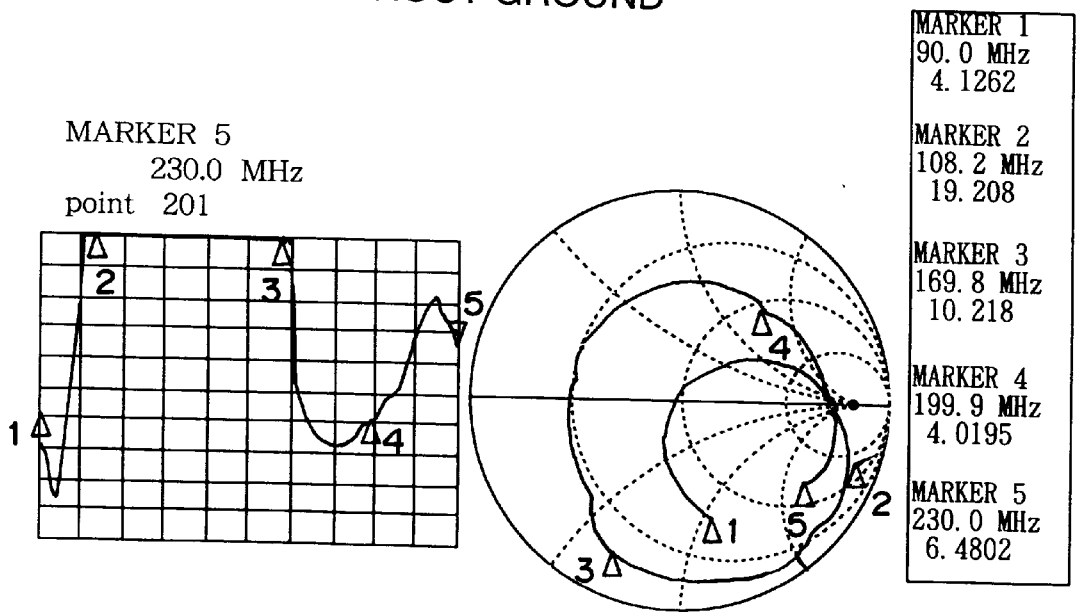
FIG. 75 is a set of graphs showing a VSWR characteristic of the T-shape antenna according to the first embodiment (without the grounding plate)
Figure 76:
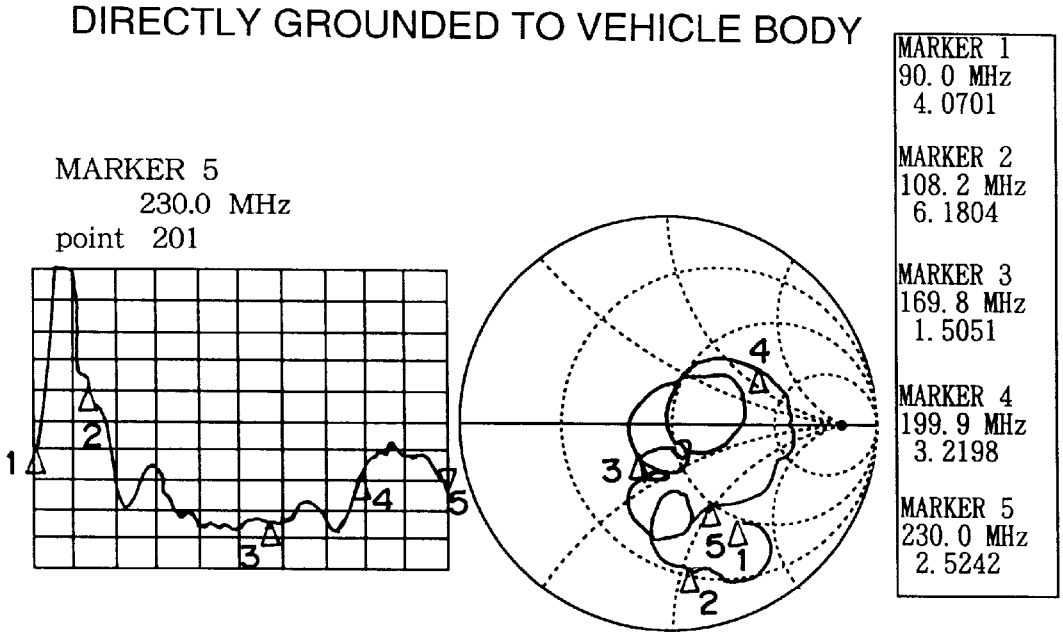
FIG. 76 is a set of graphs showing a VSWR characteristic of the T-shape antenna according to the first embodiment (the body is directly grounded)

FIGS. 68 to 73 are sets of graphs showing VSWR (Voltage Standing Wave Ratio) characteristics of the T-shape antenna 10 of the first embodiment connected with the open-end type ground wire with respect to a TV radio wave in a band from 90 to 230 MHz when the length of the open-end type ground wire is changed. For the purpose of comparison, FIG. 74 shows a VSWR characteristic of the antenna 10 with the ground plate in FIG. 11; FIG. 75, a VSWR characteristic of the antenna 10 without ground; and FIG. 76, a VSWR characteristic of the antenna 10 directly grounded to the vehicle body (the length of ground wire: about 15 cm). Assuming that it is most preferable to make direct grounding to a vehicle body or employ a ground plate for obtaining highest function of ground, the ground having the VSWR characteristic shown in FIG. 74 or 76 is ideal as a ground for the antenna 10 (FIG. 3). That is, an open-end type ground wire having a length from 50 to 60 cm, having a VSWR characteristic similar to that shown in FIGS. 72 or 73 is preferable.

Thus, a ground wire which is easily set and which has an appropriate reception performance can be provided by setting the length of the ground wire so as to satisfy $\delta\cdot\lambda/4$ ($\delta$ : transmission path reduction ratio of material existing between ground wire and vehicle body) in accordance with reception radio wavelength.

Next, influence of the open-end type ground wire on reception sensitivity will be described below.

Figure 77:
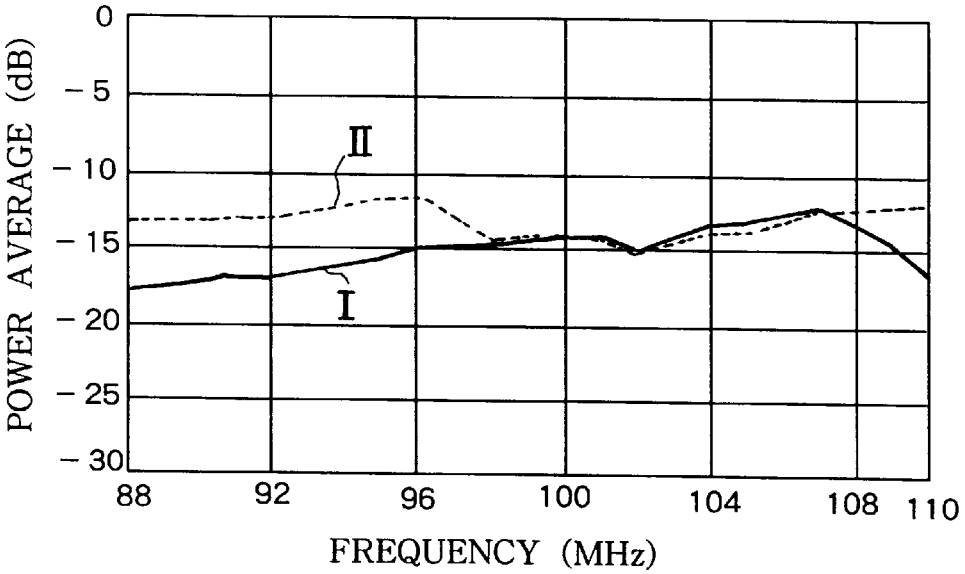
FIG. 77 is a graph showing reception characteristics of the T-shape antenna according to the first embodiment (reception band: 88–110 MHz)
Figures 78, 79:
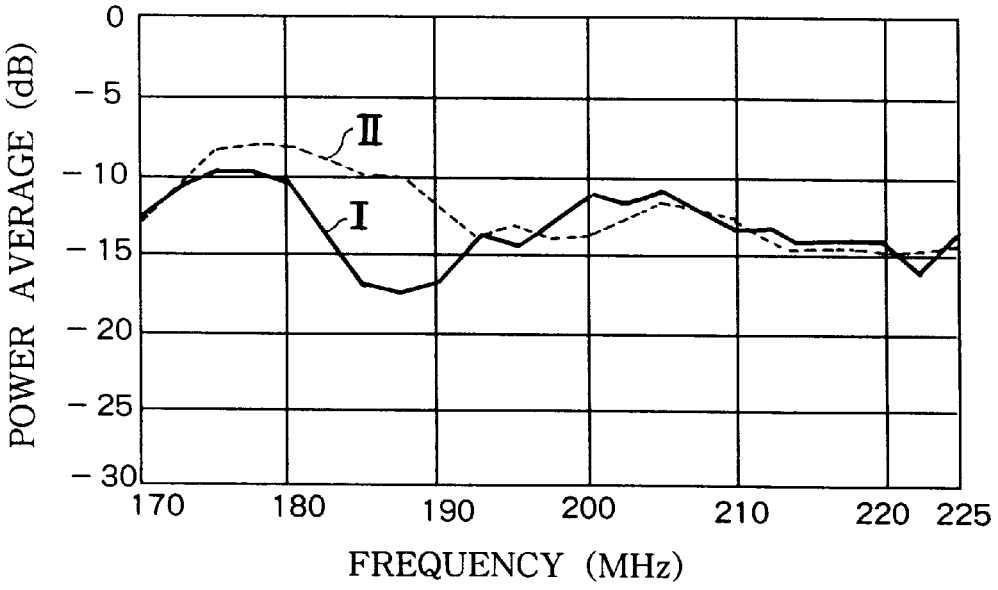
FIG. 78 is a table showing averaged reception characteristics of the T-shape antenna according to the first embodiment (reception band: 88–110 MHz)
FIG. 79 is a graph showing reception characteristics of the T-shape antenna according to the first embodiment (reception band: 170–225 MHz; ground length=53.5 cm)
Figures 80, 81:
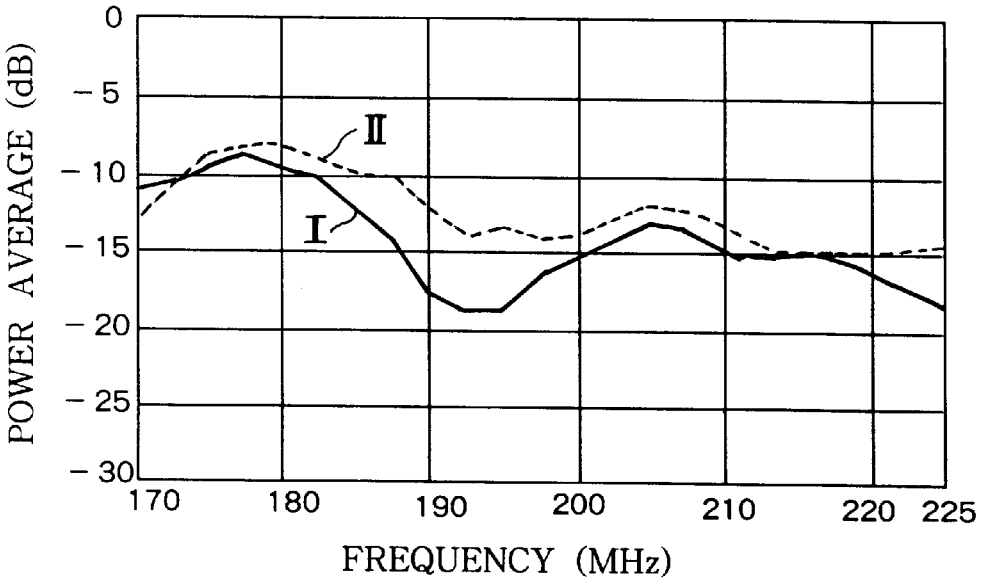
FIG. 80 is a table showing averaged reception characteristics of the T-shape antenna according to the first embodiment (reception band: 170–225 MHz; ground length=53.5 cm)
FIG. 81 is a graph showing reception characteristics of the T-shape antenna according to the first embodiment (reception band: 170–225 MHz; ground length=30 cm)
Figures 82, 83:
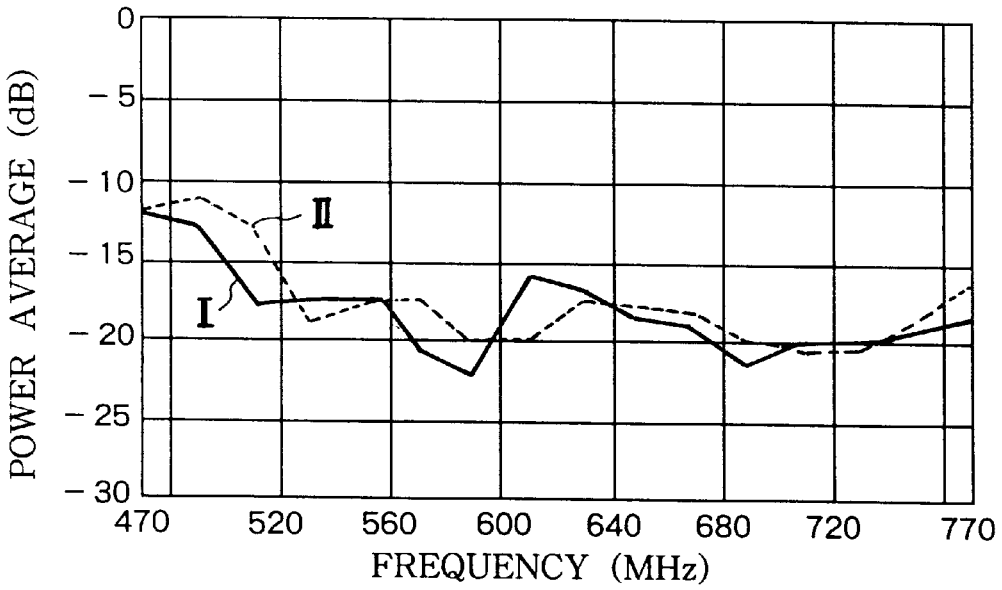
FIG. 82 is a table showing averaged reception characteristics of the T-shape antenna according to the first embodiment (reception band: 170–225 MHz; ground length=30 cm)
FIG. 83 is a graph showing reception characteristics of the T-shape antenna according to the first embodiment (reception band: 470–770 MHz; ground length=20 cm)
Figures 84, 85:
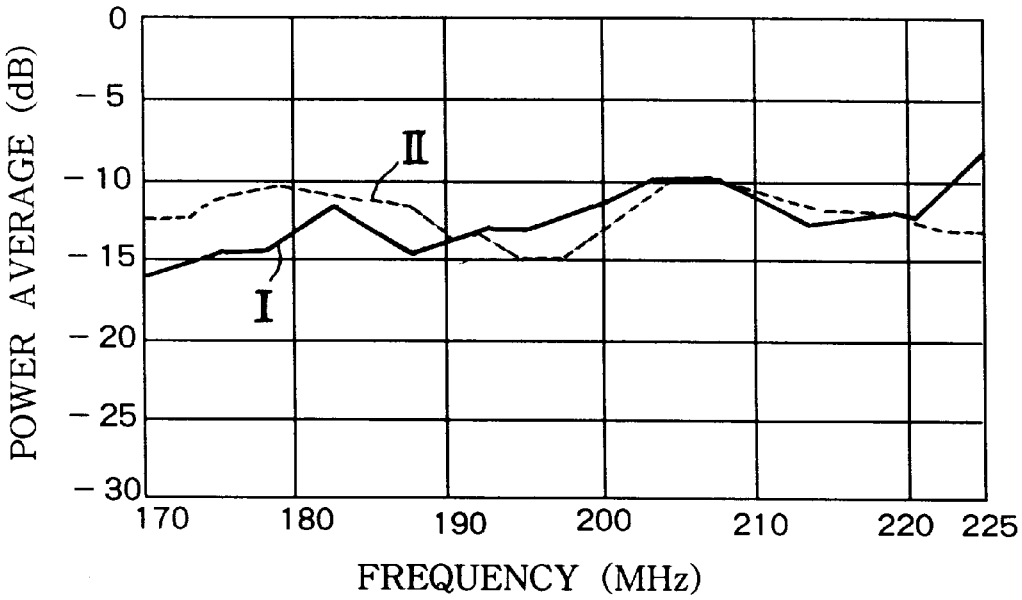
FIG. 84 is a table showing averaged reception characteristics of the T-shape antenna according to the first embodiment (reception band: 470–770 MHz; ground length=20 cm)
FIG. 85 is a graph showing reception characteristics of the rectangular antenna according to the first embodiment (reception band: 170–225 MHz; ground length=30 cm)

FIGS. 77, 79, 81 and 83 are graphs showing reception sensitivities of the T-shape antenna 10 in FIG. 3. FIGS. 78, 80, 82 and 84 are tables showing average reception sensitivities obtained from the above graphs. In FIGS. 77, 79, 81 and 83, a curve I shows a characteristic of the antenna 10 when it is connected to the open-end type ground wire; and a curve II, a characteristic of the antenna 10 when it is connected to the ground plate (FIG. 7) for the purpose of comparison. Especially FIGS. 77 and 78 show the reception sensitivities when the length of the open-end type ground wire is 90 cm for receiving radio waves in a band from 88 to 110 MHz. It is understood from FIG. 76 that a sufficient average sensitivity −15.1 dB is obtained. FIGS. 79 and 80 show the reception sensitivities when the length of the open-end type ground wire is 53.5 cm for receiving radio waves in a band from 170 to 225 MHz. It is understood from FIG. 80 that a sufficient average sensitivity −13.3 dB is obtained. FIGS. 81 and 82 show the reception sensitivities when the length of the open-end type ground wire is 30 cm for receiving radio waves in the 170 to 225 MHz band. It is understood from FIG. 82 that a sufficient average sensitivity −14.2 dB is obtained. FIGS. 83 and 84 show the reception sensitivities when the length of the open-end type ground wire is 20 cm for receiving radio waves in a band from 470 to 770 MHz. It is understood from FIG. 84 that a sufficient average sensitivity −18.1 dB is obtained.

Further, the graphs in FIGS. 77, 79, 81 and 83 indicate that reception characteristic as excellent as that of a ground plate can be obtained by appropriately setting the length of the open-end type ground wire.

Figures 86, 87:
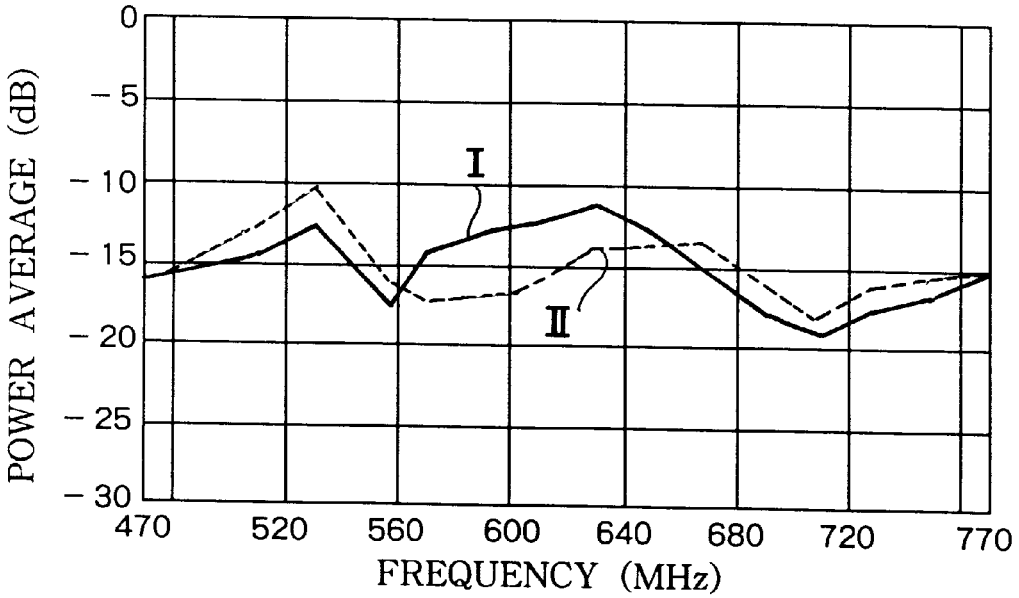
FIG. 86 is a table showing averaged reception characteristics of the rectangular antenna according to the first embodiment (reception band: 170–225 MHz; ground length=30 cm)
FIG. 87 is a graph showing reception characteristics of the rectangular antenna according to the first embodiment (reception band: 470–770 MHz; ground length=10 cm)

FIG. 85 is a graph showing reception sensitivities of the rectangular frame-type antenna 20 in FIG. 4 in receiving radio waves in a band from 170 to 225 MHz. In FIG. 85, a solid line I represents the reception characteristic of the antenna 20 when the length of the open-end type ground wire is set to 30 cm; and a broken line II, the reception characteristic when a ground plate is employed. FIG. 86 is a table showing average reception sensitivities obtained from FIG. 85.

FIG. 87 is a graph showing reception sensitivities of the rectangular antenna 20 in FIG. 4 in receiving radio waves in a band from 170 to 225 MHz when the length of the open-end type ground wire is set to 10 cm. FIG. 88 is a table showing average reception sensitivities obtained from FIG. 87.

From the above various tests, it is understood that when the open-end type ground wire is applied to a T-shape antenna like the antenna 10 in FIG. 3, if the maximum width x and the maximum height y are set so as to satisfy the following conditions $$y \leqq \alpha \cdot \lambda/4$$

$$x \leqq 60\ \text{cm} - y$$

and the width of the part below the 10 cm range from the upper end of the front window glass (the above-described reference base line 100T) is set within 6.6 cm, a desirable antenna device can be made.

Further, it is understood that when the open-end type ground wire is applied to a frame shape antenna like the antenna 20 in FIG. 4, preferable results are obtained to set the maximum width x and the maximum height y so as to satisfy the following conditions:

$$5\ \text{cm} \leqq x \leqq 40\ \text{cm}$$

$$3\ \text{cm} \leqq y \leqq 10\ \text{cm}$$

Further, it is understood that when the open-end type ground wire is applied to a circular shape antenna having a diameter of 7 cm, like the antenna 30 in FIG. 5, preferable results are obtained to set the maximum width x and the maximum height y so as to satisfy the following conditions:

$$y \leqq \alpha \cdot \lambda/4$$

$$x \leqq 60\ \text{cm} - y$$

Second Embodiment

As a second embodiment, the glass antenna of the present invention is applied to a side window glass. Especially wagon type vehicles may have side windows which are not opened/closed, and in such case, it is convenient to place the glass antenna on the un-opened window glass. Further, considering that an antenna for the VICS band must be placed apart from an antenna for the TV broadcast band, if the VICS antenna is placed on the front window glass as in the first embodiment shown in FIG. 50, the front window glass is occupied with many antenna wires, which is undesirable for some type of vehicles. In view of this inconvenience, the second embodiment places the VICS antenna on the side window glass.

The glass antenna according to the second embodiment is a frame antenna to which the glass-antenna designing method of the first embodiment (expressions (1) and (2) and designing conditions in FIG. 23) is applied.

Figure 89:
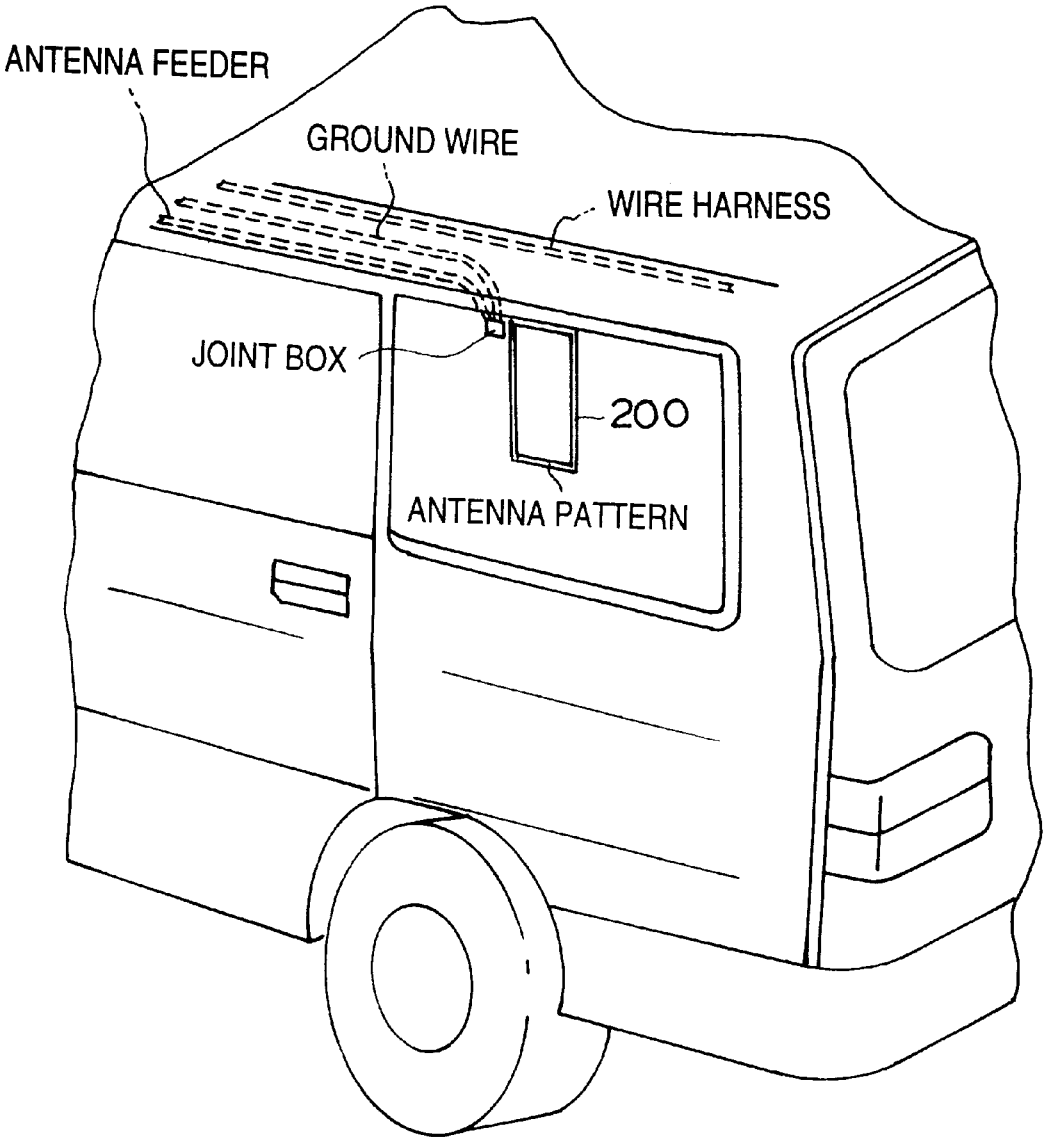
FIG. 89 is a perspective view showing a vehicular side window glass to which the glass antenna (with open-end type ground wire) according to a second embodiment of the present invention is attached.

FIG. 89 shows a frame antenna 200 according to the second embodiment attached onto a side window glass of a vehicle. An open end type antenna ground wire (FIG. 61) according to the first embodiment is attached to the antenna 200 of FIG. 89. In the antenna assembly illustrated in FIG. 89, a ground wire is attached to an inside of a body panel of the vehicle by virtue of adhesive seal. Since this adhesion is not required to electrically connect the ground wire to vehicle body, the post-installation of the antenna shown in FIG. 89 will not be so difficult, which is similar to the embodiment of FIG. 108.

In FIG. 89, the antenna 200 is illustrated as independent from a wire harness, and is connected to the open-end type ground wire of the first embodiment (FIG. 61). The antenna 200 has all the features of the frame antenna according to the first embodiment. Further, since the antenna 200 is connected to the open-end type ground wire, the antenna set has all the features of the open-end type ground wire.

If the designing conditions in the above-described expressions (1), (2) and FIG. 23 are applied to the glass antenna 200, preferable measurements of the glass antenna 200 are as follows:

$$x \leqq 30\ \text{cm}$$

$$20\ \text{cm} \leqq y \leqq 40\ \text{cm}$$

Figure 90:
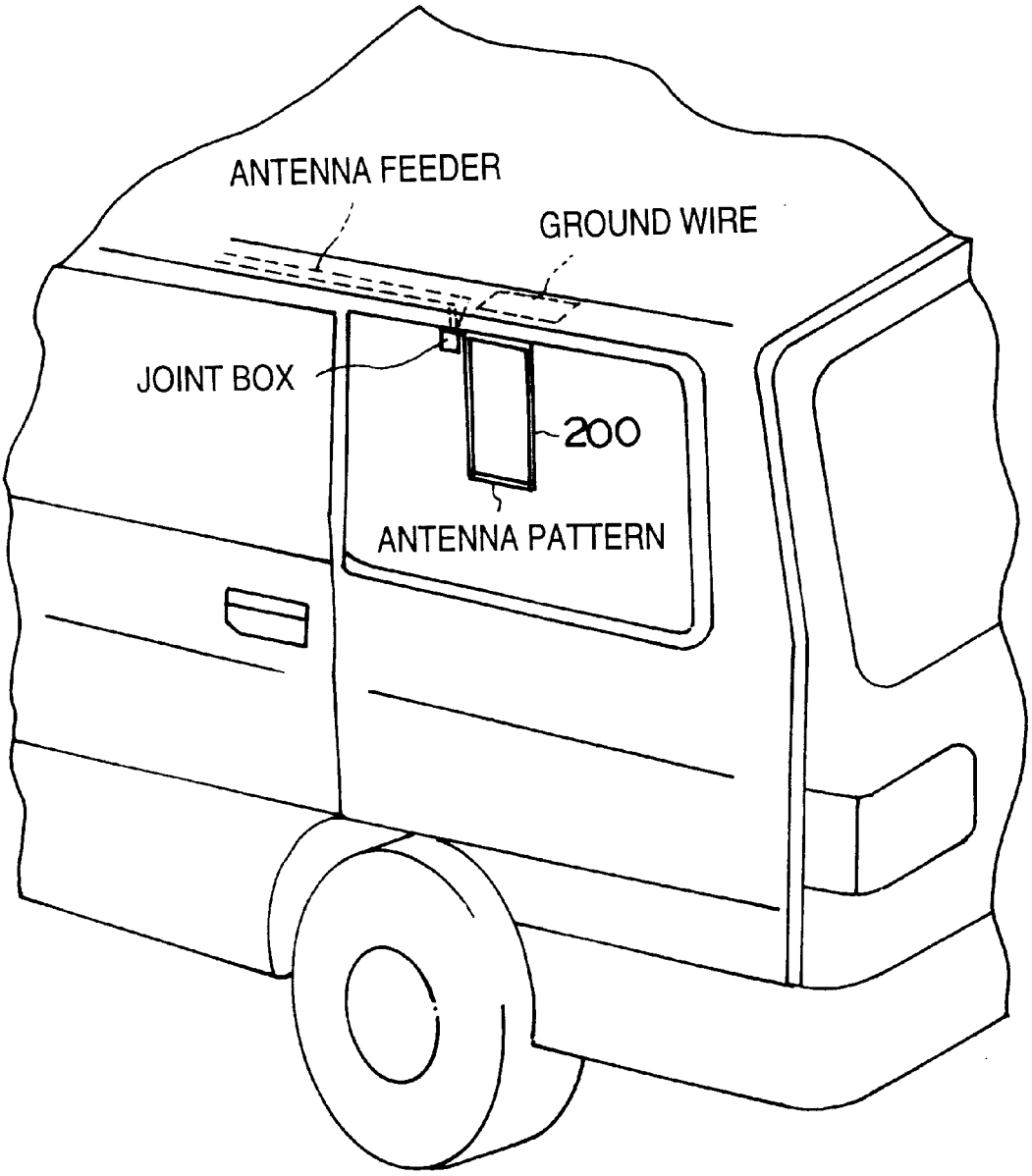
FIG. 90 is a perspective view showing a vehicular side window glass to which the glass antenna (with ground plate) according to the second embodiment is attached.

The ground of the glass antenna of the second embodiment is not limited to the open-end type ground wire so far as it satisfies the above designing conditions. FIG. 90 shows the antenna 200 connected to the ground plate. In this figure, the antenna 200 is placed on a side window glass.

Figure 91:
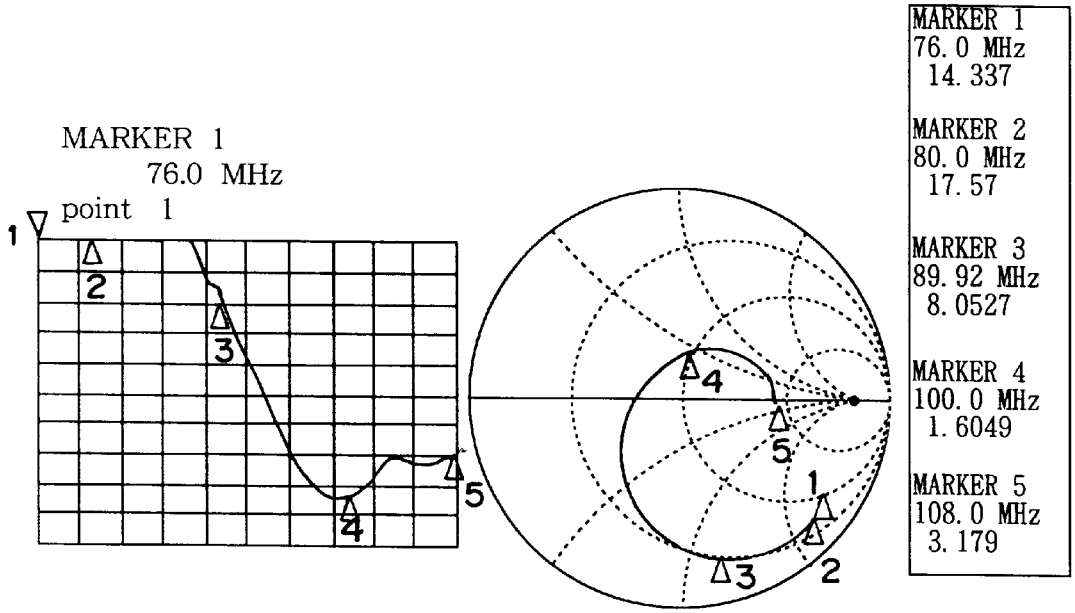
FIG. 91 is a set of graphs showing a VSWR characteristic of the antenna according to the second embodiment (without ground plate)
Figure 92:
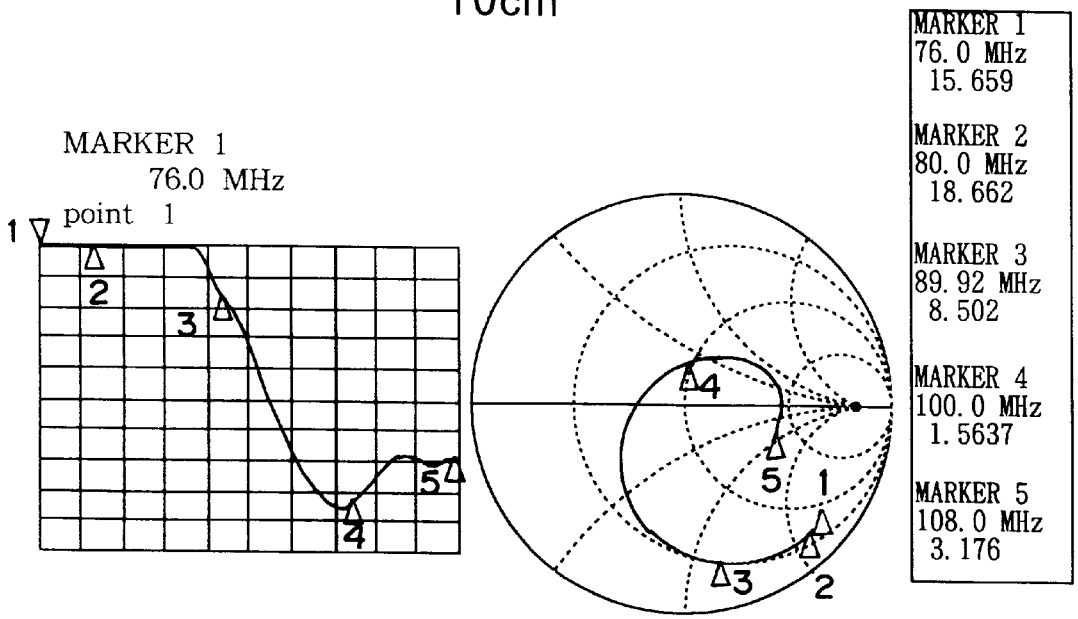
FIG. 92 is a set of graphs showing a VSWR characteristic of the antenna according to the second embodiment (ground wire length: 10 cm)
Figure 93:
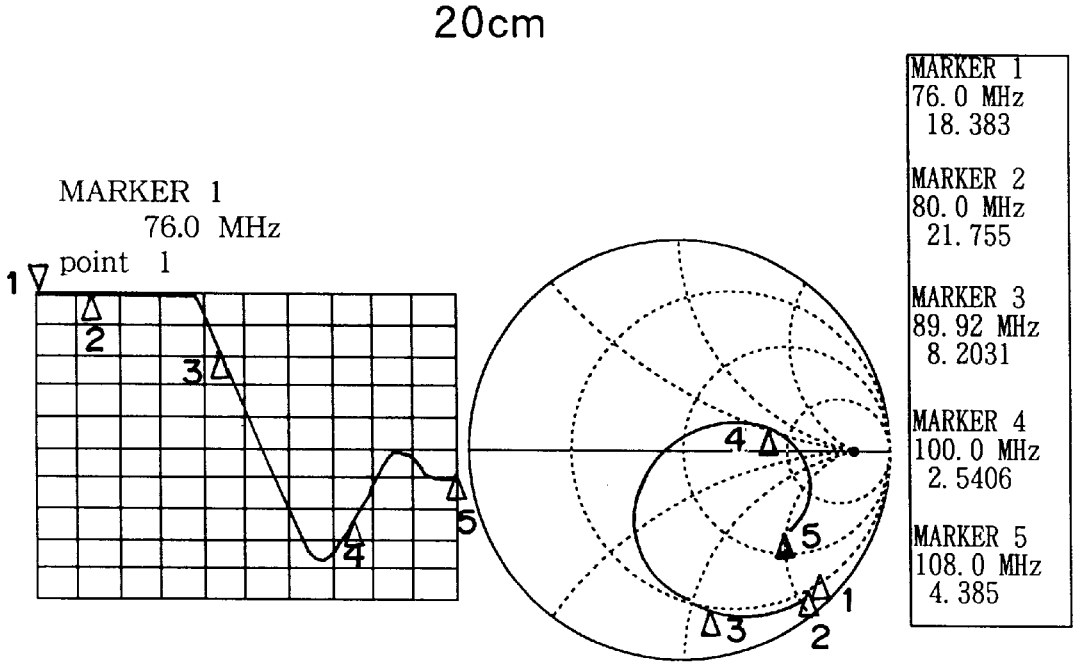
FIG. 93 is a set of graphs showing a VSWR characteristic of the antenna according to the second embodiment (ground wire length: 20 cm)
Figure 94:
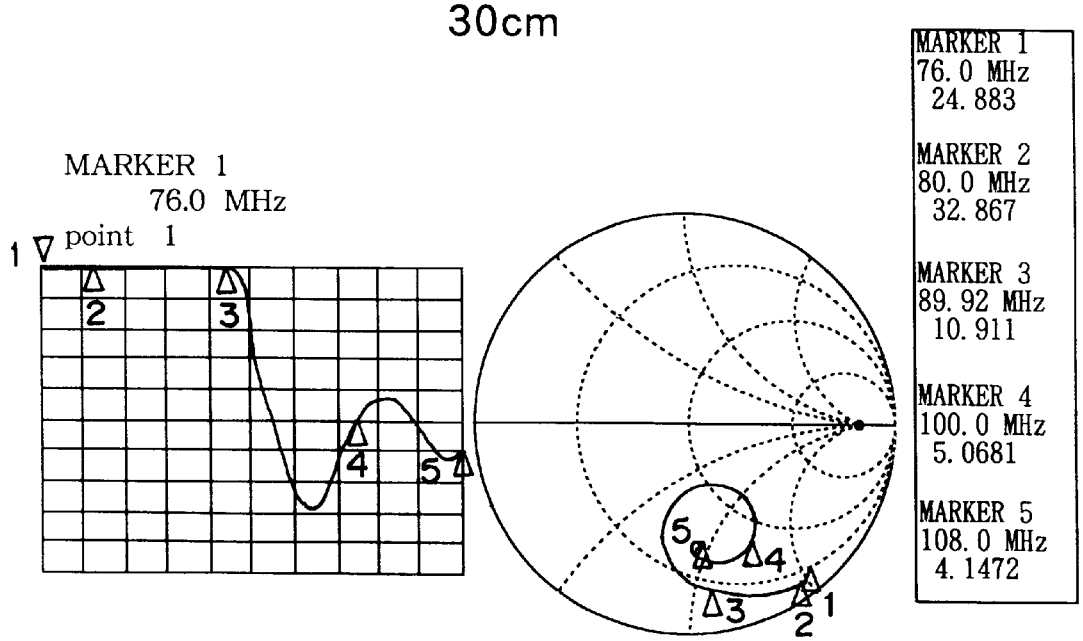
FIG. 94 is a set of graphs showing a VSWR characteristic of the antenna according to the second embodiment (ground wire length: 30 cm)
Figure 95:
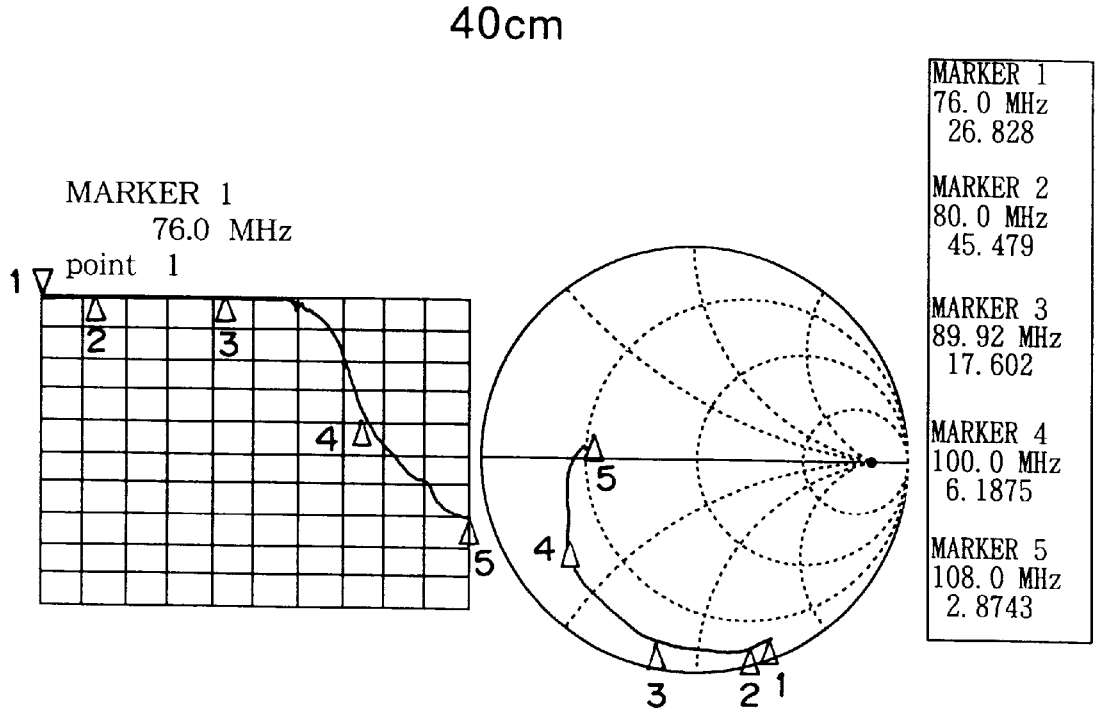
FIG. 95 is a set of graphs showing a VSWR characteristic of the antenna according to the second embodiment (ground wire length: 40 cm)
Figure 96:
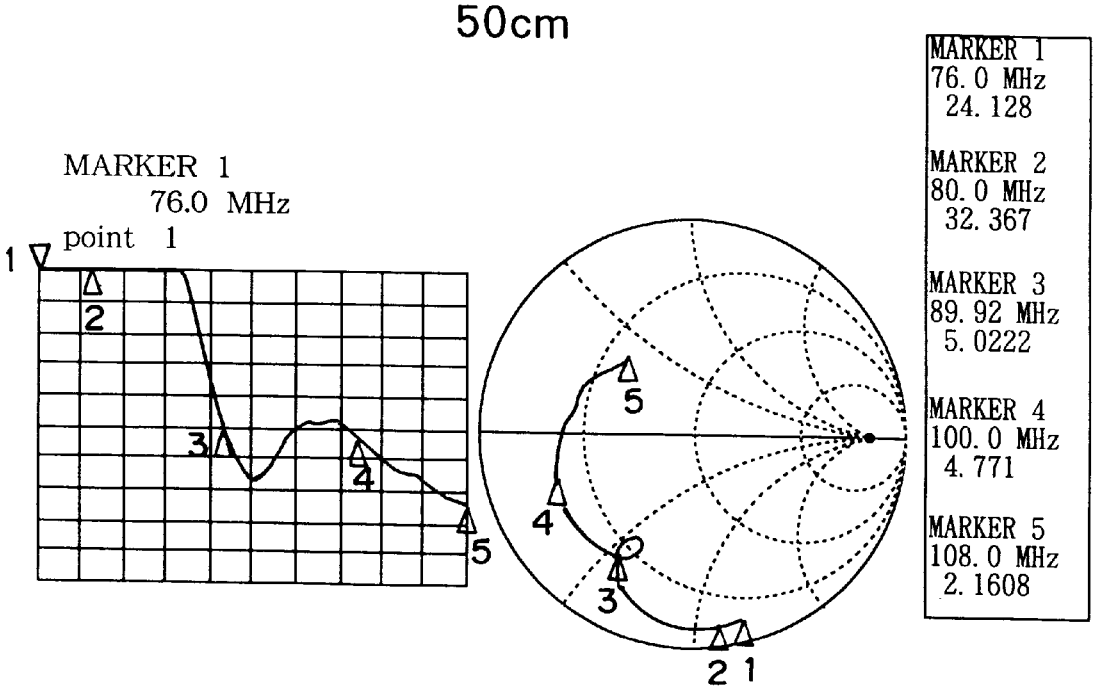
FIG. 96 is a set of graphs showing a VSWR characteristic of the antenna according to the second embodiment (ground wire length: 50 cm)
Figure 97:
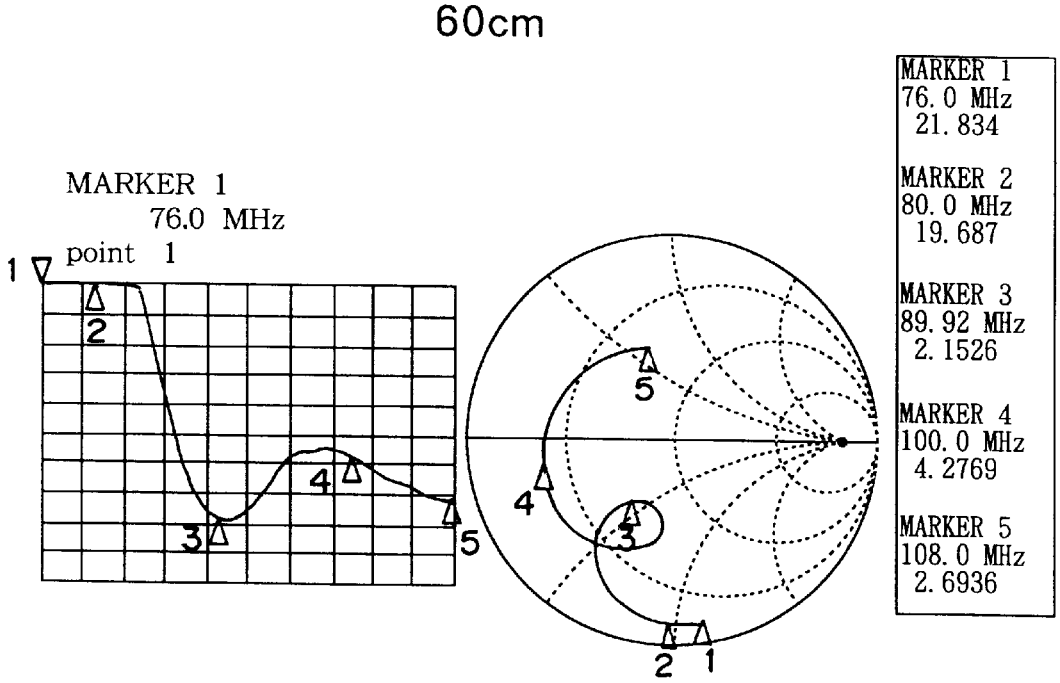
FIG. 97 is a set of graphs showing a VSWR characteristic of the antenna according to the second embodiment (ground wire length: 60 cm)
Figure 98:
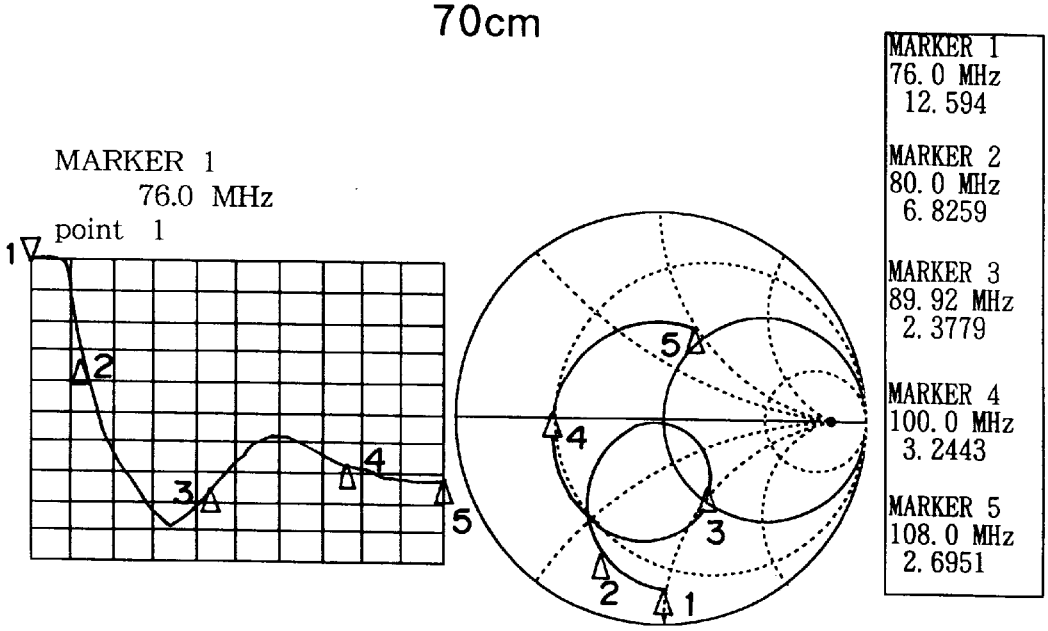
FIG. 98 is a set of graphs showing a VSWR characteristic of the antenna according to the second embodiment (ground wire length: 70 cm)
Figure 99:
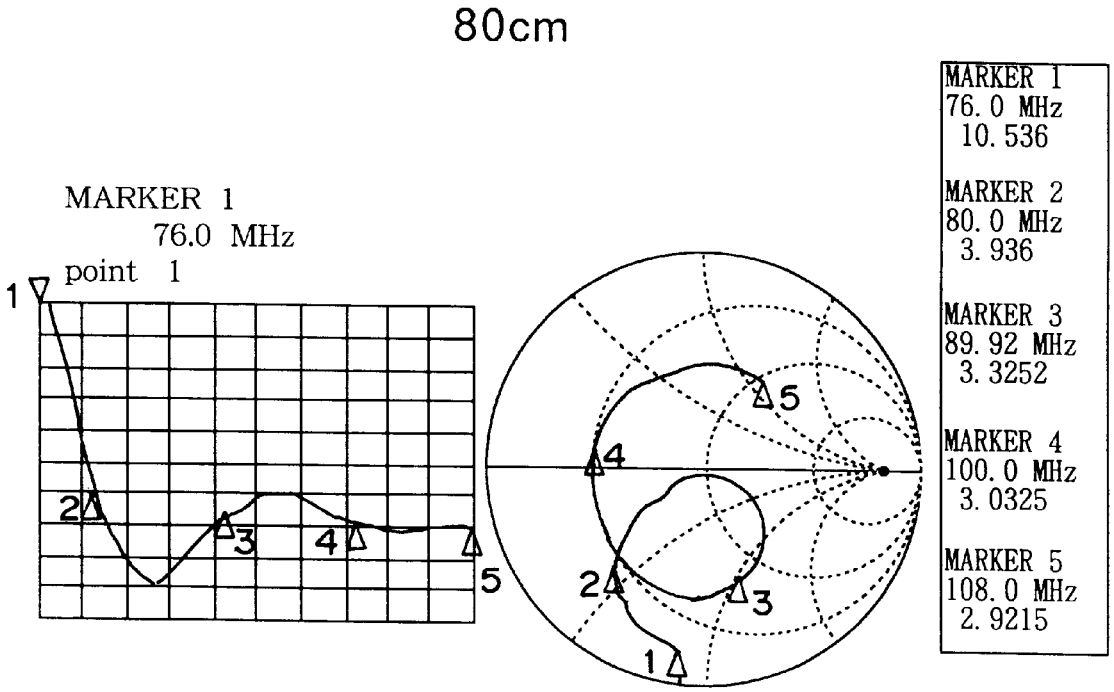
FIG. 99 is a set of graphs showing a VSWR characteristic of the antenna according to the second embodiment (ground wire length: 80 cm)
Figure 103:
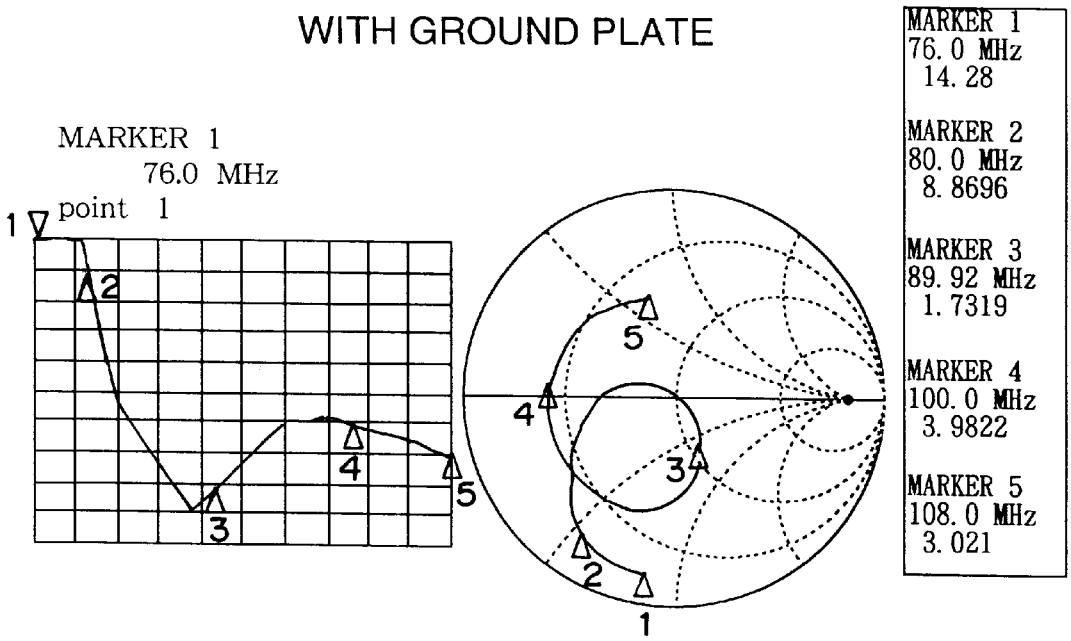
FIG. 103 is a set of graphs showing a VSWR characteristic of the antenna according to the second embodiment (with the ground plate)
Figure 104:
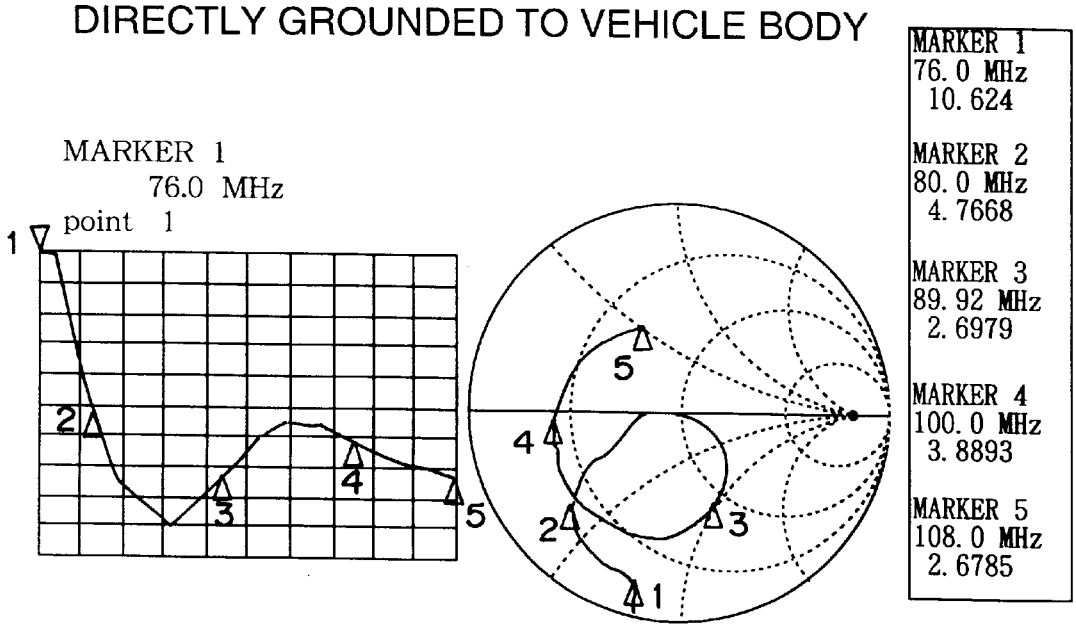
FIG. 104 is a set of graphs showing a VSWR characteristic of the antenna according to the second embodiment (the body is directly grounded)

FIGS. 92 to 102 are sets graphs showing VSWR characteristics of the VICS antenna 200 of the second embodiment, connected to the open-end type ground wire, in receiving TV radio waves in a band from 76 to 108 MHz, when the length of the open-end type ground wire is changed. For the purpose of comparison, FIG. 91 shows the VSWR characteristic of the antenna 200 without ground; FIG. 103, the VSWR characteristic of the antenna 200 with the ground plate; and FIG. 104, the VSWR characteristic of the antenna 200 directly grounded to the vehicle body.

It is apparent from the VSWR characteristic in FIG. 103 that the antenna 200 of the second embodiment with the ground plate is preferable for receiving FM radio waves in the VICS band.

Figure 100:
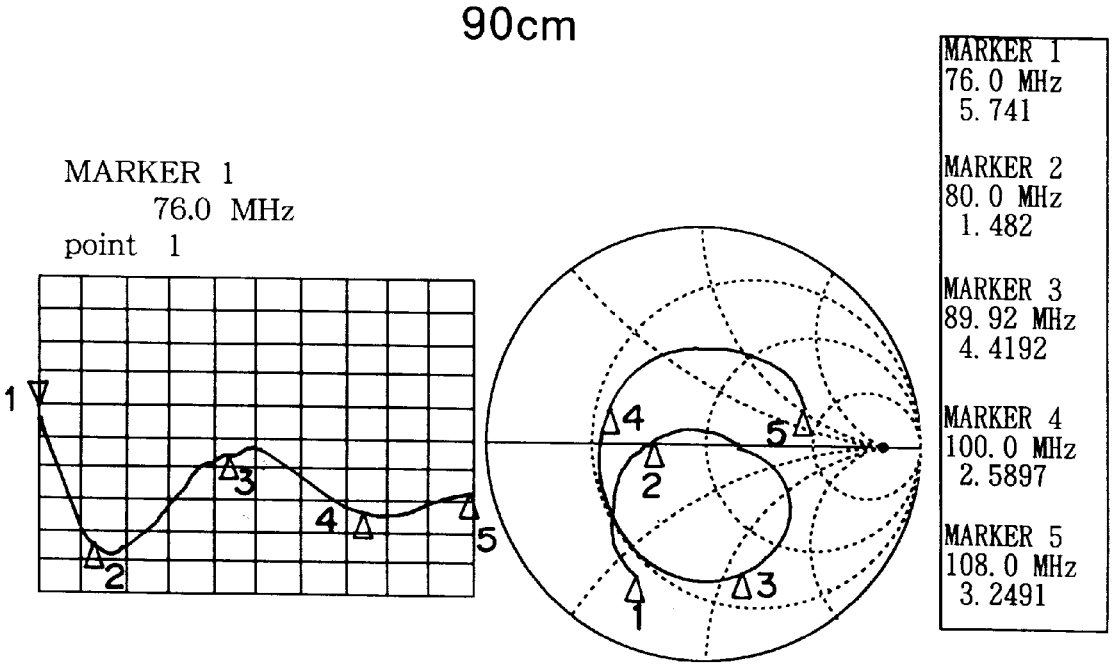
FIG. 100 is a set of graphs showing a VSWR characteristic of the antenna according to the second embodiment (ground wire length: 90 cm)
Figure 101:
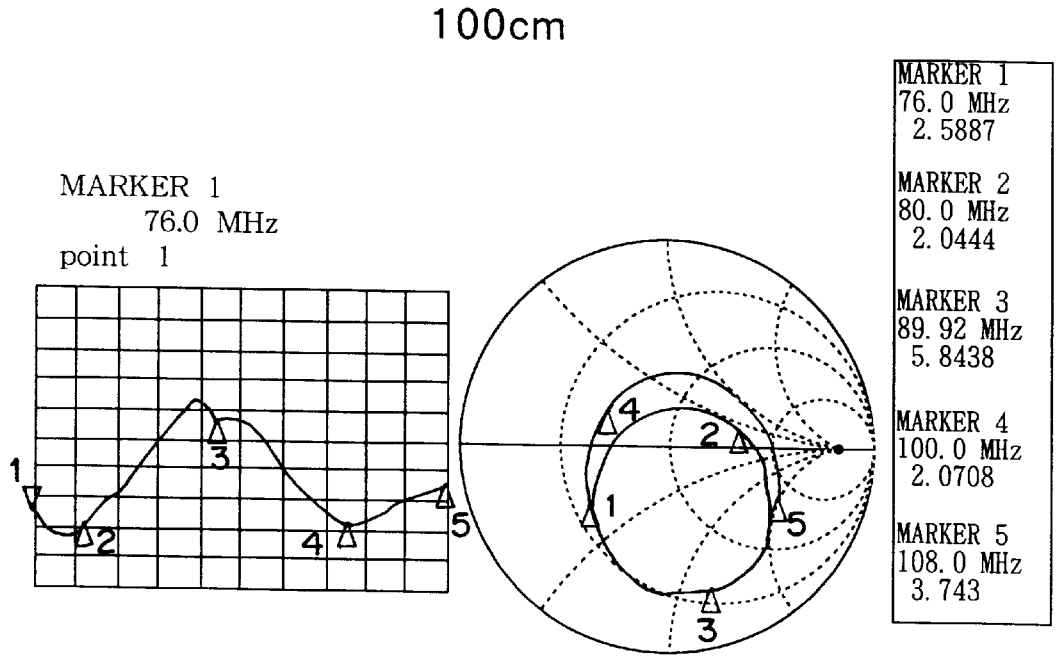
FIG. 101 is a set of graphs showing a VSWR characteristic of the antenna according to the second embodiment (ground wire length: 100 cm)
Figure 102:
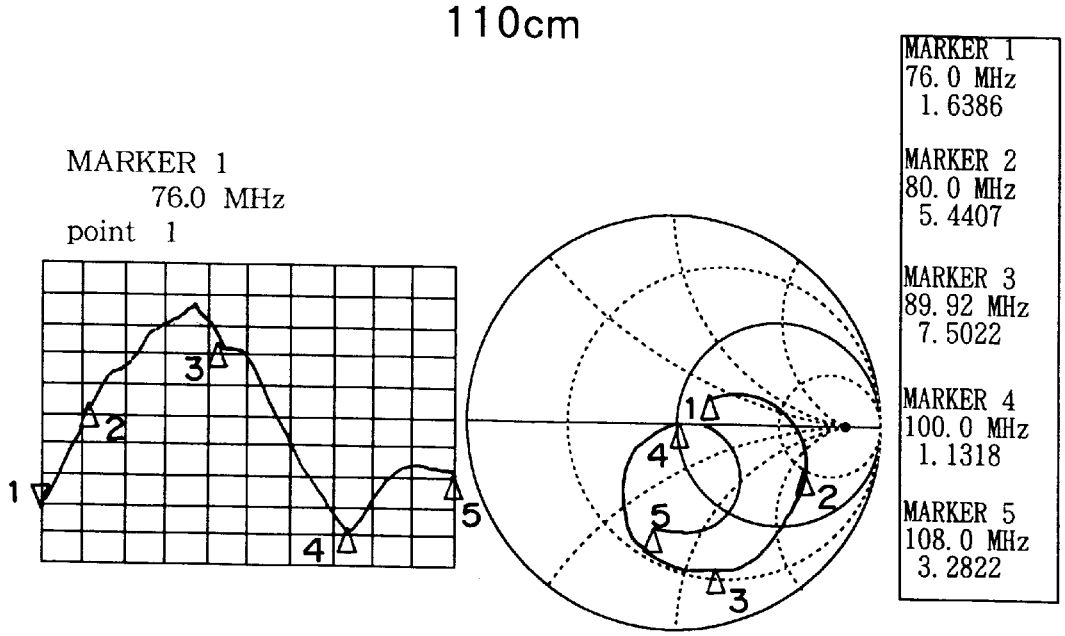
FIG. 102 is a set of graphs showing a VSWR characteristic of the antenna according to the second embodiment (ground wire length: 110 cm)

Further, it is understood from the graphs in FIGS. 92 to 102 that in a case where the antenna 200 of the second embodiment is used for receiving FM radio waves in the VICS band, it is preferable to set the length of the open-end type ground wire to 80 cm (FIG. 99) or 90 cm (FIG. 100).

Figures 105, 106:
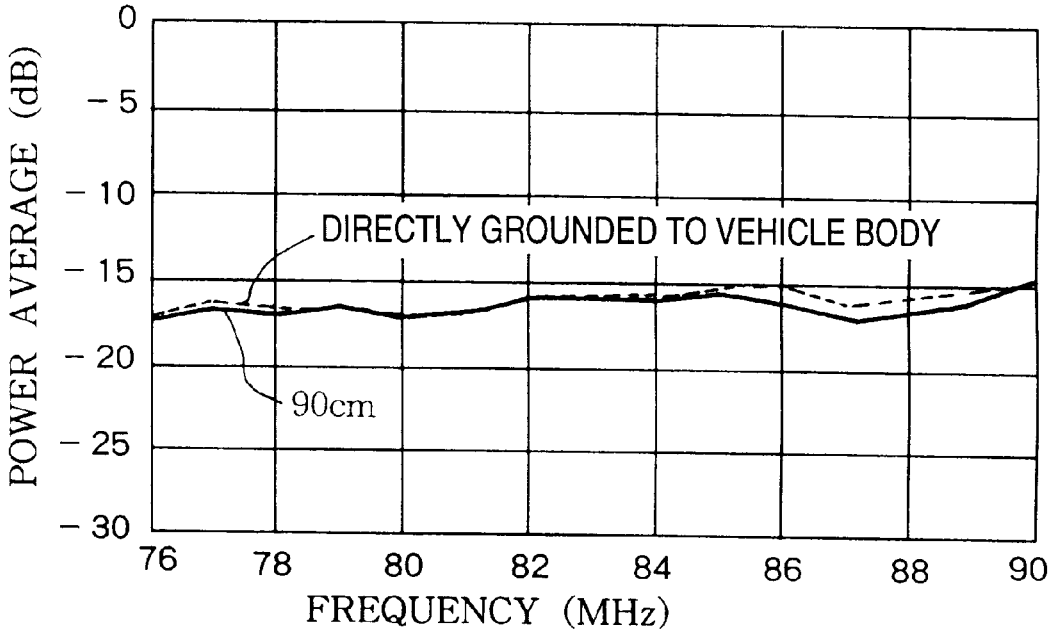
FIG. 105 is a graph showing reception characteristics of the antenna according to the second embodiment.
FIG. 106 is a table showing averaged reception characteristics of the antenna according to the second embodiment.

FIG. 105 is a graph showing a the reception sensitivities of the VICS antenna 200 with the open-end type ground wire having a length of 90 cm, placed on the side window glass. FIG. 106 is a table showing average reception sensitivities within an evaluation frequency range, obtained from FIG. 105. In FIG. 105, a broken line represents the reception characteristic when the antenna 200 is directly grounded to the vehicle body, given for the purpose of comparison.

Third Embodiment

As a third embodiment, the glass antenna of the present invention placed on a rear window glass will be proposed. The glass antenna of the third embodiment is the loop antenna employed in the first and second embodiment attached onto a rear window glass.

Figure 107:
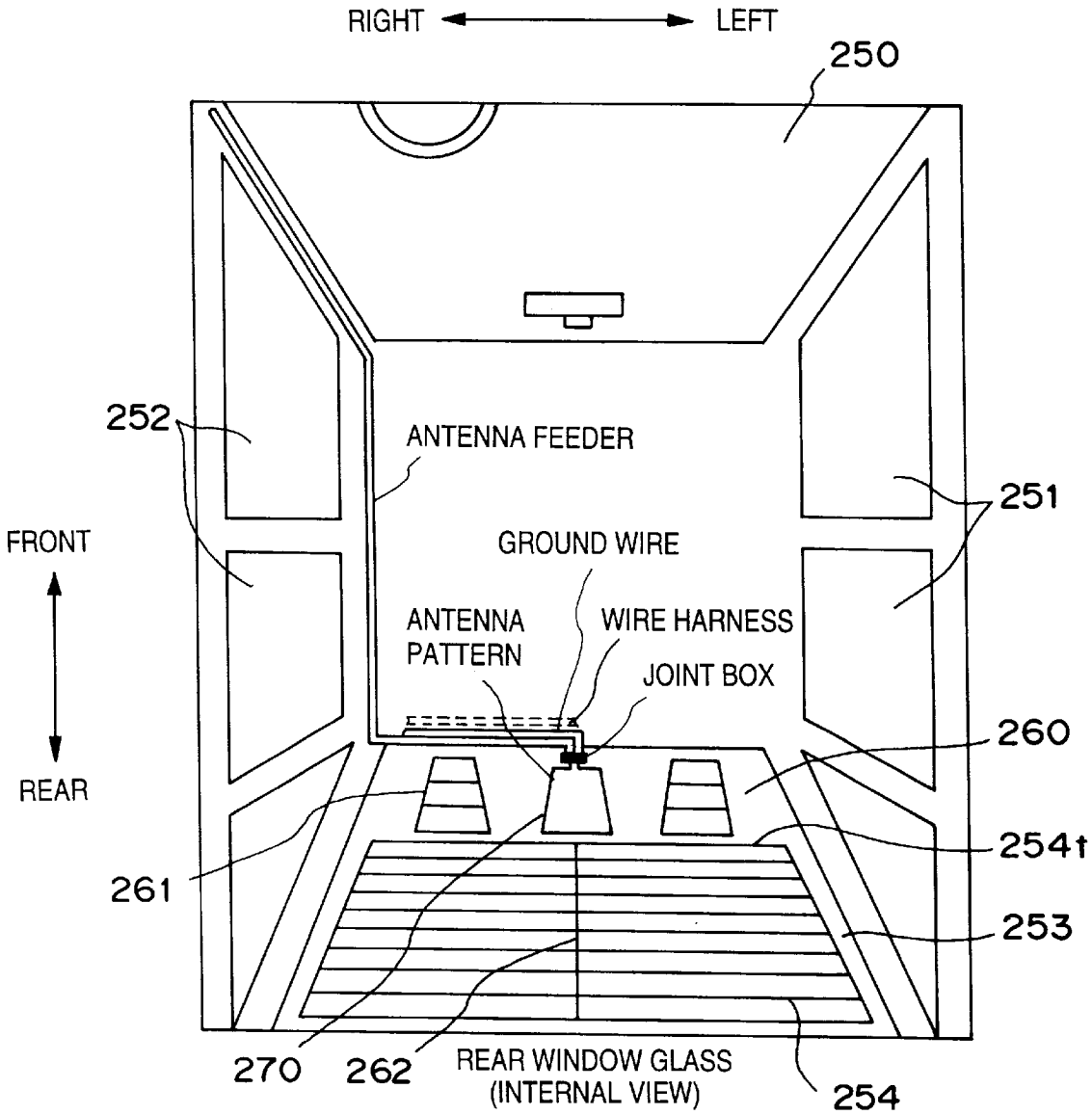
FIG. 107 is a perspective view showing a vehicular rear window glass to which the antenna according to a third embodiment is attached.

FIG. 107 is a perspective internal view of a vehicle body viewed from the bottom of the vehicle, where a glass antenna 270 according to the third embodiment is attached onto a rear window glass. In FIG. 107, numeral 250 denotes a front window glass; 251 and 252, side window glasses; and 253, the rear window glass.

A defogger 254 is placed on the rear window glass 253 where heating lines of the defogger are in parallel to a vehicular widthwise direction, and an antenna conductive wire 262 extends at the center of the defogger 254 vertically to the widthwise direction. The conductive wire 262 orthogonally intersects the heating lines of the defogger 254 and in direct-current connection with each of the heating lines.

At an upper part of the rear window glass 253, there is a blank area where the defogger heating line is not placed. Radio (or TV) antennas 260 and 261, and a VICS antenna 270 are placed in this area. Note that in FIG. 107, the antennas 260 and 261 have a ladder shape, and the VICS antenna 270, a frame shape.

The antenna assembly as shown in FIG. 107 may be attached to vehicle body with a similar method to that which attaches the ground wire assembly of FIG. 108 to vehicle body.

Bottom conductive wires of the antennas 260 and 261 are adjacent to an uppermost heating line 254t of the defogger 254. Accordingly, the antennas 260 and 261 are respectively capacitively coupled, via the heating 254t, with the conductive wire 262 vertically extending within the defogger 254.

Similarly, the VICS antenna 270 is capacitively coupled with the conductive wire 262.

For the capacitive coupling of the three antennas with the antenna conductive wire 262, the antennas are designed as follow.

That is, assuming that the length of the antennas 270, 260 and 261 in the vertical direction is y, the length of the antenna conductive wire 262 is L, and an antenna reduction ratio by the antenna conductive wire 262 is ω, the respective lengths y of the antennas are adjusted to satisfy:

$$20\text{ cm} \leqq y+\omega\cdot L \leqq 70\text{ cm}$$

Note that the open-end ground wire of capacitive coupling type is described in detail in Japanese Patent Application No. 6-205767 by the inventors of the present application.

Regarding the VICS antenna 270, it is necessary to satisfy the above-described expressions (1) and (2), and satisfy designing conditions shown in FIG. 23. That is, preferable measurements of the antenna 270 are:

$$x \leqq 30\text{ cm}$$

$$20\text{ cm} \leqq y+\omega L \leqq 40\text{ cm}$$

In the present embodiment, the VICS antenna 270 uses the above-described open-end type ground wire.

According to the antenna system of the third embodiment, a diversity system which receives radio waves in radio and TV broadcast bands and a VICS broadcast band can be provided.

The antenna system has the advantage of the antenna system of the first embodiment, and all the features of the open-end type ground wire.

Further Modifications

Various modifications can be made to the first to third embodiments within the scope of the present invention:

①: The antenna shapes of the glass antenna of the first to third embodiments are T-shape, rectangular and a circular shapes; the present invention can be any shape of antenna so far as it is a loop antenna and the loop is close to a feeding point.

②: In the expression (2) applied to the glass antenna of the first to third embodiments, the critical value is 60 cm since the antenna base is glass material; if the base is any other material than glass (with transmission path reduction ratio: γ), the critical value 60 cm can be generally predetermined 100×γ cm. If the reduction ratio γ of the base is smaller than the glass reduction ratio (α≈0.6), 100×γ cm is smaller than the critical value 60 cm. In this case, the size of the antenna can be minimized.

Figure 109:
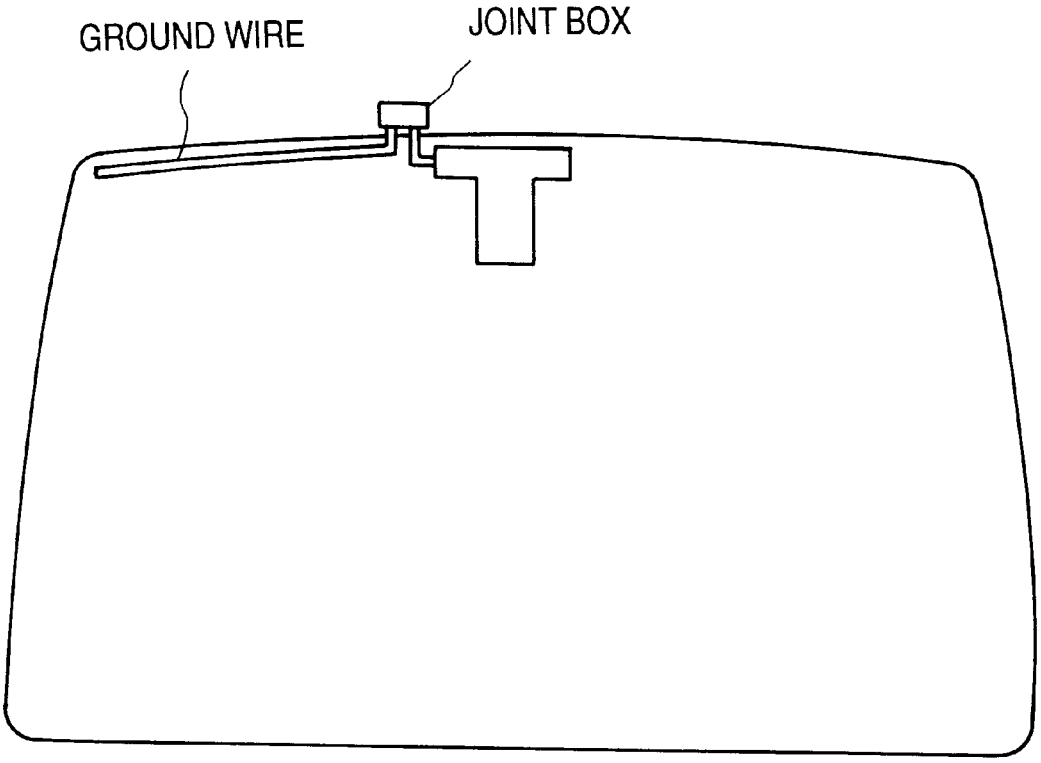
FIG. 109 is a schematic view showing a modification of the open-end type ground wire applicable to the antenna according to the first to third embodiments.

③: The open-end type ground wire employed in the first to third embodiments is used with the feeder cable; the ground wire applied to the present invention is not limited to this use. For example, a thin and slender sheet conductor can be attached to a glass surface as the open-end type ground wire, separated from the feeder cable, as shown in FIG. 109. Fixing the ground wire onto the glass surface will ease post-installation of ground wire assembly. Note that the shield of the feeder cable and the conductor is connected within the joint box. In this case, as the glass (reduction ratio: α) exists between the ground wire and the vehicle body, an appropriate length of the open-end type ground wire is $(\lambda/4)\cdot\alpha$ from the expression (5).

Figure 110A:
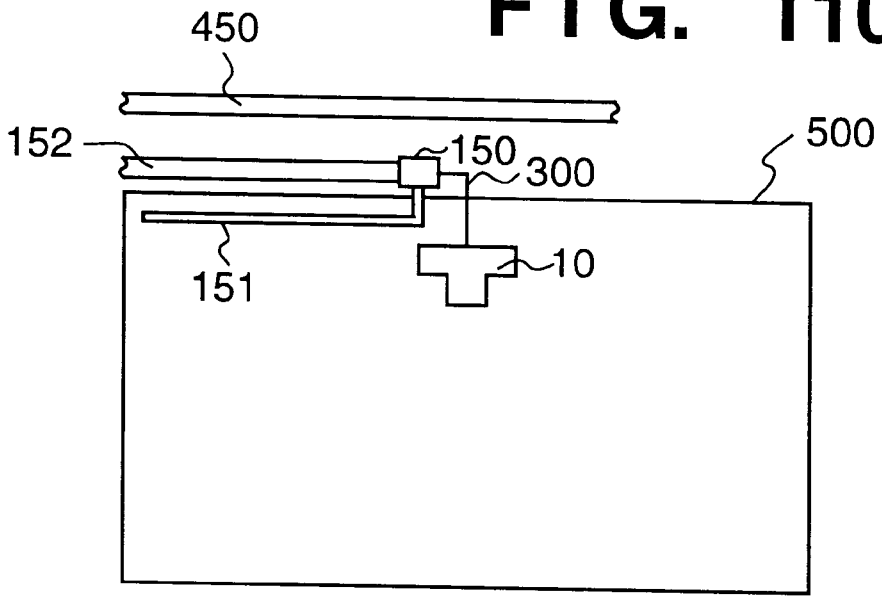
FIG. 110A is a view showing another example in which the ground wire shown in FIG. 109 is applied to a front glass.
Figure 110B:
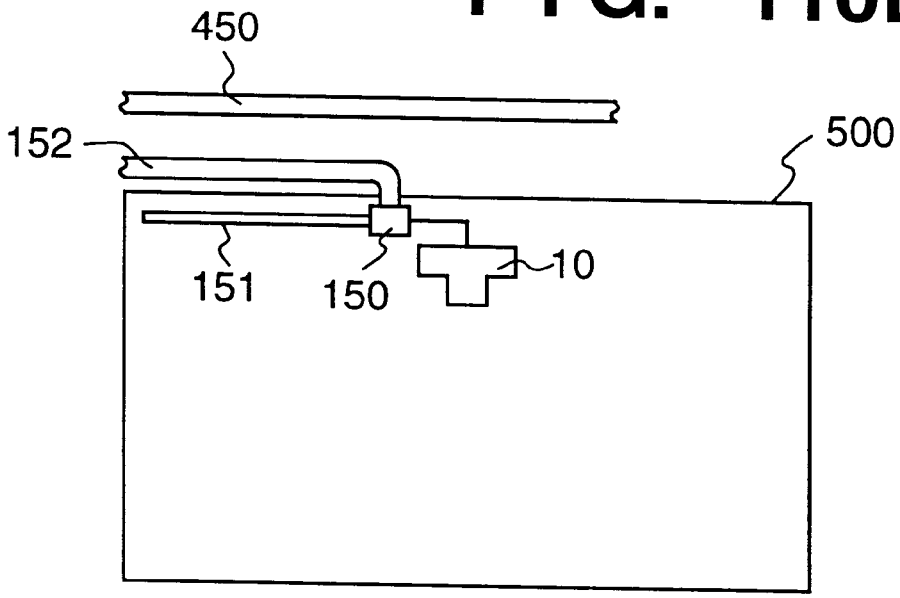
FIG. 110B is a view showing still another example in which the ground wire shown in FIG. 109 is applied to the front glass.
Figure 111A:
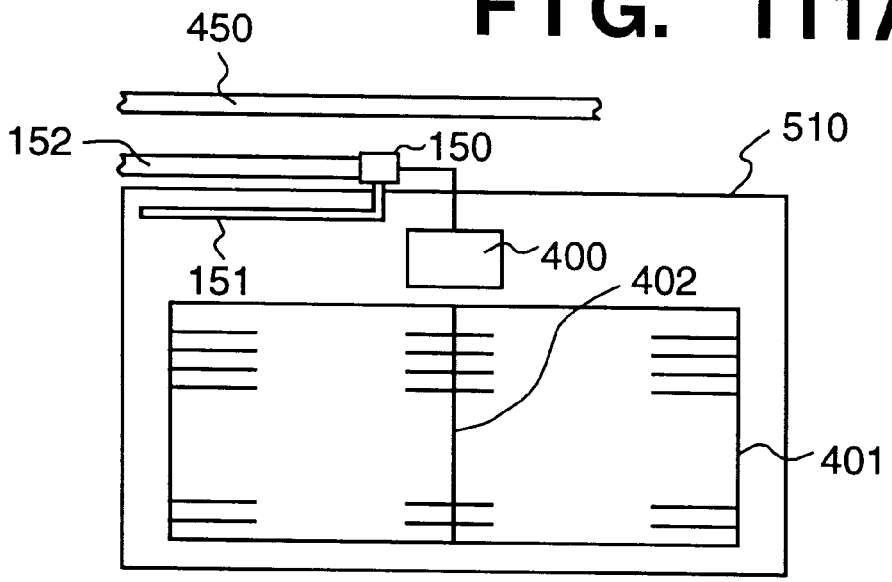
FIG. 111A is a view showing still another example in which the ground wire shown in FIG. 109 is applied to a rear glass.
Figure 111B:
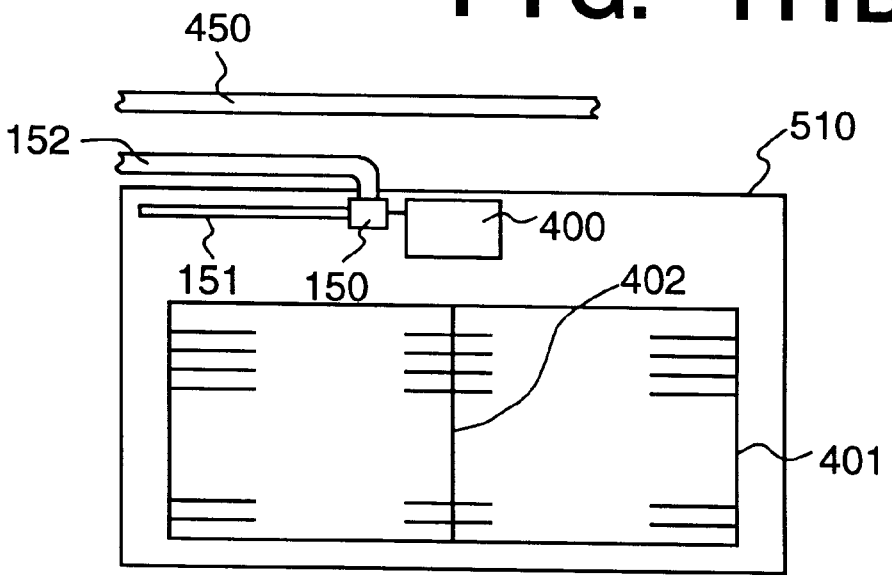
FIG. 111B is a view showing still another example in which the ground wire shown in FIG. 109 is applied to the rear glass.

FIGS. 110A and 110B are views showing two examples in which the open ended type ground wire of the present invention is applied to ground an antenna 10 (with the same shape as that of the antenna 10 shown in FIG. 1) arranged on the surface of a front window glass 500. FIGS. 111A and 111B are views showing two examples in which the open end type ground wire of the present invention is applied to ground an antenna 400 (equal to the antenna pattern shown in FIG. 99) provided on the surface of a rear window glass 510. A ground wire 151 shown in FIGS. 110A, 110B, 111A, and 111B is different from the ground wire shown in FIG. 61 in that the ground wire 151 is arranged on the glass.

In FIGS. 110A, 110B, 111A and 111B, 450 denotes wire harness from which the ground structures according to the embodiments are independent.

The earth structure shown in FIG. 110A or 110B is constituted by the ground wire 151 arranged on the surface of the glass 500 at its edge near the body metal, the shield line of a feeder line 152, and a joint box 150 for connecting the shield line to the ground wire 151.

The joint box 150 shown in FIG. 110A is arranged outside the glass 500 so as not to enter the view field of the driver. The joint box 150 must be fixed in the frame of the body to prevent the ground wire 151 from being detached from the joint box 150. The joint box 150 shown in FIG. 110B is fixed on the surface of the glass 500 (with, e.g., a self-adhesive sheet). Although the joint box 150 enters the view field of the driver, the example of FIG. 110B has an advantage over the example shown in FIG. 110A in case of attaching the ground wire after assembly of the vehicle because the box itself need not be pressed into the body.

FIGS. 111A and 111B show examples in which the earth structure of the present invention is applied to the rear window glass 510. Referring to FIGS. 111A and 111B, reference numeral 401 denotes a defogger heating wire. A second antenna line 402 extending on the glass surface at the central position in the direction of body width and perpendicular to the heating wire 401 is electrically connected to the defogger heating wire 401. The first antenna line 400 having a rectangular shape is arranged to extend on the glass surface where the first antenna line 400 is capacitively coupled to the second antenna line 402 and the uppermost defogger heating wire. The principle that the first antenna line 400 and the second antenna line 402 capacitively coupled to the first antenna line 400 act as a high-performance antenna is described in detail in U.S. Ser. No. 08/362,788 filed by the present inventor, and its contents are incorporated by reference in the specification of the present invention.

The earth structure shown in FIG. 111A is the same as that in FIG. 110A, and the earth structure shown in FIG. 111B is the same as that in FIG. 110B.

The ground wire 151 shown in FIGS. 110A, 110B, 111A, and 111B can be spread and adhered on the glass surface by various methods. When the ground wire of the present invention is to be set on the glass after assembly of the vehicle, the ground wire 151 is preferably adhered to the glass with, e.g., a self-adhesive sheet. If the ground wire can be set in the vehicle assembly factory, the ground wire 151 is preferably deposited on the glass in the assembly process from the viewpoint of strength.

④: The antenna of the embodiments has a specific shape in consideration of a sticker such as an automobile inspection sticker or a periodic service sticker, which must be stuck on a front window glass in conformity to the Japanese law; however, in the United States, for example, it is not necessary to stick such stickers on a front widow glass. Accordingly, in a country or state where a sticker like the above-mentioned automobile inspection sticker must be stuck on a window glass to observe the law or regulation, the shape of the glass antenna of the present invention should be changed in accordance with the shape of the sticker.

⑤: The regulations, made on attachments to a window glass which obstruct a driver's sight, for the purpose of ensuring the driver's sight, are different depending upon country, state or area. Accordingly, similar to the case of inspection sticker, the shape of the glass antenna of the present invention should be changed in accordance with the law or regulations thereof.

⑥: The earth structure of the above embodiment must be determined in correspondence with the frequency of a radio wave to be received. The table below shows the frequency bands of AM, FM, TV, or long wave (LW) radio waves used in various countries (Japan, Korea, ADR, European countries ECE, and U.S.A.).

TABLE

| Country/ Region | Band | Frequencies |
|---|---|---|
| Japan | AM | 522 kHz–1692 kHz |
| | FM | 76 MHz–90 MHz |
| | TV | 90 MHz–108 MHz, 170 MHz–222 MHz, |

TABLE-continued

| Country/ Region | Band | Frequencies |
|---|---|---|
| | | 470 MHz–770 MHz |
| Korea | AM | 526.5 kHz–1606.5 kHz |
| | FM | 88.9 MHz–107.7 MHz |
| | TV | 54 MHz–72 MHz, 76 MHz–88 MHz, 174 MHz–216 MHz, 470 MHz–752 MHz |
| ADR | AM | 522 kHz–1602 kHz |
| | TV | 87.5 MHz–108 MHz |
| ECE | AM | 531 kHz–1602 kHz |
| | FM | 87.5 MHz–108 MHz |
| | TV(E) | 47 MHz–68 MHz, 174 MHz to 230 MHz, 470 MHz–862 MHz |
| | LW | 153 kHz–279 kHz |
| USA | AM | 530 kHz–1710 kHz |
| | FM | 88.1 MHz–107.9 MHz |
| | TV | 54 MHz–72 MHz, 76 MHz–88 MHz, 174 MHz–216 MHz, 470 MHz–806 MHz |

As described above, in accordance with the present invention, a glass antenna having high performance while ensuring visibility can be provided, and the glass antenna can be easily designed.

Further, the size of the antenna can be controlled by selecting antenna base material.

Further, antennas for various frequency bands can be designed by utilizing a rear defogger.

As many apparently widely different embodiments of the present invention can be made without departing from the spirit and scope thereof, it is to be understood that the invention is not limited to the specific embodiments thereof except as defined in the appended claims.

What is claimed is:

1. An earth structure, adapted for an antenna conductor element and formed independently of a body metal portion of the vehicle, comprising:

an antenna feeder line; and an earth line member having a first end portion conductively connected to one end of the antenna feeder line and a second end portion which is open, and having an earth effective portion extending from said first end portion to said second end portion of said earth line member, said earth effective portion being covered with an insulating material to be insulated from said body metal portion and being bundled with said antenna feeder line, wherein when an antenna structure is adapted to the antenna conductor element for installing an antenna system on the vehicle, the antenna conductor element is set on a glass window of the vehicle, and said earth effective portion and said antenna feeder line are inserted into an interior of a ceiling panel of the vehicle so that said earth effective portion may be arranged along said body metal portion, and be attached to a vehicle side independently of a harness provided on said vehicle which is independent from said antenna feeder line.

2. The structure according to claim 1, wherein when said feeder line has a coaxial shield line, said first end portion of said earth line member is connected to a portion of said shield line.

3. The structure according to claim 1, wherein said earth line member is flexible.

4. The structure according to claim 1, wherein said first end portion of said earth line member is arranged near said electrically conductive member.

5. The structure according to claim 1, wherein said earth line member serves as a transmission line, and wherein a length of said earth line member is set in correspondence with a wavelength of a radio wave to be received.

6. The structure according to claim 5, wherein the length of said earth line member as the transmission line is set such that an impedance with respect to said first end portion substantially becomes zero.

7. The structure according to claim 6, wherein a length from said first end portion to said second end portion of said earth line member is set to be substantially ¼ the wavelength $\lambda$ of the radio wave to be received.

8. The structure according to claim 6, wherein said earth line member is arranged along said electrically conductive member through a predetermined insulating layer having a path reduction ratio $\delta$, and the length of said earth line member is set to be $\delta \cdot \lambda/4$.

9. The structure according to claim 1, wherein the length of said line member is set to be substantially $\alpha \cdot \lambda/4$ where $\alpha$ is a path reduction ratio of said window glass.

10. The structure according to claim 1, wherein said earth line member is flexible so that said member may be arranged along a surface of said body metal portion.

11. The structure according to claim 1, wherein when the bundled set is inserted into the ceiling panel, said antenna feeder line is attached with an adhesive.

12. An earth structure, adapted for an antenna conductor element and formed independently of a body metal portion of the vehicle, comprising:

an antenna feeder line; and an earth line member having a first end portion electrically-conductively connected to one end of the antenna feeder line and a second end portion which is open, and having an earth effective portion extending from said first end portion to said second end portion of said earth line member, said earth effective portion being covered with an insulating material to be insulated from said body metal portion and being bundled with said antenna feeder line, wherein when an antenna structure is adapted to the antenna conductor element for installing an antenna system on the vehicle, said antenna feeder line is connected to the body of the vehicle, the antenna conductor element is set on a glass window of the vehicle, and said earth effective portion and said antenna feeder line are inserted into an interior of a ceiling panel of the vehicle so that said earth effective portion may be arranged along said body metal portion, and be attached to a vehicle side independently of a harness provided on said vehicle which is independent from said antenna feeder line.

13. An earth structure, adapted for antenna conductor element and formed independently of a body metal portion of the vehicle, comprising:

an antenna feeder line; and an earth line member having a first end portion electrically-conductively connected to one end of the antenna feeder line and a second end portion which is open, and having an earth effective portion extending from said first end portion to said second end portion of said earth line member, said earth effective portion being covered with an insulating material to be insulated from said body metal portion and being bundled with said antenna feeder line, wherein when said antenna structure is adapted to the antenna conductor element for installing an antenna system on the vehicle, the antenna conductor element is set on a glass window of the vehicle, and said earth effective portion and said antenna feeder line are inserted into an interior of a ceiling panel of the vehicle so that said earth effective portion may be arranged along said body metal portion, and be attached to a vehicle side independently of a harness provided on said vehicle which is independent from said antenna feeder line, and wherein said earth line member, said antenna feeder line and the antenna conductor element are connected at a connector provided on the glass window.

14. The structure according to claim 13, wherein said connector comprises an enclosure box that covers a portion of said earth line member which is not insulated by the insulating material.

15. An earth structure, adapted for an antenna conductor element and formed independently of a body metal portion of the vehicle, comprising:

an antenna feeder line; and an earth line member having a first end portion electrically-conductively connected to one end of the antenna feeder line and a second end portion which is open, and having an earth effective portion extending from said first end portion to said second end portion of said earth line member, said earth effective portion being covered with an insulating material to be insulated from said body metal portion and being bundled with said antenna feeder line, wherein when an antenna structure is adapted to the antenna conductor element for installing an antenna system on the vehicle, the antenna conductor element is set on a glass window of the vehicle, and said earth effective portion and said antenna feeder line are inserted into an interior of a ceiling panel of the vehicle so that said earth effective portion may be arranged along said body metal portion, and be attached to a vehicle side independently of a harness provided on said vehicle which is independent from said antenna feeder line, and wherein said earth structure is installed in the vehicle in the fields after the vehicle is shipped out from a factory.

* * * * *

UNITED STATES PATENT AND TRADEMARK OFFICE

CERTIFICATE OF CORRECTION

PATENT NO.: 6,018,322
DATED : January 25, 2000
INVENTOR(S): Tatsuaki TANIGUCHI, et al.

It is certified that error appears in the above-identified patent and that said Letters Patent is hereby corrected as shown below:

Title Page [56] FOREIGN PATENT DOCUMENTS, change "20272804" to --2-272804--.

Column 10, line 6, change "moling" to --molding--;
line 8, change "mole" to --molding--.

Column 12, line 47, change "≈" to --≒--.

Column 18, line 13, delete ", therefor";
line 27, change "method or the" to --methods using a--;
line 28, delete "(FIG. 11) of the present".

Column 22, line 25, change "≈" to --≒--.

Column 23, line 40, change "widow" to --window--.

Signed and Sealed this

First Day of May, 2001

*Attest:*

Nicholas P. Godici

NICHOLAS P. GODICI

*Attesting Officer*

*Acting Director of the United States Patent and Trademark Office*